US011753800B2

(12) United States Patent
Maehara et al.

(10) Patent No.: US 11,753,800 B2
(45) Date of Patent: Sep. 12, 2023

(54) HYDRAULIC DRIVE SYSTEM FOR CONSTRUCTION MACHINE

(71) Applicant: Hitachi Construction Machinery Tierra Co., Ltd., Koka (JP)

(72) Inventors: Taihei Maehara, Koka (JP); Kiwamu Takahashi, Moriyama (JP); Takeshi Ishii, Hino-cho (JP); Yuichi Ogawa, Koka (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 13 days.

(21) Appl. No.: 17/641,964

(22) PCT Filed: Mar. 27, 2020

(86) PCT No.: PCT/JP2020/014255
§ 371 (c)(1),
(2) Date: Mar. 10, 2022

(87) PCT Pub. No.: WO2021/192287
PCT Pub. Date: Sep. 30, 2021

(65) Prior Publication Data
US 2022/0307228 A1 Sep. 29, 2022

(51) Int. Cl.
*E02F 9/22* (2006.01)
*F15B 11/17* (2006.01)
(Continued)

(52) U.S. Cl.
CPC ..... *E02F 9/2235* (2013.01); *E02F 9/2228* (2013.01); *E02F 9/2267* (2013.01);
(Continued)

(58) Field of Classification Search
CPC . F15B 11/165; F15B 11/17; F15B 2211/2656; F15B 2211/36; E02F 9/2232;
(Continued)

(56) References Cited

U.S. PATENT DOCUMENTS 5,056,312 A * 10/1991 Hirata ..... E02F 9/2292 91/518
9,249,812 B2 * 2/2016 Jeon ..... E02F 9/2282
(Continued)

FOREIGN PATENT DOCUMENTS

JP 2009-52339 A 3/2009
JP 2012-82643 A 4/2012
(Continued)

OTHER PUBLICATIONS

International Search Report (PCT/ISA/210) issued in PCT Application No. PCT/JP2020/014255 dated Jun. 23, 2020 with English translation (four (4) pages).
(Continued)

*Primary Examiner* — Michael Leslie
(74) *Attorney, Agent, or Firm* — Crowell & Moring LLP

(57) ABSTRACT

A controller calculates the ratio between the sum of estimated demanded powers of a plurality of first actuators and the sum of estimated demanded powers of a plurality of second actuators, and calculates, on the basis of the ratio, first and second command values for adjusting allocation between a first allowable torque of a first pump and a second allowable torque of a second pump, and first and second regulators adjust the first and second allowable torques, on the basis of first and second output pressures of first and second torque control valves, such that the first and second allowable torques become values to which a predetermined allowable torque is allocated according to the ratio described above, and control the delivery flow rates of the first and second pumps such that the respective consumed torques of the first and second pumps do not become larger than the first and second allowable torques. Thus, the present invention efficiently performs torque allocation between the first and second pumps (a plurality of hydraulic pumps) to
(Continued)

thereby enable effective utilization of the torque generated by the prime mover without wasting the torque.

5 Claims, 22 Drawing Sheets

(51) Int. Cl.
*F15B 11/16* (2006.01)
*F15B 13/02* (2006.01)

(52) U.S. Cl.
CPC ..... *E02F 9/2271* (2013.01); *E02F 9/2292* (2013.01); *E02F 9/2296* (2013.01); *F15B 11/165* (2013.01); *F15B 11/17* (2013.01); *F15B 13/02* (2013.01); *E02F 9/2285* (2013.01); *F15B 2211/2656* (2013.01); *F15B 2211/405* (2013.01); *F15B 2211/6309* (2013.01); *F15B 2211/6346* (2013.01); *F15B 2211/6652* (2013.01); *F15B 2211/7142* (2013.01)

(58) Field of Classification Search
CPC ..... E02F 9/2235; E02F 9/2225; E02F 9/2228; E02F 9/2285; E02F 9/2292; E02F 9/2296
See application file for complete search history.

(56) References Cited

U.S. PATENT DOCUMENTS

| | | | | |
|---|---|---|---|---|
| 10,107,310 | B2 * | 10/2018 | Kondo | E02F 9/2282 |
| 10,273,985 | B2 * | 4/2019 | Kondo | F15B 11/17 |
| 10,676,898 | B2 * | 6/2020 | Takahashi | F15B 11/02 |
| 11,332,911 | B2 * | 5/2022 | Takebayashi | E02F 9/2203 |
| 11,378,104 | B1 * | 7/2022 | Quinn | F15B 11/17 |
| 2013/0195597 | A1 | 8/2013 | Imura et al. | |
| 2019/0177953 | A1 | 6/2019 | Takahashi et al. | |
| 2023/0026848 | A1 * | 1/2023 | MacPherson | E02F 9/2267 |

FOREIGN PATENT DOCUMENTS

| | | | |
|---|---|---|---|
| JP | 2016-200241 | A | 12/2016 |
| JP | 2018-96504 | A | 6/2018 |

OTHER PUBLICATIONS

Japanese-language Written Opinion (PCT/ISA/237) issued in PCT Application No. PCT/JP2020/014255 dated Jun. 23, 2020 (three (3) pages).
International Preliminary Report on Patentability (PCT/IB/338 & PCT/IB/373) issued in PCT Application No. PCT/JP2020/014255 dated Oct. 6, 2022, Including English translation of document C2 (Japanese-language Written Opinion (PCT/ISA/237), filed on Mar. 27, 2020) (five (5) pages).

* cited by examiner

HYDRAULIC DRIVE SYSTEM FOR CONSTRUCTION MACHINE

TECHNICAL FIELD

The present invention relates to a hydraulic drive system for a construction machine such as a hydraulic excavator including a plurality of variable displacement hydraulic pumps, and particularly relates to a hydraulic drive system that performs so-called total horsepower control of controlling the displacements of the plurality of hydraulic pumps such that the total of the consumed torques (absorption torques) of the plurality of hydraulic pumps does not become larger than the output torque of a prime mover undesirably.

BACKGROUND ART

As hydraulic drive systems for construction machines such as hydraulic excavators that perform total horsepower control, there is one described in Patent Document 1. In Patent Document 1, total horsepower control is performed by giving feedback about the delivery pressure of each of first and second hydraulic pumps to a regulator of the other pump, adjusting allowable torques of the first and second hydraulic pumps on the basis of the pressures about which the feedback has been given, and controlling the displacements of the first and second hydraulic pumps such that the total of the consumed torques (absorption torques) of the first and second hydraulic pumps does not become larger than the output torque of the prime mover undesirably. Thereby, where a plurality of actuators are driven by using hydraulic fluids delivered from the first and second hydraulic pumps, horsepower allocated to the first and second hydraulic pumps can be utilized effectively.

In addition, in Patent Document 1, also where two or more hydraulic pumps are provided in the hydraulic excavator mentioned before, a pump controller that performs torque control typically referred to as total horsepower control is provided. In this total horsepower control, for example, the delivery pressures of both of two hydraulic pumps (hereinafter, referred to as a "first hydraulic pump" and a "second hydraulic pump") are introduced to respective regulators of the first hydraulic pump and the second hydraulic pump, and, if the sum of the absorption torques of the first hydraulic pump and the absorption torque of the second hydraulic pump reaches a set maximum absorption torque, the regulators are controlled such that the respective displacement volumes of the first hydraulic pump and the second hydraulic pump are reduced in response to a further increase in the delivery pressures of the hydraulic pumps. Thereby, where a plurality of actuators driven by using the hydraulic fluids delivered from the first hydraulic pump and the second hydraulic pump are driven singly, the total horsepower allocated to the first hydraulic pump and the second hydraulic pump can be utilized, and the output force of the prime mover can be utilized effectively. The first and second hydraulic pumps are, when travel operation is not sensed, subjected to horsepower control and load sensing control of a plurality of actuators not including left and right travel motors but including first and second actuators. When travel operation is sensed, the first and second hydraulic pumps are not subjected to load sensing control but supply the hydraulic fluids of the first and second hydraulic pumps to the left and right travel motors. A third hydraulic pump is, when travel operation is not sensed, subjected to horsepower control and load sensing control of a plurality of actuators not including the left and right travel motors but including a third actuator. When travel operation is sensed, the third hydraulic pump performs horsepower control and load sensing control of a plurality of actuators not including the left and right travel motors but including the first, second and third actuators.

PRIOR ART DOCUMENT

Patent Document

Patent Document 1: JP-2018-96504-A

SUMMARY OF THE INVENTION

Problem to be Solved by the Invention

Since total horsepower control is performed on the first and second hydraulic pumps in Patent Document 1, horsepower allocated to the first and second hydraulic pumps can be utilized effectively when a plurality of actuators are driven by using the hydraulic fluids delivered from the first and second hydraulic pumps.

However, the consumed horsepower of a hydraulic pump is a value represented by the product of the delivery pressure of the hydraulic pump and the delivery flow rate of the hydraulic pump. Because of this, even where the delivery pressure of a hydraulic pump is high, if the delivery flow rate of the hydraulic pump is low, consumed horsepower (consumed torque) of the hydraulic pump may be smaller in some cases, and thus the consumed horsepower (consumed torques) of hydraulic pumps cannot be monitored accurately simply on the basis of the delivery pressures of the hydraulic pumps.

There is a problem about Patent Document 1 that since total horsepower control is performed by giving feedback with only the delivery pressure of each of the first and second hydraulic pumps to the other pump mutually, even where the delivery flow rate of either one pump is kept low and where there is a margin in consumed torque, the consumed torque of the other pump is undesirably reduced by the total horsepower control, and the torque generated by the prime mover cannot be utilized effectively without being wasted.

An object of the present invention is to provide a hydraulic drive system for a construction machine that performs total horsepower control such that the total of the consumed torques of a plurality of hydraulic pumps does not become larger than a predetermined allowable torque, in which torque allocation is efficiently performed between the plurality of hydraulic pumps to thereby enable effective utilization of the torque generated by a prime mover without wasting the torque.

Means for Solving the Problem

According to the present invention, in order to solve the problems described above, there is provided a hydraulic drive system for a construction machine comprising: a first pump and a second pump that are driven by a prime mover; a plurality of first actuators driven by a hydraulic fluid delivered from the first pump; a plurality of second actuators driven by a hydraulic fluid delivered from the second pump; a plurality of first flow control valves that control the hydraulic fluid supplied to the plurality of first actuators; a plurality of second flow control valves that control the hydraulic fluid supplied to the plurality of second actuators;

a plurality of operation lever devices that operate the plurality of first flow control valves and the plurality of second flow control valves, and drive the plurality of first actuators and the plurality of second actuators; a first regulator that adjusts a delivery flow rate of the first pump; and a second regulator that adjusts a delivery flow rate of the second pump, the first regulator adjusting the delivery flow rate of the first pump such that a consumed torque of the first pump does not become larger than a first allowable torque, and also adjusting the delivery flow rate of the first pump such that a total of the consumed torque of the first pump and a consumed torque of the second pump does not become larger than a predetermined allowable torque, the second regulator adjusting the delivery flow rate of the second pump such that the consumed torque of the second pump does not become larger than a second allowable torque, and also adjusting the delivery flow rate of the second pump such that the total of the consumed torque of the first pump and the consumed torque of the second pump does not become larger than the predetermined allowable torque, wherein the construction machine hydraulic drive system further comprises: a plurality of operation amount sensors that sense operation amounts of the plurality of operation lever devices; a first pressure sensor that senses a delivery pressure of the first pump; a second pressure sensor that senses a delivery pressure of the second pump; a controller configured to calculate a ratio between a sum of estimated demanded powers of the plurality of first actuators and a sum of estimated demanded powers of the plurality of second actuators on a basis of sensed values of the plurality of operation amount sensors and sensed values of the first pressure sensor and the second pressure sensor, and output, on a basis of the ratio, a first command value and a second command value for adjusting allocation between the first allowable torque of the first pump and the second allowable torque of the second pump; and a first torque control valve and a second torque control valve that generate a first output pressure and a second output pressure on a basis of the output first command value and second command value, and the first regulator and the second regulator being configured to adjust the first allowable torque and the second allowable torque, on a basis of the first output pressure and the second output pressure, such that the first allowable torque and the second allowable torque become values to which the predetermined allowable torque is allocated according to the ratio.

In this manner, the controller outputs the first command value and the second command value on the basis of the ratio between the sum of the estimated demanded powers of the plurality of first actuators and the sum of the estimated demanded powers of the plurality of second actuators, and adjusts the first allowable torque and the second allowable torque such that the first allowable torque and the second allowable torque become values to which the predetermined allowable torque is allocated according to the ratio described above. Thereby, where the delivery flow rate of either one pump is kept low and there is an adequate consumed torque, accordingly, the first allowable torque and the second allowable torque are adjusted, and the consumed torque of the other pump can be increased. Thereby, torque allocation can be performed efficiently between the plurality of hydraulic pumps, and the torque generated by the prime mover can be utilized effectively without being wasted.

Advantages of the Invention

According to the present invention, where the delivery flow rate of either one pump is kept low and there is a margin in consumed torque, accordingly, the first and second allowable torques are adjusted, and the consumed torque of the other pump can be increased. Thereby, torque allocation can be performed efficiently between the plurality of hydraulic pumps, and the torque generated by the prime mover can be utilized effectively without being wasted.

MODES FOR CARRYING OUT THE INVENTION

Hereinafter, embodiments of the present invention are explained according to the figures.

First Embodiment

—Configuration—

Figure 1:
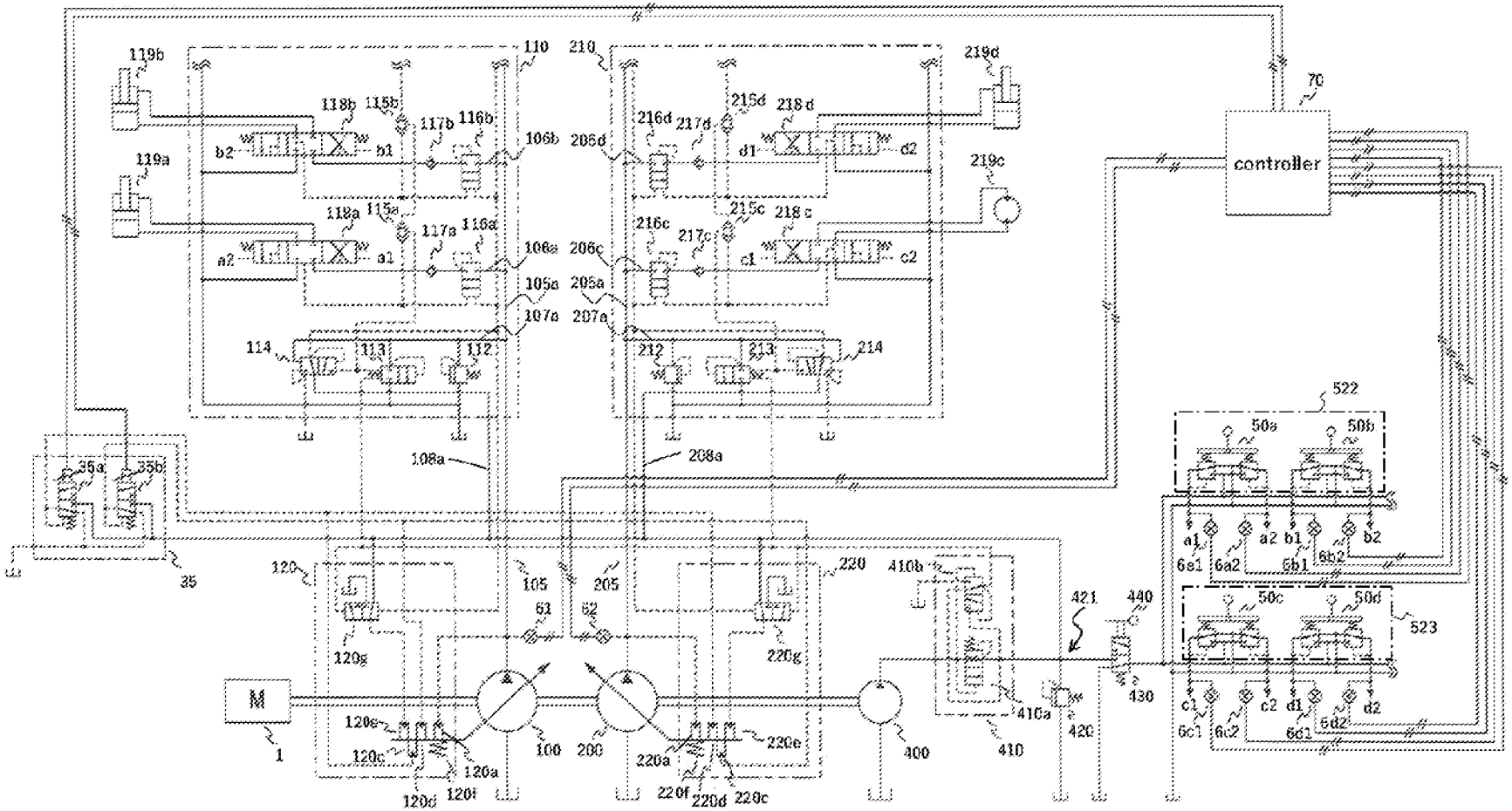
FIG. 1 is a figure illustrating a hydraulic drive system for a construction machine according to a first embodiment of the present invention.

FIG. 1 is a figure illustrating a hydraulic drive system for a construction machine according to a first embodiment of the present invention.

In the present embodiment, the hydraulic drive system for the construction machine comprises: a prime mover 1 (diesel engine); first and second variable displacement main pumps 100 and 200 driven by the prime mover 1; a fixed displacement pilot pump 400 driven by the prime mover 1; a first regulator 120 for controlling the delivery flow rate of the first main pump 100; a second regulator 220 for controlling the delivery flow rate of the second main pump 200; a plurality of first actuators 119*a*, 119*b*, . . . driven by a hydraulic fluid delivered from the first main pump 100; a plurality of second actuators 219*c*, 219*d*, . . . driven by a hydraulic fluid delivered from the second main pump 200; a first hydraulic fluid supply line 105 for supplying the hydraulic fluid delivered from the first main pump 100 to the plurality of first actuators 119*a*, 119*b*, . . . ; a second hydraulic fluid supply line 205 for supplying the hydraulic fluid delivered from the second main pump 200 to the plurality of second actuators 219*c*, 219*d*, . . . ; a first control valve block 110 that is connected downstream of the first hydraulic fluid supply line 105, and is for distributing the hydraulic fluid delivered from the first main pump 100 to the plurality of first actuators 119*a*, 119*b*, . . . ; and a second control valve block 210 that is provided downstream of the second hydraulic fluid supply line 205, and is for distributing the hydraulic fluid delivered from the second main pump 200 to the plurality of second actuators 219*c* and 219*d*.

The first control valve block 110 includes: a hydraulic line 105*a* connected to the first hydraulic fluid supply line 105; a plurality of first closed center flow control valves 118*a*, 118*b*, . . . that are arranged on a plurality of hydraulic lines 106*a*, 106*b*, . . . branching off from the hydraulic line 105*a*, and introducing the hydraulic fluid supplied from the first main pump 100 to the plurality of first actuators 119*a*, 119*b*, . . . , and control the flow (flow rate and direction) of the hydraulic fluid supplied to the plurality of first actuators 119*a*, 119*b*, . . . ; a plurality of pressure compensating valves 116*a*, 116*b*, . . . that are arranged on the plurality of hydraulic lines 106*a*, 106*b*, . . . , and control the differential pressures across the plurality of first flow control valves 118*a*, 118*b*, . . . ; a plurality of first check valves 117*a*, 117*b*, . . . that are arranged on the plurality of hydraulic lines 106*a*, 106*b*, . . . , and prevent the counterflow of the hydraulic fluid; a main relief valve 112 that is connected to a hydraulic line 107*a* branching off from the hydraulic line 105*a*, and controls a pressure P1 of the first hydraulic fluid supply line 105 such that the pressure P1 does not become equal to or higher than a set pressure; an unloading valve 113 that is connected to the hydraulic line 107*a*, and becomes opened, and returns the hydraulic fluid in the first hydraulic fluid supply line 105 to a tank when the pressure P1 of the first hydraulic fluid supply line 105 becomes a predetermined pressure higher than a maximum load pressure Plmax1 of the plurality of first actuators 119*a*, 119*b*, . . . ; a plurality of shuttle valves 115*a*, 115*b*, . . . that are connected to load pressure sensing ports of the plurality of first flow control valves 118*a*, 118*b*, . . . , and sense the maximum load pressure Plmax1 of the plurality of first actuators 119*a*, 119*b*, . . . ; and a differential-pressure pressure reducing valve 114 that is connected to a hydraulic line 108*a* to which a pilot primary pressure Pi0 generated at a pilot relief valve 420 (mentioned later) is introduced, receives the pressure P1 of the first hydraulic fluid supply line 105 and the maximum load pressure Plmax1 that are introduced thereto as signal pressures, and outputs, as an LS differential pressure Pls1, the absolute pressure of the differential pressure between the pressure P1 of the first hydraulic fluid supply line 105 and the maximum load pressure Plmax1.

The second control valve block 210 includes: a hydraulic line 205*a* connected to the second hydraulic fluid supply line 205; a plurality of second closed center flow control valves 218*c*, 218*d*, . . . that are arranged on a plurality of hydraulic lines 206*c*, 206*d*, . . . branching off from the hydraulic line 205*a*, and introducing the hydraulic fluid supplied from the second main pump 200 to the plurality of second actuators 219*c*, 219*d*, . . . , and control the flow (flow rate and direction) of the hydraulic fluid supplied to the plurality of second actuators 219*c*, 219*d*, . . . ; a plurality of pressure compensating valves 216*c*, 216*d*, . . . that are arranged on the plurality of hydraulic lines 206*c*, 206*d*, . . . , and control the differential pressures across the plurality of second flow control valves 218*c*, 218*d*, . . . ; a plurality of second check valves 217*c*, 217*d*, . . . that are arranged on the plurality of hydraulic lines 206*c*, 206*d*, . . . , and prevent the counterflow of the hydraulic fluid; a main relief valve 212 that is connected to a hydraulic line 207*a* branching off from the hydraulic line 205*a*, and controls a pressure P2 of the second hydraulic fluid supply line 205 such that the pressure P2 does not become equal to or higher than a set pressure; an unloading valve 213 that is connected to the hydraulic line 207*a*, and becomes opened, and returns the hydraulic fluid in the second hydraulic fluid supply line 205 to the tank when the pressure P2 of the second hydraulic fluid supply line 205 becomes a predetermined pressure higher than a maximum load pressure Plmax2 of the plurality of second actuators 219*c*, 219*d*, . . . ; a plurality of shuttle valves 215*c*, 215*d*, . . . that are connected to load pressure sensing ports of the plurality of second flow control valves 218*c*, 218*d*, . . . , and sense the maximum load pressure Plmax2 of the plurality of second actuators 219*c*, 219*d*, . . . ; and a differential-pressure pressure reducing valve 214 that is connected to a hydraulic line 208*a* to which the pilot primary pressure Pi0 (mentioned later) generated at the pilot relief valve 420 is introduced, receives the pressure P2 of the second hydraulic fluid supply line 205 and the maximum load pressure Plmax2 that are introduced thereto as signal pressures, and outputs, as an LS differential pressure Pls2, the absolute pressure of the differential pressure between the pressure P2 of the second hydraulic fluid supply line 205 and the maximum load pressure Plmax2.

A hydraulic fluid supply line of the fixed delivery flow rate pilot pump 400 is connected with a prime mover rotation speed sensing valve 410, and a hydraulic fluid delivered from the pilot pump 400 flows through the prime mover rotation speed sensing valve 410. The prime mover rotation speed sensing valve 410 includes: a variable restrictor 410*a* whose opening area changes according to the passing flow rate of the hydraulic fluid from the pilot pump 400; and a differential-pressure pressure reducing valve 410*b* that outputs the differential pressure across the variable restrictor valve 410*a* as a target LS differential pressure Pgr.

A pilot hydraulic pressure source 421 that generates the constant pilot pressure Pi0 by using the pilot relief valve 420 is formed downstream of the prime mover rotation speed sensing valve 410.

A plurality of remote control valves 50*a*, 50*b*, 50*c*, 50*d*, . . . each including a pair of pilot valves (pressure reducing valves) that generate corresponding ones of operating pressures a1, a2, b1, b2, c1, c2, d1, d2, . . . for controlling the plurality of first and second flow control valves 118*a*, 118*b*, 218*c*, 218*d*, . . . , and a selector valve 430 that selects whether to introduce the pilot primary pressure Pi0 generated at the pilot relief valve 420 or to introduce a tank pressure, to the plurality of remote control valves 50*a*, 50*b*, 50*c*, 50*d*, . . . are arranged downstream of the pilot hydraulic pressure source 421.

As mentioned later, a plurality of operation lever devices are installed in an operation room of the hydraulic excavator, and the remote control valves 50*a* and 50*b*, and 50*c* and 50*d* are provided to operation lever devices 522 and 523 (see FIG. 13) provided on the left and right sides of the operator's seat. The selector valve 430 is configured to perform selecting operation of a pressure among a plurality of the pressures described above by a gate lock lever 440, and the gate lock lever 440 is arranged on the entrance side of the operator's seat of the hydraulic excavator (see FIG. 13).

The first regulator 120 of the first main pump 100 includes: a torque control piston 120*a* to which the pressure P1 of the first hydraulic fluid supply line 105 of the first main pump 100 is introduced, and which performs control such that, when the pressure P1 increases, the consumed torque of the first main pump 100 does not become larger than a first allowable torque AT1 (mentioned later) by reducing the displacement volume of the first main pump 100 (e.g. the tilt of the swash plate); a flow rate control piston 120*e* that controls the delivery flow rate of the first main pump 100 according to demanded flow rates of the plurality of first flow control valves 118*a*, 118*b*, . . . ; an LS valve 120*g* that controls the tilt of the first main pump 100 such that the LS differential pressure Pls1 becomes equal to the target LS differential pressure Pgr by introducing the constant pilot pressure Pi0 to the flow rate control piston 120*e* to reduce the delivery flow rate of the first main pump 100 when the LS differential pressure Pls1 is higher than the target LS differential pressure Pgr, and by releasing the hydraulic fluid in the flow rate control piston 120*e* to the tank to increase the flow rate of the first main pump 100 when the LS differential pressure Pls1 is lower than the target LS differential pressure Pgr; an increase torque control piston 120*c* to which the output pressure of a first torque control valve 35*a* (mentioned later) is introduced, and that increases the first allowable torque AT1; a reduction torque control piston 120*d* to which the output pressure of a second torque control valve 35*b* (mentioned later) is introduced, and that reduces the first allowable torque AT1; and a spring 120*f* that sets a first initial allowable torque T1*i* which is a reference value of the first allowable torque AT1 of the first main pump 100.

The second regulator 220 of the second main pump 200 includes: a torque control piston 220*a* to which the pressure P2 of the second hydraulic fluid supply line 205 of the second main pump 200 is introduced, and that performs control such that, when the pressure P2 increases, the consumed torque of the second main pump 200 does not become larger than a second allowable torque AT2 (mentioned later) by reducing the displacement volume of the second main pump 200 (e.g. the tilt of the swash plate); a flow rate control piston 220*e* that controls the delivery flow rate of the second main pump 200 according to demanded flow rates of the plurality of second flow control valves 218*c*, 218*d*, . . . ; an LS valve 220*g* that controls the tilt of the second main pump 200 such that the LS differential pressure Pls2 becomes equal to the target LS differential pressure Pgr by introducing the constant pilot pressure Pi0 to the flow rate control piston 220*e* to reduce the delivery flow rate of the second main pump 200 when the LS differential pressure Pls2 is higher than the target LS differential pressure Pgr, and by releasing the hydraulic fluid in the flow rate control piston 220*e* to the tank to increase the flow rate of the second main pump 200 when the LS differential pressure Pls2 is lower than the target LS differential pressure Pgr; an increase torque control piston 220*c* to which the output pressure of the second torque control valve 35*b* is introduced, and that increases the second allowable torque AT2; a reduction torque control piston 220*d* to which the output pressure of the first torque control valve 35*a* is introduced, and that reduces the second allowable torque AT2; and a spring 220*f* that sets a second initial allowable torque T2*i* which is a reference value of the second allowable torque AT2 of the second main pump 200.

The first allowable torque AT1 is set by the increase torque control piston 120*c*, the reduction torque control piston 120*d*, and the spring 120*f*, and the second allowable torque AT2 is set by the increase torque control piston 220*c*, the reduction torque control piston 220*d*, and the spring 220*f*.

When the output pressures of the first and second torque control valves 35*a* and 35*b* introduced to the increase torque control piston 120*c* and the reduction torque control piston 120*d* are 0, the first allowable torque AT1 is set to the first initial allowable torque T1*i*. When the output pressures of the first and second torque control valves 35*a* and 35*b* introduced to the increase torque control piston 220*c* and the reduction torque control piston 220*d* are 0, the second allowable torque AT2 is set to the second initial allowable torque T2*i*.

The total of the first and second initial allowable torques T1*i*+T2*i* is a predetermined allowable torque allocated, out of the total output torque of the prime mover 1, to the first and second main pumps 100 and 200, and the total allowable torque AT1+AT2 of the first and second main pumps 100 and 200, is controlled by the increase torque control piston 120*c* and reduction torque control piston 120*d* of the first regulator 120, and the increase torque control piston 220*c* and reduction torque control piston 220*d* of the second regulator 220 such that the total allowable torque AT1+AT2 becomes equal to the total of the first and second initial allowable torques T1*i*+T2*i* which is the predetermined allowable torque thereof.

Then, the first and second regulators 120 and 220 control the delivery flow rates of the first and second main pumps 100 and 200, respectively, such that the total of the consumed torques of the first and second main pumps 100 and 200 does not become larger than the total of the first and second initial allowable torques T1*i*+T2*i* which is the predetermined allowable torque allocated to the first and second main pumps 100 and 200.

Here, the first initial allowable torque T1*i* of the first main pump 100 is set by the spring 120*f* as follows:

$$T1i=((\text{total output torque } T\text{Eng of prime mover } 1)-(\text{consumed torque } T4 \text{ of pilot pump } 400))/2$$

Similarly, the second initial allowable torque T2*i* of the second main pump 200 is also set by the spring 220*f* as follows:

$$T2i=((\text{total output torque } T\text{Eng of prime mover } 1)-(\text{consumed torque } T4 \text{ of pilot pump } 400))/2$$

As a result, the total of the first and second initial allowable torques T1*i*+T2*i* which is the predetermined allowable torque allocated, out of the total output torque of the prime mover 1, to the first and second main pumps 100 and 200, is set as follows:

$$T1i+T2i=(\text{total output torque } T\text{Eng of prime mover } 1)-(\text{consumed torque } T4 \text{ of pilot pump } 400)$$

In other words, the first and second initial allowable torques T1*i* and T2*i* of the first main pump 100 and the second main pump 200 are set by the springs 120*f* and 220*f*, respectively, such that each of the first and second initial allowable torques T1*i* and T2*i* becomes a half of the predetermined allowable torque allocated to the first and second main pumps 100 and 200.

In addition, the hydraulic drive system for the construction machine comprises: a first pressure sensor 61 for sensing the pressure P1 of the first hydraulic fluid supply line 105; a second pressure sensor 62 for sensing the pressure P2 of the second hydraulic fluid supply line 205; pressure sensors (operation amount sensors) 6*a*1, 6*a*2, 6*b*1, 6*b*2, 6*c*1, 6*c*2, 6*d*1, 6*d*2, . . . that are provided to the remote control valves 50*a*, 50*b*, 50*c*, 50*d*, . . . , and sense the operating pressures a1, a2, b1, b2, c1, c2, d1, d2, . . . generated according to the operation amounts of the operation lever devices 522 and 523 (the operation amounts of the operation levers); a torque control valve block 35 including the first and second torque control valves 35*a* and 35*b*; and a controller 70.

Note that instead of the pressure sensors 6*a*1, 6*a*2, 6*b*1, 6*b*2, 6*c*1, 6*c*2, 6*d*1, 6*d*2, . . . , other operation amount sensors such as angle sensors that sense the inclination angles of the operation levers may be used as long as those operation amount sensors can sense parameters related to the operation amounts.

Details of the content of processes performed by the controller 70 are explained. In the following explanation, " . . . " in the plurality of first actuators 119*a*, 119*b*, . . . , the plurality of second actuators 219*c*, 219*d*, . . . , the remote control valves 50*a*, 50*b*, 50*c*, 50*d*, . . . , the operating pressures a1, a2, b1, b2, c1, c2, d1, d2, . . . , the pressure sensors 6*a*1, 6*a*2, 6*b*1, 6*b*2, 6*c*1, 6*c*2, 6*d*1, 6*d*2, . . . , and the like is omitted for simplification of the explanation.

Figure 2:
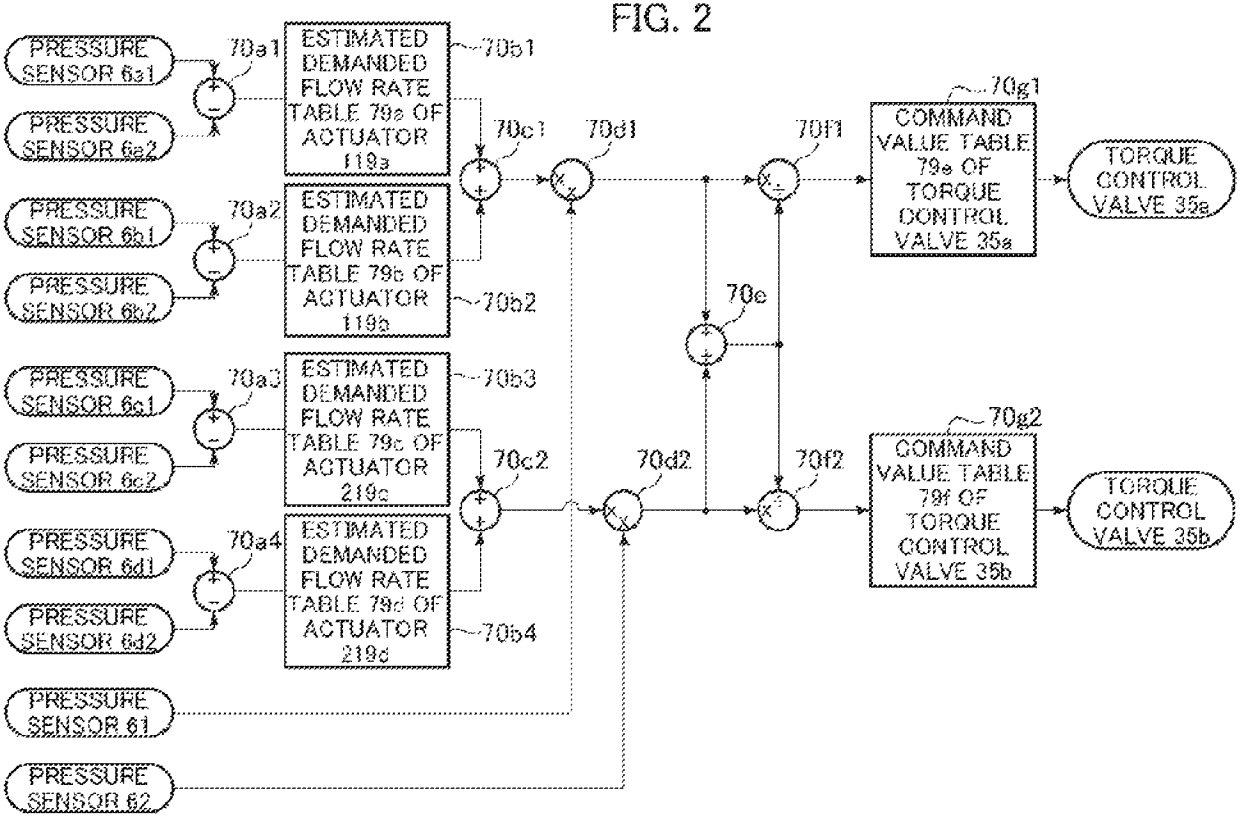
FIG. 2 is a functional block diagram illustrating the content of processes performed by a controller in the first embodiment of the present invention.

FIG. 2 is a functional block diagram illustrating the content of processes performed by the controller 70.

In the controller 70, a subtracting section 70*a*1 receives, as input, the operating pressure a1 sensed by the pressure sensor 6*a*1 as a positive (+) value, receives, as input, the operating pressure a2 sensed by the pressure sensor 6*a*2 as a negative (−) value, and generates operating pressure information a1-a2. In the controller 70, similarly, a subtracting section 70*a*2 receives, as input, operating pressures b1 and b2 sensed by the pressure sensors 6*b*1 and 6*b*2, and generates operating pressure information b1-b2, a subtracting section 70*a*3 receives, as input, the operating pressures c1 and c2 sensed by the pressure sensors 6*c*1 and 6*c*2, and generates operating pressure information c1-c2, and a subtracting section 70*a*4 receives, as input, the operating pressures d1 and d2 sensed by the pressure sensors 6*d*1 and 6*d*2, and generates operating pressure information d1-d2.

Next, in the controller 70, estimated demanded flow rate computing sections 70*b*1, 70*b*2, 70*b*3, and 70*b*4 calculate estimated demanded flow rates of the actuators 119*a*, 119*b*, 219*c*, and 219*d* corresponding to the operating pressure information a1-a2, b1-b2, c1-c2, and d1-d2 by using preset estimated demanded flow rate tables 79*a*, 79*b*, 79*c*, and 79*d* of the actuators 119*a*, 119*b*, 219*c*, and 219*d*.

Figure 3:
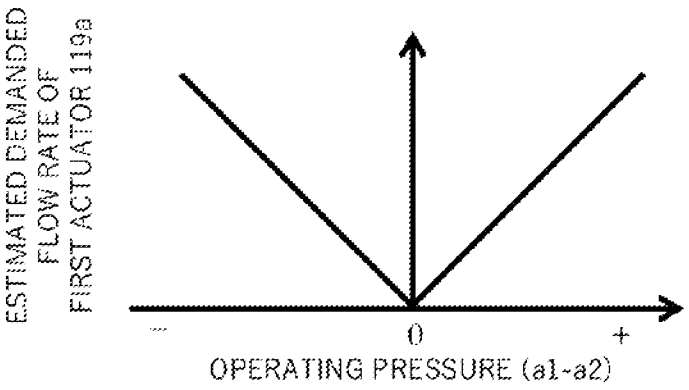
FIG. 3 is a figure illustrating characteristics of an estimated demanded flow rate table for calculating an estimated demanded flow rate of an actuator from operating pressure information.
Figure 4:
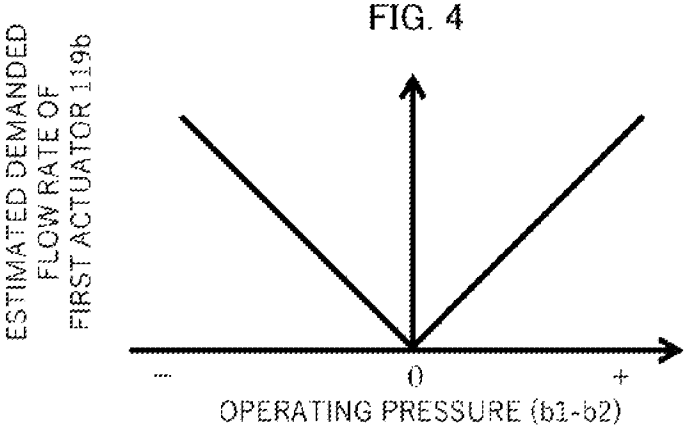
FIG. 4 is a figure illustrating characteristics of an estimated demanded flow rate table for calculating an estimated demanded flow rate of an actuator from operating pressure information.
Figure 5:
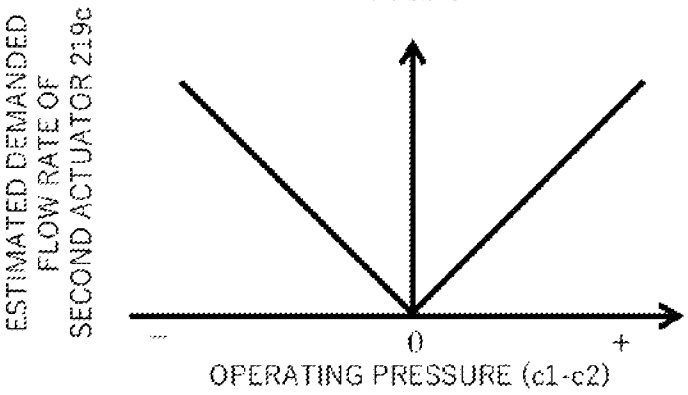
FIG. 5 is a figure illustrating characteristics of an estimated demanded flow rate table for calculating an estimated demanded flow rate of an actuator from operating pressure information.
Figure 6:
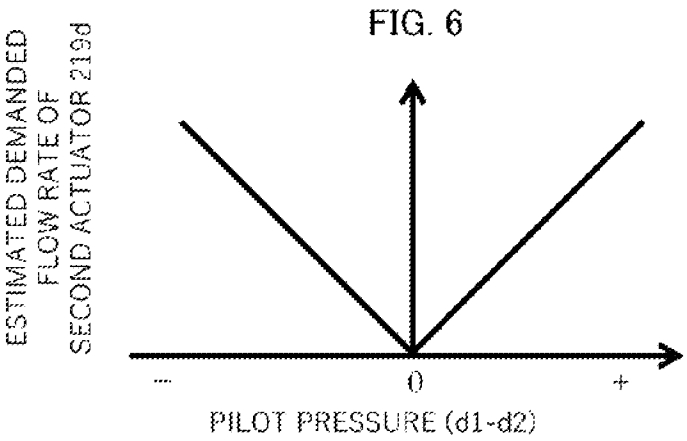
FIG. 6 is a figure illustrating characteristics of an estimated demanded flow rate table for calculating an estimated demanded flow rate of an actuator from operating pressure information.

FIG. 3 is a figure illustrating characteristics of the estimated demanded flow rate table 79*a* for calculating the estimated demanded flow rate of the actuator 119*a* from the operating pressure information a1-a2. FIG. 4 is a figure illustrating characteristics of the estimated demanded flow rate table 79*b* for calculating the estimated demanded flow rate of the actuator 119*b* from the operating pressure information b1-b2. FIG. 5 is a figure illustrating characteristics of the estimated demanded flow rate table 79*c* for calculating the estimated demanded flow rate of the actuator 219*c* from the operating pressure information c1-c2. FIG. 6 is a figure illustrating characteristics of the estimated demanded flow rate table 79*d* for calculating the estimated demanded flow rate of the actuator 219*d* from the operating pressure information d1-d2.

Here, in the estimated demanded flow rate table 79*a*, characteristics of the estimated demanded flow rate in relation to the operating pressure a1 are set on the positive side, and characteristics of the estimated demanded flow rate in relation to the operating pressure a2 are set on the negative side. In the estimated demanded flow rate table 79*a*, the characteristics of the estimated demanded flow rate in relation to the operating pressure a1 are set such that the estimated demanded flow rate increases as the operating pressure a1 increases, and the characteristics of the estimated demanded flow rate in relation to the operating pressure a2 are set such that the estimated demanded flow rate increases as the operating pressure a2 decreases (the absolute value of the operating pressure a2 increases).

Similarly, in the estimated demanded flow rate tables 79*b*, 79*c*, and 79*d* also, characteristics of the estimated demanded flow rates in relation to the operating pressures b1 and b2, the operating pressures c1 and c2, and the operating pressures d1 and d2 are set.

The operating pressures a1 and a2 and the operating pressures b1 and b2 are operating pressures that are generated selectively when the operation lever of the operation lever device 522 is operated, and the operating pressures c1 and c2 and the operating pressures d1 and d2 are operating pressures generated selectively when the operation lever of the operation lever device 523 is operated. Because of this, by referring to the estimated demanded flow rate tables 79*a*, 79*b*, 79*c*, and 79*d* for the operating pressure information a1-a2, b1-b2, c1-c2, and d1-d2, respectively, the estimated demanded flow rates corresponding to the operating pressures a1 and a2, the operating pressures b1 and b2, the operating pressures c1 and c2, and the operating pressures d1 and d2 can be calculated.

Next, in the controller 70, an adding section 70*c*1 calculates the sum of the estimated demanded flow rates of the plurality of first actuators 119*a* and 119*b* by adding together the estimated demanded flow rate of the actuator 119*a* calculated at the computing section 70*b*1, and the estimated demanded flow rate of the actuator 119*b* calculated at the computing section 70*b*2, and an adding section 70*c*2 calculates the sum of the estimated demanded flow rates of the plurality of second actuators 219*c* and 219*d* by adding together the estimated demanded flow rate of the actuator 219*c* calculated at the computing section 70*b*3, and the estimated demanded flow rate of the actuator 219*d* calculated at the computing section 70*b*4.

Next, in the controller 70, a multiplying section 70*d*1 calculates the sum of estimated demanded powers of the plurality of first actuators 119*a* and 119*b* by multiplying the sum of the estimated demanded flow rates of the plurality of first actuators 119*a* and 119*b* calculated at the adding section 70*c*1 by the pressure P1 of the first hydraulic fluid supply line 105 sensed by the first pressure sensor 61, and a multiplying section 70*d*2 calculates the sum of estimated demanded powers of the plurality of second actuators 219*c* and 219*d* by multiplying the sum of the estimated demanded flow rates of the plurality of second actuators 219*c* and 219*d* calculated at the adding section 70*c*2 by the pressure P2 of the second hydraulic fluid supply line 205 sensed by the second pressure sensor 62.

Next, the controller 70 calculates the ratio between the sum of the estimated demanded powers of the plurality of first actuators 119*a* and 119*b* and the sum of the estimated demanded powers of the plurality of second actuators 219*c* and 219*d*, and calculates the first and second command values for adjusting allocation between the first allowable torque AT1 of the first main pump 100 and the second allowable torque AT2 of the second main pump 200 such that the first and second allowable torques AT1 and AT2 set for the first regulator 120 and the second regulator 220 become values to which the total T1*i*+T2*i* of the first initial allowable torque T1*i* and second initial allowable torque T2*i* mentioned before is allocated according to the ratio.

Specific processes for this are as follows.

First, in the controller 70, an adding section 70*e* adds together the sum of the estimated demanded powers of the plurality of first actuators 119*a* and 119*b* calculated at the multiplying section 70*d*1, and the sum of the estimated demanded powers of the plurality of second actuators 219*c* and 219*d* calculated at the multiplying section 70*d*2, and calculates the sum total of the estimated demanded power of the plurality of first actuators 119*a* and 119*b* and the plurality of second actuators 219*c* and 219*d*.

Next, in the controller 70, a dividing section 70*f*1 divides the sum of the estimated demanded powers of the plurality of first actuators 119*a* and 119*b* calculated at the multiplying section 70*d*1 by the sum total of the estimated demanded power calculated at the adding section 70*e*, and calculates, as a first estimated demanded power ratio, the ratio of the sum of the estimated demanded powers of the plurality of first actuators 119*a* and 119*b* to the sum total of the estimated demanded power. In addition, in the controller 70, a dividing section 70*f*2 divides the sum of the estimated demanded powers of the plurality of second actuators 219*c* and 219*d* calculated at the multiplying section 70*d*2 by the sum total of the estimated demanded power calculated at the adding section 70*e*, and calculates, as a second estimated demanded power ratio, the ratio of the sum of the estimated demanded powers of the plurality of second actuators 219*c* and 219*d* to the sum total of the estimated demanded power.

In this manner, in the controller 70, the adding section 70*e* and the dividing sections 70*f*1 and 70*f*2 calculate the ratio (first estimated demanded power ratio) of the sum of the estimated demanded powers of the plurality of first actuators 119*a* and 119*b* to the sum total of the estimated demanded power, and the ratio (second estimated demanded power ratio) of the sum of the estimated demanded powers of the plurality of second actuators 219*c* and 219*d* to the sum total of the estimated demanded power, to thereby calculate the ratio between the sum of the estimated demanded powers of the plurality of first actuators 119*a* and 119*b* and the sum of the estimated demanded powers of the plurality of second actuators 219*c* and 219*d*.

Next, in the controller 70, by using preset command value tables 79*e* and 79*f* of the first and second torque control valves 35*a* and 35*b*, command value computing sections 70*g*1 and 70*g*2 calculate the first and second command values of the first and second torque control valves 35*a* and 35*b* corresponding to the first and second estimated demanded power ratios calculated at the dividing sections 70*f*1 and 70*f*2.

Figure 7:
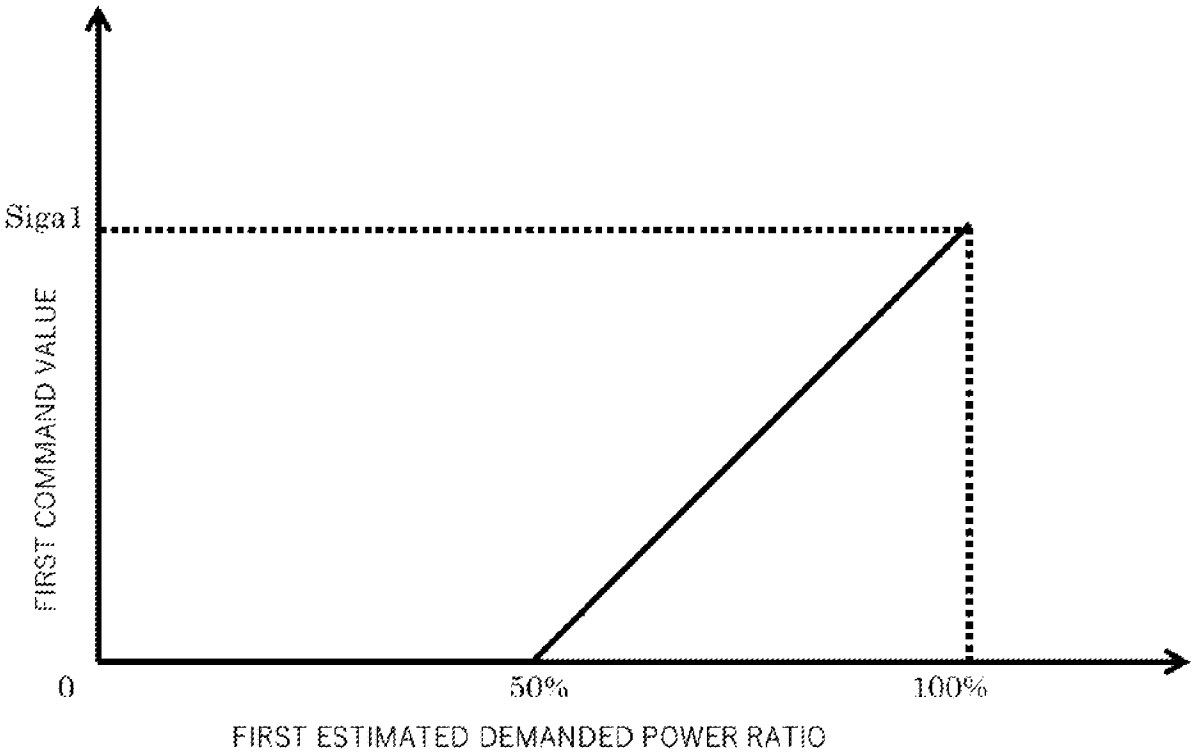
FIG. 7 is a figure illustrating characteristics of a command value table for calculating a first command value from a first estimated demanded power ratio.
Figure 8:
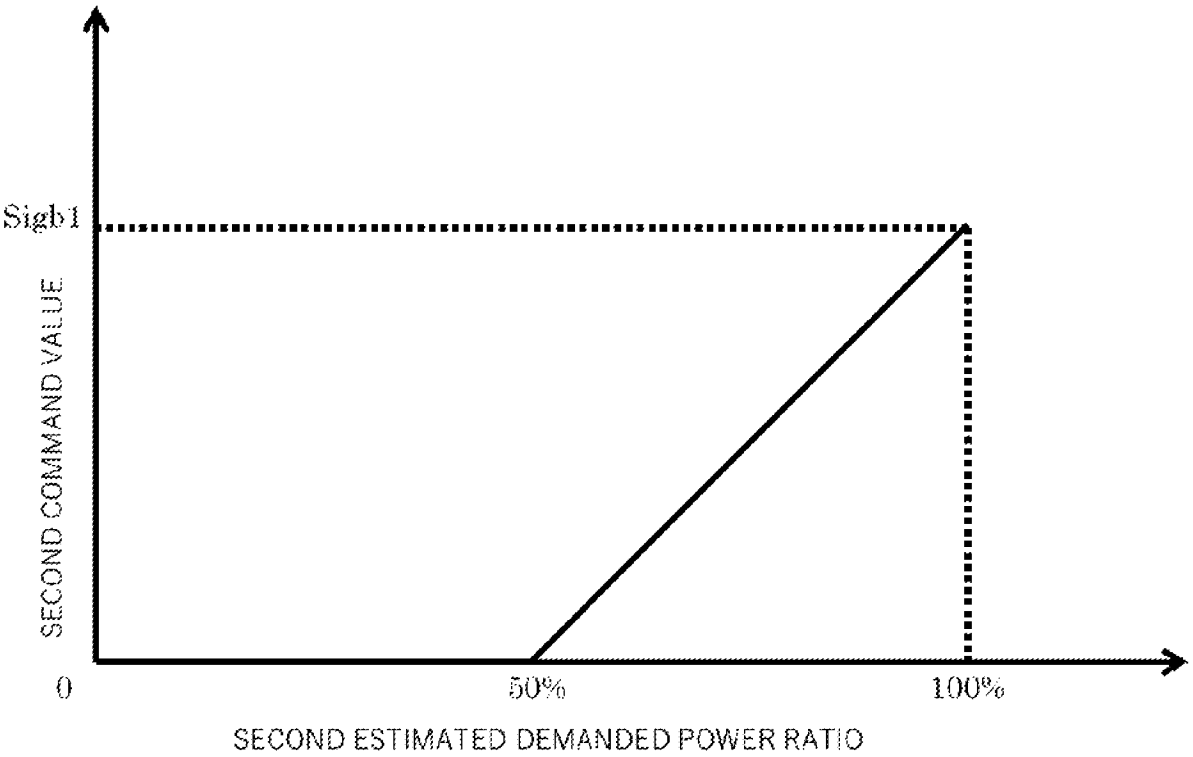
FIG. 8 is a figure illustrating characteristics of a command value table for calculating a second command value from a second estimated demanded power ratio.

FIG. 7 is a figure illustrating characteristics of the command value table 79*e* for calculating the first command value from the first estimated demanded power ratio. FIG. 8 is a figure illustrating characteristics of the command value table 79*f* for calculating the second command value from the second estimated demanded power ratio.

In the command value table 79*e* in FIG. 7, characteristics of the first command value in relation to the first estimated demanded power ratio are set such that the first command value is 0 until the first estimated demanded power ratio becomes 50%, and, when the first estimated demanded power ratio becomes equal to or higher than 50%, the first command value increases to a maximum Sigal as the first estimated demanded power ratio increases. In the command value table 79*f* in FIG. 8 also, similarly, characteristics of the second command value in relation to the second estimated demanded power ratio are set such that the second command value is 0 until the second estimated demanded power ratio becomes 50%, and, when the second estimated demanded power ratio becomes equal to or higher than 50%, the second command value increases to a maximum Sigbl as the second estimated demanded power ratio increases.

Next, the controller 70 outputs, to the first and second torque control valves 35*a* and 35*b*, as electric signals, the first and second command values calculated at the command value computing sections 70*g*1 and 70*g*2.

Figure 9:
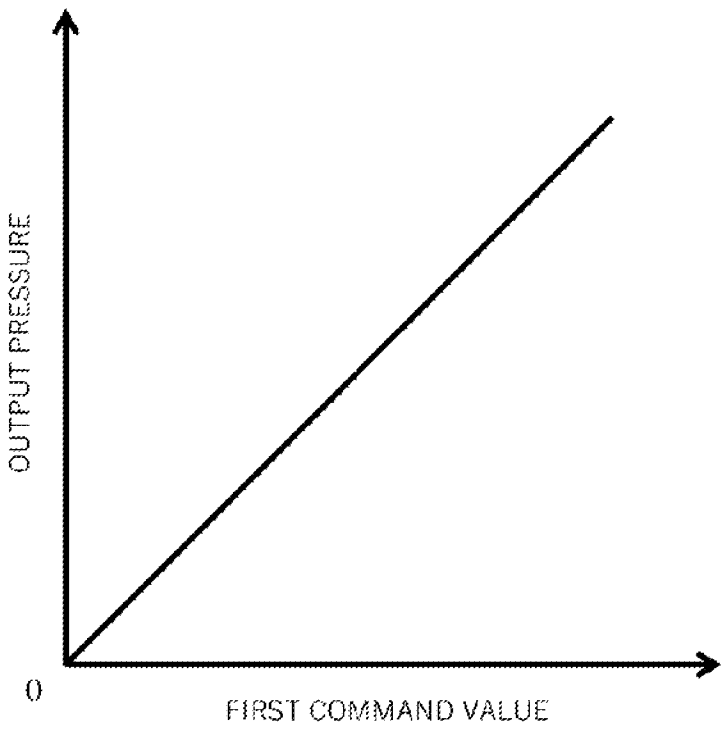
FIG. 9 is a figure illustrating output characteristics of a first torque control valve.
Figure 10:
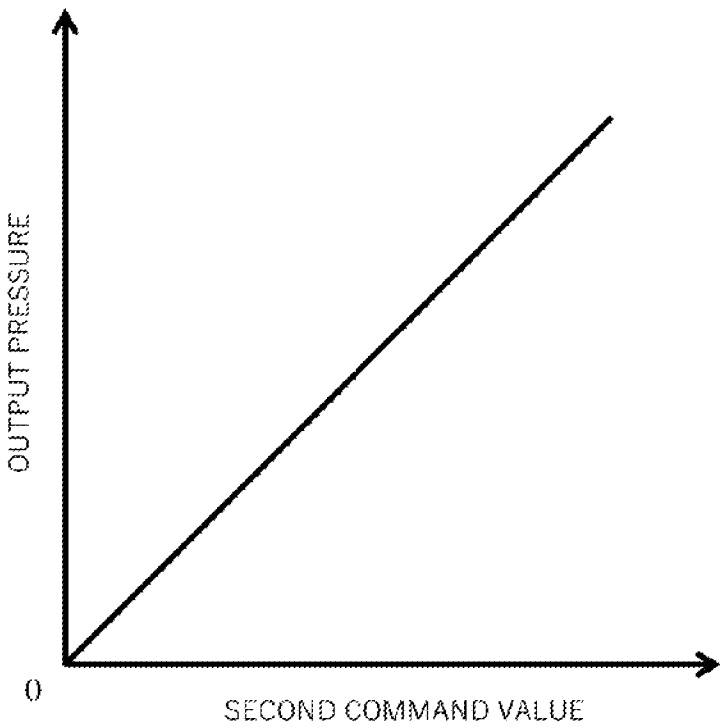
FIG. 10 is a figure illustrating output characteristics of a second torque control valve.

FIG. 9 and FIG. 10 are figures illustrating output characteristics of the first and second torque control valves 35*a* and 35*b*.

Both the first and second torque control valves 35*a* and 35*b* have output characteristics of outputting larger pressures as the first and second command values increase.

The output pressure of the first torque control valve 35*a* is introduced to the increase torque control piston 120*c* of the first regulator 120 and the reduction torque control piston 220*d* of the second regulator 220, and the output pressure of the second torque control valve 35*b* is introduced to the increase torque control piston 220*c* of the second regulator 220 and the reduction torque control piston 120*d* of the first regulator 120.

Figure 11:
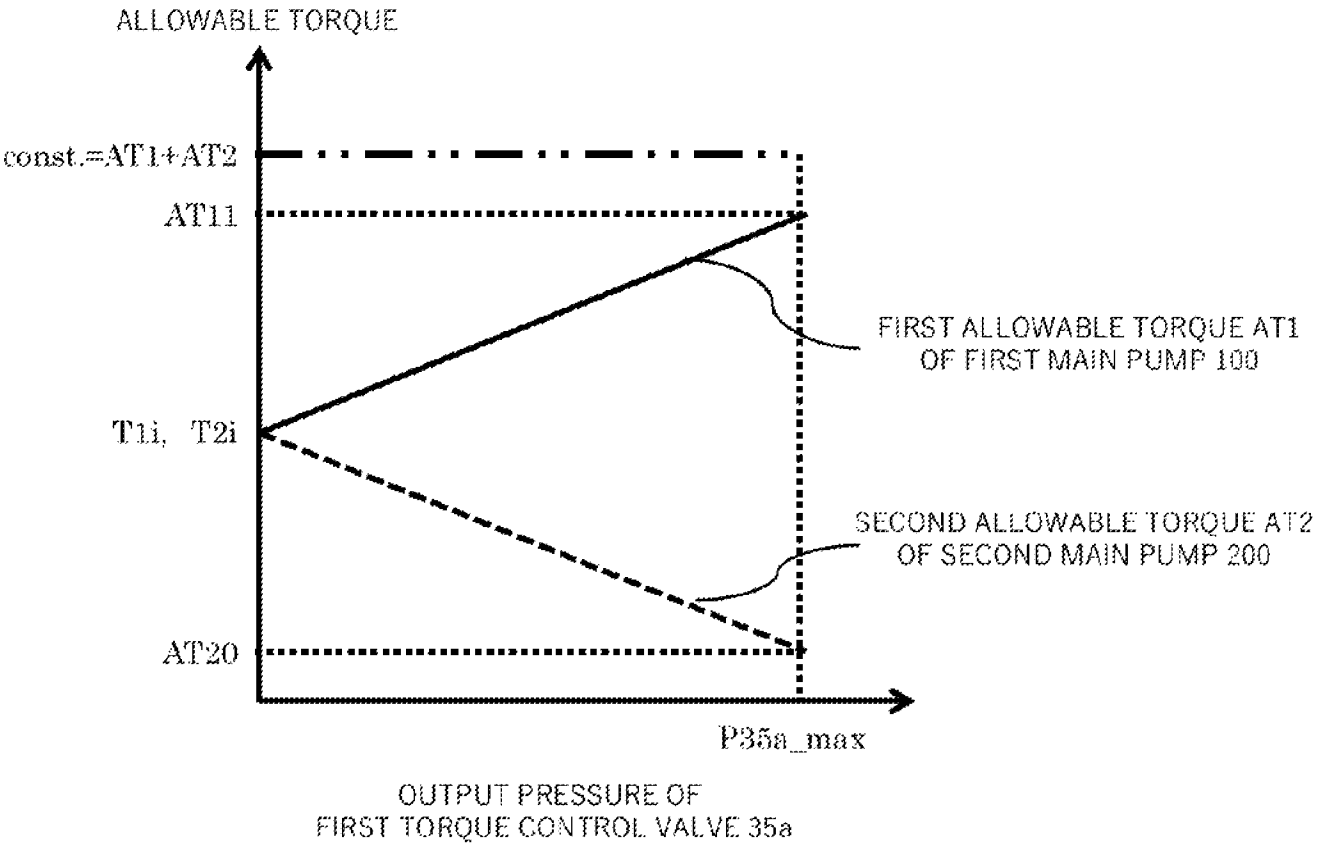
FIG. 11 is a figure illustrating a relation between the output pressure of the first torque control valve, and a first allowable torque of a first main pump and a second allowable torque of a second main pump that are controlled by an increase torque control piston of a first regulator and a reduction torque control piston of a second regulator, to which the output pressure of the first torque control valve is introduced.

FIG. 11 is a figure illustrating a relation between the output pressure of the first torque control valve 35*a*, and the first allowable torque AT1 of the first main pump 100 and the second allowable torque AT2 of the second main pump 200 that are controlled by the increase torque control piston 120*c* of the first regulator 120 and the reduction torque control piston 220*d* of the second regulator 220, to which the output pressure of the first torque control valve 35*a* is introduced.

Figure 12:
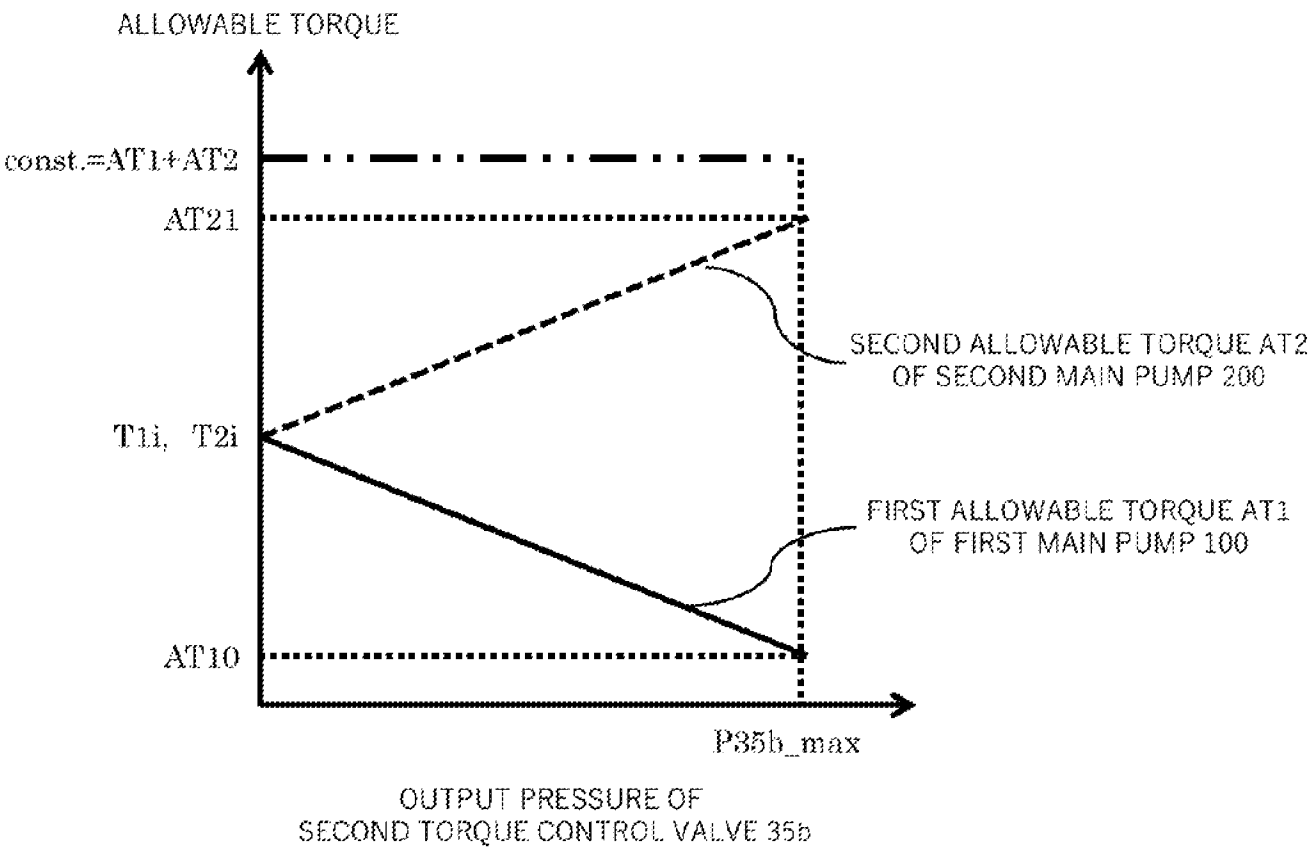
FIG. 12 is a figure illustrating a relation between the output pressure of the second torque control valve, and the first allowable torque of the first main pump and the second allowable torque of the second main pump that are controlled by an increase torque control piston of the second regulator and a reduction torque control piston of the first regulator, to which the output pressure of the second torque control valve is introduced.

FIG. 12 is a figure illustrating a relation between the output pressure of the second torque control valve 35*b*, and the first allowable torque AT1 of the first main pump 100 and the second allowable torque AT2 of the second main pump 200 that are controlled by the increase torque control piston 220*c* of the second regulator 220 and the reduction torque control piston 120*d* of the first regulator 120, to which the output pressure of the second torque control valve 35*b* is introduced.

As mentioned before, the first and second initial allowable torques T1*i* and T2*i* of the first main pump 100 and the second main pump 200 are set such that each of the first and second initial allowable torques T1*i* and T2*i* becomes a half of the allowable torque allocated to the first and second main pumps 100 and 200. The output pressure of the first torque control valve 35*a* of the first main pump 100 is introduced to the increase torque control piston 120*c* of the first regulator 120 and the reduction torque control piston 220*d* of the second regulator 220. As illustrated in FIG. 11, the first torque control valve 35*a* of the first main pump 100 increases the first allowable torque AT1 allocated to the first main pump 100 as the output pressure of the first torque control valve 35*a* increases relative to the first initial allowable torque T1*i* as a reference torque, and simultaneously reduces the second allowable torque AT2 allocated to the second main pump 200 relative to the second initial allowable torque T2*i* as a reference torque such that the sum of the first allowable torque AT1 and the second allowable torque AT2 is kept constant (AT1+AT2=const.). In FIG. 11, AT11 is a first maximum allowable torque, and AT20 is a second minimum allowable torque.

Similarly, the output pressure of the second torque control valve 35*b* of the second main pump 200 is introduced to the increase torque control piston 220*c* of the second regulator 220 and the reduction torque control piston 120*d* of the first regulator 120. As illustrated in FIG. 12, the second torque control valve 35*b* of the second main pump 200 increases the second allowable torque AT2 allocated to the second main pump 200 according to the output pressure of the second torque control valve 35*b* relative to a second initial allowable torque T2*i* as a reference torque, and simultaneously reduces the first allowable torque AT1 allocated to the first main pump 100 relative to the first initial allowable torque T1*i* as a reference torque such that the sum of the first allowable torque AT1 and the second allowable torque AT2 is kept constant (AT1+AT2=const.). In FIG. 12, AT21 is a second maximum allowable torque, and AT10 is a first minimum allowable torque.

In this manner, in accordance with the first and second command values calculated at the command value computing sections 70*g*1 and 70*g*2 of the controller 70, the first and second allowable torques AT1 and AT2 set for the first regulator 120 and the second regulator 220 are adjusted such that the first and second torques AT1 and AT2 become values to which the predetermined allowable torque (T1*i*+T2*i*) allocated to the first and second main pumps 100 and 200 is allocated according to the ratio between the sum of the estimated demanded powers of the plurality of first actuators 119*a* and 119*b* and the sum of the estimated demanded powers of the plurality of second actuators 219*c* and 219*d*.

That is, the first and second regulators 120 and 220 adjust, on the basis of the output pressures of the first and second torque control valves 35*a* and 35*b*, the first and second allowable torques AT1 and AT2 such that the first and second allowable torques AT1 and AT2 become values to which the predetermined allowable torque (T1*i*+T2*i*) is allocated according to the ratio between the sum of the estimated demanded powers of the plurality of first actuators 119*a* and 119*b* and the sum of the estimated demanded powers of the plurality of second actuators 219*c* and 219*d*.

—Hydraulic Excavator (Construction Machine)—

In the present embodiment, a construction machine on which the hydraulic drive system mentioned above is mounted is a hydraulic excavator.

Figure 13:
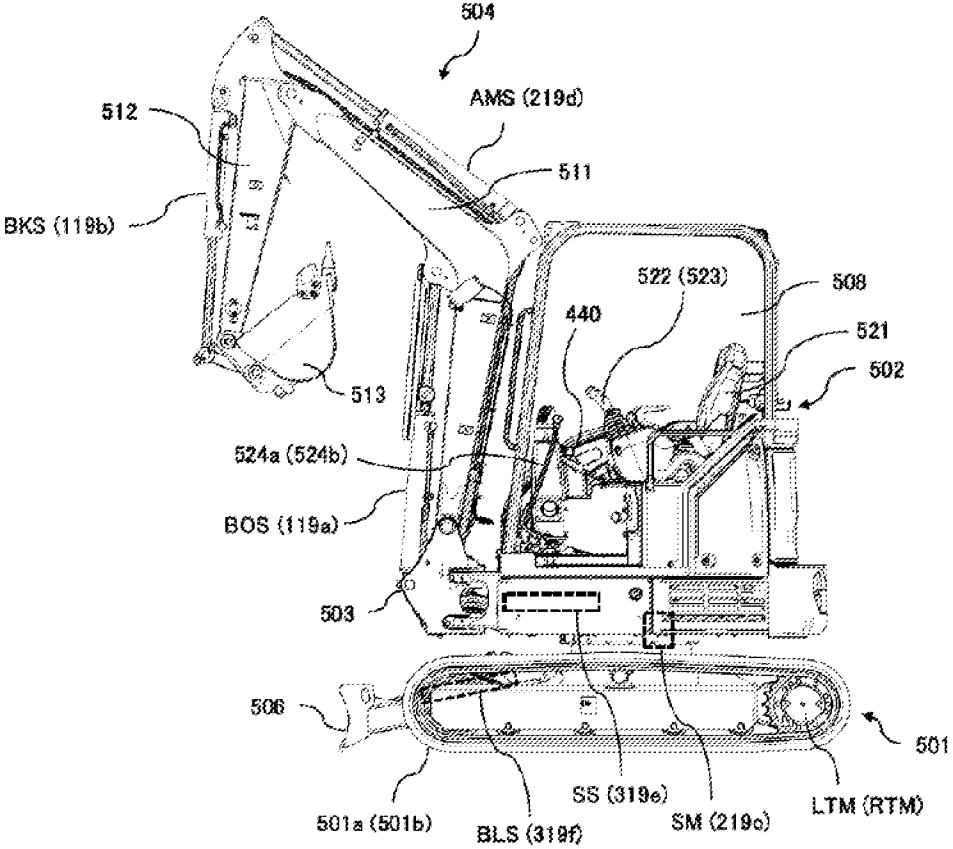
FIG. 13 is a figure illustrating the external appearance of a hydraulic excavator which is a construction machine on which the hydraulic drive system of the present embodiment is mounted.

FIG. 13 is a figure illustrating the external appearance of the hydraulic excavator.

In FIG. 13, the hydraulic excavator includes a lower travel structure 501, an upper swing structure 502 and a swingable front implement 504, and the front implement 504 includes a boom 511, an arm 512, and a bucket 513. The upper swing structure 502 is swingable relative to the lower travel structure 501 by a swing motor SM, which is the second actuator 219*c* illustrated in FIG. 1. A swing post 503 is attached to a front section of the upper swing structure 502, and the front implement 504 is attached to the swing post 503 vertically movably. The swing post 503 is horizontally pivotable relative to the upper swing structure 502 by the extension and retraction of a swing cylinder SS, and the boom 511, arm 512, and bucket 513 of the front implement 504 are vertically pivotable by the extension and retraction of a boom cylinder BOS, an arm cylinder ARS, and a bucket cylinder BKS, respectively, which are the first actuator 119*a*, the second actuator 219*d*, and the first actuator 119*b* illustrated in FIG. 1. A blade 506 that is caused to perform vertical operation by the extension and retraction of a blade cylinder BLS is attached to the middle frame of the lower travel structure 501. The lower travel structure 501 is caused to travel by left and right crawlers 501*a* and 501*b* (only the left crawler 501*a* is illustrated in FIG. 13) being driven by the rotation of travel motors LTM and RTM (only the left travel motor LTM is illustrated in FIG. 13).

A canopy type operation room 508 is formed on the upper swing structure 502, and an operator's seat 521, the operation lever devices 522 and 523 (only the left operation lever device 522 is illustrated in FIG. 13), and operation lever devices 524*a* and 524*b* (only the left operation lever device 524*a* is illustrated in FIG. 13) are provided in the operation room 508. The operation lever devices 522 and 523 are for front implement/swinging operation and are provided on the left and right sides at a front section of the operator's seat 521, and the operation lever devices 524*a* and 524*b* are for travel operation and are provided on the left and right sides on the front side of the operator's seat 521. The gate lock lever 440 illustrated in FIG. 1 mentioned before, an operation lever device 532 for swinging operation, and the operation lever device 522 for blade operation are further provided in the operation room 508.

Note that although not illustrated in FIG. 1, a flow control valve and a pressure compensating valve that control the flow of the hydraulic fluid supplied from the first main pump 100 to one of the travel motors LTM and RTM are provided in the first control valve block 110, a flow control valve and a pressure compensating valve that control the flow of the hydraulic fluid supplied from the second main pump 200 to the other one of the travel motors LTM and RTM are provided in the second control valve block 210, and the travel motors LTM and RTM are driven by the delivered fluids from the first and second main pumps 100 and 200. Similarly, although not illustrated in FIG. 1, for the swing cylinder SS and the blade cylinder BLS also, flow control valves and pressure compensating valves are provided in the first and second control valve blocks 110 and 210, and the swing cylinder SS and the blade cylinder BLS are driven by the delivered fluids from the first and second main pumps 100 and 200.

—Operation—

(a) Where all the Operation Levers are at the Neutral Positions

Since all the operation levers of the operation lever devices 522 and 523 are at the neutral positions, all the flow control valves 118*a*, 118*b*, 218*c*, and 218*d* are kept at the neutral positions by the springs provided at both ends thereof.

The hydraulic fluid delivered from first main pump 100 is fed to the first control valve block 110 via the first hydraulic fluid supply line 105, but the entire hydraulic fluid is returned to the tank via the unloading valve 113 because all of the first flow control valves 118*a* and 118*b* are kept at the neutral positions, and the hydraulic lines 106*a* and 106*b* are interrupted.

At this time, since the load pressure sensing ports of the first flow control valves 118*a* and 118*b* are communicating with the tank, the maximum load pressure Plmax1 equals the tank pressure.

The unloading valve 113 performs control such that the pressure P1 of the first hydraulic fluid supply line 105 does not become higher than Plmax1+Pgr+(spring force). Since the maximum load pressure Plmax1 equals the tank pressure as mentioned before, supposing that the tank pressure is 0, the unloading valve 113 keeps the pressure P1 of the first hydraulic fluid supply line 105 at a pressure slightly higher than the target LS differential pressure Pgr.

The differential-pressure pressure reducing valve 114 outputs, as the LS differential pressure Pls1, the absolute pressure of the differential pressure between the maximum load pressure Plmax1 and the pressure P1 of the first hydraulic fluid supply line 105. Since the maximum load pressure Plmax1 equals the tank pressure as mentioned before, supposing that the tank pressure is 0, $$Pls1=P1-Pl\max1=P1>Pgr$$

is satisfied.

The LS differential pressure Pls1 is introduced to the LS valve 120*g* located in the first regulator 120. Since Pls1 is higher than Pgr, the constant pilot pressure Pi0 is introduced to the flow rate control piston 120*e* as mentioned before, and the tilt of the first main pump 100 is reduced to reduce the delivery flow rate.

The hydraulic fluid delivered from the second main pump 200 is fed to the second control valve block 210 via the second hydraulic fluid supply line 205, but the entire hydraulic fluid is returned to the tank via the unloading valve 213 because the second flow control valves 218*c* and 218*d* are kept at the neutral positions, and the hydraulic lines 206*c* and 206*d* are interrupted.

At this time, since the load pressure sensing ports of the second flow control valves 218*c* and 218*d* are communicating with the tank, the maximum load pressure Plmax2 equals the tank pressure.

Whereas the unloading valve 213 performs control such that the pressure P2 of the second hydraulic fluid supply line 205 does not become higher than Plmax2+Pgr+(spring force), since the maximum load pressure Plmax2 equals the tank pressure as mentioned before, supposing that the tank pressure is 0, the pressure P2 of the second hydraulic fluid supply line 205 is kept at a pressure slightly higher than the target LS differential pressure Pgr.

The differential-pressure pressure reducing valve 214 outputs, as the LS differential pressure Pls2, the absolute pressure of the differential pressure between the maximum load pressure Plmax2 and the pressure P2 of the second hydraulic fluid supply line 205. Since the maximum load pressure Plmax2 equals the tank pressure as mentioned before, supposing that the tank pressure is 0, $$Pls2=P2-Pl\max2=P2>Pgr$$

is satisfied.

The LS differential pressure Pls2 is introduced to the LS valve 220*g* located in the second regulator 220. Since Pls2 is higher than Pgr, the constant pilot pressure Pi0 is introduced to the flow rate control piston 220*e* as mentioned before, and the tilt of the second main pump 200 is reduced to reduce the delivery flow rate.

That is, where all the operation levers are at the neutral positions, the delivery flow rates of the first and second main pumps 100 and 200 are kept at the minimum rates.

(b) Where Only the Operation Lever of the First Actuators is Operated

Since the operation lever of the operation lever device 523 of the second actuators 219*c* and 219*d* is at the neutral position, the delivery flow rate of the second main pump 200 is kept at the minimum rate as mentioned before.

When the operation lever of the operation lever device 522 of the first actuators 119*a* and 119*b* is operated, and for example, when the operating pressure a1 and the operating pressure b1 are generated, the flow control valves 118*a* and 118*b* switch to the right side in FIG. 1.

The first actuators 119*a* and 119*b* are supplied with the hydraulic fluid delivered from the first main pump 100 via the first hydraulic fluid supply line 105, the pressure compensating valves 116*a* and 116*b*, the check valves 117*a* and 117*b*, and the flow control valves 118*a* and 118*b*.

At this time, the load pressures of the first actuators 119*a* and 119*b* are introduced to the shuttle valves 115*a* and 115*b* via the load pressure sensing ports of the flow control valves 118*a* and 118*b*, the shuttle valves 115*a* and 115*b* sense the maximum load pressure Plmax1, and the maximum load pressure Plmax1 is introduced to the unloading valve 113 and the differential-pressure pressure reducing valve 114.

As mentioned before, the unloading valve 113 performs control such that the pressure P1 of the first hydraulic fluid supply line 105 does not become higher than Plmax1+Pgr+(spring force).

The differential-pressure pressure reducing valve 114 outputs, as the LS differential pressure Pls1, the absolute pressure of the differential pressure between the maximum load pressure Plmax1 and the pressure P1 of the first hydraulic fluid supply line 105, and the LS differential pressure Pls1 is introduced to the pressure compensating valves 116*a* and 116*b* and the LS valve 120*g* of the first regulator 120.

The pressure compensating valve 116*a* performs control such that the downstream side pressure of the pressure compensating valve 116*a* becomes (downstream side pressure of flow control valve 118*a*)+(LS differential pressure Pls1), and the pressure compensating valve 116*b* performs control such that the downstream side pressure of the pressure compensating valve 116*b* becomes (downstream side pressure of flow control valve 118*b*)+(LS differential pressure Pls1).

That is, since the pressure compensating valves 116*a* and 116*b* perform control such that the differential pressures ΔP across the flow control valves 118*a* and 118*b* are kept constant, the rates of the flows through the flow control valves 118*a* and 118*b* are controlled such that the flow rates are proportional to the opening areas that are determined according to the operation amount (operating pressures a1 and b1) of the operation lever of the operation lever device 522.

As mentioned before, the LS valve 120*g* performs load sensing control of controlling the tilt of the first main pump 100 such that the LS differential pressure Pls1 becomes equal to the target LS differential pressure Pgr by increasing the delivery flow rate of the first main pump 100 to increase the LS differential pressure Pls1 when the delivery flow rate of the first main pump 100 becomes insufficient and Pls1 becomes lower than Pgr, and by reducing the delivery flow rate of the first main pump 100 to reduce the LS differential pressure Pls1 when the delivery flow rate of the first main pump 100 becomes excessive and Pls1 becomes higher than Pgr.

Here, the controller 70 calculates, as mentioned before, in accordance with input from the pressure sensors 6*a*1, 6*a*2, 6*b*1, 6*b*2, 6*c*1, 6*c*2, 6*d*1, 6*d*2, 61, and 62, the sum of the estimated demanded powers of the first actuators 119*a* and 119*b* and the sum of the estimated demanded powers of the second actuators 219*c* and 219*d*, calculates the ratio (first estimated demanded power ratio) of the sum of the estimated demanded powers of the plurality of first actuators 119*a* and 119*b* to the sum total of the estimated demanded power, and the ratio (second estimated demanded power ratio) of the sum of the estimated demanded powers of the plurality of second actuators 219*c* and 219*d* to the sum total of the estimated demanded power, and, on the basis of these ratios, calculates the first and second command values for adjusting allocation between the first allowable torque AT1 of the first main pump 100 and the second allowable torque AT2 of the second main pump 200. At this time, since only the first actuators 119*a* and 119*b* are being operated, and the sum of the estimated demanded powers of the second actuators 219*c* and 219*d* equals 0, the first estimated demanded power ratio is 1.0 (100%), the second estimated demanded power ratio is 0 (0%), and the maximum first command value is output as an electric signal to the first torque control valve 35*a*.

The first torque control valve 35*a* having received, as input, the maximum first command value as an electric signal outputs the maximum pressure according to the first command value, the output pressure is introduced to the increase torque control piston 120*c* of the first regulator 120, the allowable torque AT1 of the first main pump 100 is set to the first maximum allowable torque AT1*l* (see FIG. 11), additionally the output pressure of the first torque control valve 35*a* is introduced to the reduction torque control piston 220*d* of the second regulator 220, and the allowable torque AT2 of the second main pump 200 is set to the second minimum allowable torque AT20 (see FIG. 11).

At this time, a consumed torque T1 of the first main pump 100 equals the quotient of the division of the consumed power of the first main pump 100 represented by (delivery pressure P1)×(delivery flow rate Q1) by the rotation speed of the first main pump 100. When the consumed torque T1 is smaller than the set first allowable torque AT1=AT11, the first main pump 100 operates according to load sensing control. When the consumed torque T1 is to become larger than the set first allowable torque AT1=AT11, the torque control piston 120*a* forcibly reduces the delivery flow rate of the first main pump 100, and the first main pump 100 operates according to horsepower control.

That is, when only the first actuators 119*a* and 119*b* are operated, the delivery flow rate of the second main pump 200 is kept at the minimum rate. The allowable torque AT1 of the first main pump 100 is set to the first maximum allowable torque AT11, and the first main pump 100 is subjected to load sensing control if the consumed torque T1 of the first main pump 100 is within the range of the allowable torque AT1, and is subjected to horsepower control such that the delivery flow rate of the first main pump 100 is reduced forcibly when the consumed torque T1 is to become larger than the allowable torque AT1.

(c) Where Only the Operation Lever of the Second Actuators is Operated

Since the operation lever of the operation lever device 522 of the first actuators 119*a* and 119*b* is at the neutral position, the delivery flow rate of the first main pump 100 is kept at the minimum rate as mentioned before.

When the operation lever of the operation lever device 523 of the second actuators 219*c* and 219*d* is operated, and for example, when the operating pressure c1 and the operating pressure d1 are generated, the flow control valves 218*c* and 218*d* switch to the left side in FIG. 1.

The second actuators 219*c* and 219*d* are supplied with the hydraulic fluid delivered from the second main pump 200 via the second hydraulic fluid supply line 205, the pressure compensating valves 216*c* and 216*d*, the check valves 217*c* and 217*d* and the flow control valves 218*c* and 218*d*.

At this time, the load pressures of the second actuators 219*c* and 219*d* are introduced to the shuttle valves 215*c* and 215*d* via the load pressure sensing ports of the flow control valves 218*c* and 218*d*, the shuttle valves 215*c* and 215*d* sense the maximum load pressure Plmax2, and the maximum load pressure Plmax2 is introduced to the unloading valve 213 and the differential-pressure pressure reducing valve 214.

As mentioned before, the unloading valve 213 performs control such that the pressure P2 of the second hydraulic fluid supply line 205 does not become higher than Plmax2+Pgr+(spring force).

The differential-pressure pressure reducing valve 214 outputs, as the LS differential pressure Pls2, the absolute pressure of the differential pressure between the maximum load pressure Plmax2 and the pressure P2 of the second hydraulic fluid supply line 205, and the LS differential pressure Pls2 is introduced to the pressure compensating valves 216*c* and 216*d* and the LS valve 220*g* of the second regulator 220.

The pressure compensating valve 216*c* performs control such that the downstream side pressure of the pressure compensating valve 216*c* becomes (downstream side pressure of flow control valve 218*c*)+(LS differential pressure Pls2), and the pressure compensating valve 216*d* performs control such that the downstream side pressure of the pressure compensating valve 216*d* becomes (downstream side pressure of flow control valve 218*d*)+(LS differential pressure Pls2).

That is, since the pressure compensating valves 216*c* and 216*d* perform control such that the differential pressures ΔP across the flow control valves 218*c* and 218*d* are kept constant, the rates of the flows through the flow control valves 218*c* and 218*d* are controlled such that the flow rates are proportional to the opening areas that are determined according to the operation amount (operating pressures c1 and d1) of the operation lever of the operation lever device 523.

As mentioned before, the LS valve 220*g* performs load sensing control of controlling the tilt of the second main pump 200 such that the LS differential pressure Pls2 becomes equal to the target LS differential pressure Pgr by increasing the delivery flow rate of the second main pump 200 to increase the LS differential pressure Pls2 when the delivery flow rate of the second main pump 200 becomes insufficient and Pls2 becomes lower than Pgr, and by reducing the delivery flow rate of the second main pump 200 to reduce the LS differential pressure Pls2 when the delivery flow rate of the second main pump 200 becomes excessive and Pls2 becomes higher than Pgr.

Here, the controller 70 calculates, as mentioned before, in accordance with input from the pressure sensors 6*a*1, 6*a*2, 6*b*1, 6*b*2, 6*c*1, 6*c*2, 6*d*1, 6*d*2, 61, and 62, the sum of the estimated demanded powers of the first actuators 119*a* and 119*b* and the sum of the estimated demanded powers of the second actuators 219*c* and 219*d*, calculates the ratio (first estimated demanded power ratio) of the sum of the estimated demanded powers of the plurality of first actuators 119*a* and 119*b* to the sum total of the estimated demanded power, and the ratio (second estimated demanded power ratio) of the sum of the estimated demanded powers of the plurality of second actuators 219*c* and 219*d* to the sum total of the estimated demanded power, and, on the basis of these ratios, calculates the first and second command values for adjusting allocation between the first allowable torque AT1 of the first main pump 100 and the second allowable torque AT2 of the second main pump 200. At this time, since only the second actuators 219*c* and 219*d* are being operated, and the sum of the estimated demanded powers of the first actuators 119*a* and 119*b* equals 0, the first estimated demanded power ratio is 0 (0%), the second estimated demanded power ratio is 1.0 (100%), and the maximum second command value is output as an electric signal to the second torque control valve 35*b*.

The second torque control valve 35*b* having received, as input, the maximum second command value as an electric signal outputs the maximum pressure according to the second command value, the output pressure is introduced to the increase torque control piston 220*c* of the second regulator 220, the allowable torque AT2 of the second main pump 200 is set to the second maximum allowable torque AT21 (see FIG. 12), additionally the output pressure is introduced to the reduction torque control piston 120*d* of the first regulator 120, and the allowable torque AT1 of the first main pump 100 is set to the first minimum allowable torque AT10 (see FIG. 12).

At this time, a consumed torque T2 of the second main pump 200 equals the quotient of the division of the consumed power of the second main pump 200 represented by (delivery pressure P2)×(delivery flow rate Q2) by the rotation speed of the second main pump 200. When the consumed torque T2 is smaller than the set second allowable torque AT2=AT21, the second main pump 200 operates according to load sensing control. When the consumed torque T2 is to become larger than the set second allowable torque AT2=AT21, the torque control piston 220*a* forcibly reduces the delivery flow rate of the second main pump 200, and the second main pump 200 operates according to horsepower control.

That is, where only the second actuators 219*c* and 219*d* are operated, the delivery flow rate of the first main pump 100 is kept at the minimum rate. The allowable torque AT2 of the second main pump 200 is set to the second maximum allowable torque AT21, and the second main pump 200 is subjected to load sensing control if the consumed torque T2 of the second main pump 200 is within the range of the allowable torque AT2, and is subjected to horsepower control such that the delivery flow rate of the second main pump 200 is reduced forcibly when the consumed torque T2 is to become larger than the allowable torque AT2.

(d) Where the Operation Levers of the First Actuators and the Second Actuators are Operated Simultaneously When the operation lever of the operation lever device 522 of the first actuators 119*a* and 119*b*, and the operation lever of the operation lever device 523 of the second actuators 219*c* and 219*d* are operated simultaneously, and the operating pressures a1 and b1 and the operating pressures c1 and d1 are generated, the flow control valves 118*a* and 118*b* switch to the right side in FIG. 1, and the flow control valves 218*c* and 218*d* switch to the left side in FIG. 1.

The first actuators 119*a* and 119*b* are supplied with the hydraulic fluid delivered from the first main pump 100 via the first hydraulic fluid supply line 105, the pressure compensating valves 116*a* and 116*b*, the check valves 117*a* and 117*b* and the flow control valves 118*a* and 118*b*, and the second actuators 219*c* and 219*d* are supplied with the hydraulic fluid delivered from the second main pump 200 via the second hydraulic fluid supply line 205, the pressure compensating valves 216*c* and 216*d*, the check valves 217*c* and 217*d*, and the flow control valves 218*c* and 218*d*.

At this time, the load pressures of the first actuators 119*a* and 119*b* are introduced to the shuttle valves 115*a* and 115*b* via the load pressure sensing ports of the flow control valves 118*a* and 118*b*, the shuttle valves 115*a* and 115*b* sense the maximum load pressure Plmax1, and the maximum load pressure Plmax1 is introduced to the unloading valve 113 and the differential-pressure pressure reducing valve 114. In addition, the load pressures of the second actuators 219*c* and 219*d* are introduced to the shuttle valves 215*c* and 215*d* via the load pressure sensing ports of the flow control valves 218*c* and 218*d*, the shuttle valves 215*c* and 215*d* sense the maximum load pressure Plmax2, and the maximum load pressure Plmax2 is introduced to the unloading valve 213 and the differential-pressure pressure reducing valve 214.

As mentioned before, the unloading valve 113 performs control such that the pressure P1 of the first hydraulic fluid supply line 105 does not become higher than Plmax1+Pgr+(spring force), and the unloading valve 213 performs control such that the pressure P2 of the second hydraulic fluid supply line 205 does not become higher than Plmax2+Pgr+(spring force).

The differential-pressure pressure reducing valves 114 and 214 output the LS differential pressures Pls1 and Pls2, respectively, the LS differential pressure Pls1 is introduced to the pressure compensating valves 116*a* and 116*b* and the LS valve 120*g* of the first regulator 120, and the LS differential pressure Pls2 is introduced to the pressure compensating valves 216*c* and 216*d* and the LS valve 220*g* of the second regulator 220.

Since the pressure compensating valves 116*a*, 116*b*, 216*c*, and 216*d* perform control such that the differential pressures ΔP across the flow control valves 118*a*, 118*b*, 218*c*, and 218*d* are kept constant, the rates of the flows through the flow control valves 118*a*, 118*b*, 218*c*, and 218*d* are controlled such that the flow rates are proportional to the opening areas that are determined according to the operation amounts (operating pressures a1 and b1 and the operating pressures c1 and d1) of the operation levers of the operation lever devices 522 and 523.

As mentioned before, the LS valves 120*g* and 220*g* perform load sensing control of controlling the tilts of the first and second main pumps 100 and 200 such that the LS differential pressures Pls1 and Pls2 become equal to the target LS differential pressure Pgr, respectively.

Here, the controller 70 calculates, as mentioned before, in accordance with input from the pressure sensors 6*a*1, 6*a*2, 6*b*1, 6*b*2, 6*c*1, 6*c*2, 6*d*1, 6*d*2, 61, and 62, the sum of the estimated demanded powers of the first actuators 119*a* and 119*b* and the sum of the estimated demanded powers of the second actuators 219*c* and 219*d*, calculates the first estimated demanded power ratio and the second estimated demanded power ratio, and, on the basis of these ratios, calculates the first and second command values for adjusting allocation between the first allowable torque AT1 of the first main pump 100 and the second allowable torque AT2 of the second main pump 200.

When the sum of the estimated demanded powers of the first actuators 119*a* and 119*b* is larger than the sum of the estimated demanded powers of the second actuators 219*c* and 219*d*, and for example, when the ratio between the sum of the estimated demanded powers of the first actuators 119*a* and 119*b* and the sum of the estimated demanded powers of the second actuators 219*c* and 219*d* is 70:30, the first estimated demanded power ratio is calculated as 0.7 (70%), and the second estimated demanded power ratio is calculated as 0.3 (30%). From these ratios, the controller 70 calculates a value corresponding to 0.7 (70%), which is the first estimated demanded power ratio, as the first command value for the first torque control valve 35*a* in accordance with the command value table 79*e* illustrated in FIG. 7, and calculates 0 as the second command value for the second torque control valve 35*b* in accordance with the command value table 79*f* illustrated in FIG. 8.

The calculated first and second command values are output to the first and second torque control valves 35*a* and 35*b* as electric signals, and the first and second torque control valves 35*a* and 35*b* output pressures according to the input first and second command values on the basis of the output characteristics illustrated in FIG. 9 and FIG. 10.

The output pressure of the first torque control valve 35*a* is introduced to the increase torque control piston 120*c* of the first regulator 120 and the reduction torque control piston 220*d* of the second regulator 220, the output pressure of the second torque control valve 35*b* is introduced to the increase torque control piston 220*c* of the second regulator 220 and the reduction torque control piston 120*d* of the first regulator 120, and the allowable torque AT1 of the first main pump 100 and the allowable torque AT2 of the second main pump 200 are set as follows.

$$AT1=((\text{total output torque } T\text{Eng of prime mover 1})-(\text{consumed torque } T4 \text{ of pilot pump 400}))\times 0.7$$

$$AT2=((\text{total output torque } T\text{Eng of prime mover 1})-(\text{consumed torque } T4 \text{ of pilot pump 400}))\times 0.3$$

When the sum of the estimated demanded powers of the first actuators 119*a* and 119*b* is smaller than the sum of the estimated demanded powers of the second actuators 219*c* and 219*d*, and for example, when the ratio between the sum of the estimated demanded powers of the first actuators 119*a* and 119*b* and the sum of the estimated demanded powers of the second actuators 219*c* and 219*d* is 40:60, the first estimated demanded power ratio is calculated as 0.4 (40%), and the second estimated demanded power ratio is calculated as 0.6 (60%). From these ratios, the controller 70 calculates 0 as the first command value for the first torque control valve 35*a* in accordance with the command value table 79*e* illustrated in FIG. 7, and calculates a value corresponding to 0.6 (60%), which is the second estimated demanded power ratio, as the second command value for the second torque control valve 35*b* in accordance with the command value table 79*f* illustrated in FIG. 8.

The calculated first and second command values are output to the first and second torque control valves 35*a* and 35*b* as electric signals, and the first and second torque control valves 35*a* and 35*b* output pressures according to the input first and second command values on the basis of the output characteristics illustrated in FIG. 9 and FIG. 10.

The output pressure of the second torque control valve 35*b* is introduced to the increase torque control piston 220*c* of the second regulator 220 and the reduction torque control piston 120*d* of the first regulator 120, the output pressure of the second torque control valve 35*b* is introduced to the increase torque control piston 220*c* of the second regulator 220 and the reduction torque control piston 120*d* of the first regulator 120, and the allowable torque AT1 of the first main pump 100 and the allowable torque AT2 of the second main pump 200 are set as follows.

$$AT1=((\text{total output torque } T\text{Eng of prime mover 1})-(\text{consumed torque } T4 \text{ of pilot pump 400}))\times 0.4$$

$$AT2=((\text{total output torque } T\text{Eng of prime mover 1})-(\text{consumed torque } T4 \text{ of pilot pump 400}))\times 0.6$$

At this time, when the consumed torque T1 of the first main pump 100 is smaller than the set first allowable torque AT1, the first main pump 100 operates according to load sensing control. When the consumed torque T1 is to become larger than the set first allowable torque AT1, the torque control piston 120*a* forcibly reduces the delivery flow rate of the first main pump 100, and the first main pump 100 operates according to horsepower control.

In addition, when the consumed torque T2 of the second main pump 200 is smaller than the set second allowable torque AT2, the second main pump 200 operates according to load sensing control. When the consumed torque T2 is to become larger than the set second allowable torque AT2, the torque control piston 220*a* forcibly reduces the delivery flow rate of the second main pump 200, and the second main pump 200 operates according to horsepower control.

That is, where the first actuators 119*a* and 119*b* and the second actuators 219*c* and 219*d* are operated simultaneously, the allowable torques AT1 and AT2 of the first main pump 100 and the second main pump 200 are set to torques that are calculated by dividing the allowable torque (T1*i*+T2*i*) allocated to the first and second main pumps 100 and 200 according to the operating pressures a1 and b1 and operating pressures c1 and d1 of the operation lever devices 522 and 523, and the ratio between the sum of the estimated demanded powers of the first actuators 119*a* and 119*b* and the sum of the estimated demanded powers of the second actuators 219*c* and 219*d* calculated from the pressures P1 and P2 of the first and second hydraulic fluid supply lines 105 and 205, which are the delivery pressures of the first and second main pumps 100 and 200. The first main pump 100 is subjected to load sensing control when the consumed torque T1 of the first main pump 100 does not become larger than the allowable torque AT1, and is subjected to horsepower control such that the delivery flow rate of the first main pump 100 is reduced forcibly when the consumed torque T1 is to become larger than the allowable torque AT1. The second main pump 200 is subjected to load sensing control when the consumed torque T2 of the second main pump 200 does not become larger than the allowable torque AT2, and is subjected to horsepower control such that the delivery flow rate of the second main pump 200 is reduced forcibly when the consumed torque T2 is to become larger than the allowable torque AT2.

—Advantages—

In the thus configured present embodiment, the following advantages can be attained.

1. The controller 70 calculates the ratio between the sum of the estimated demanded powers of the plurality of first actuators 119*a*, 119*b*, . . . and the sum of the estimated demanded powers of the plurality of second actuators 219*c*, 219*d*, . . . , and, on the basis of the ratio, calculates the first and second command values for adjusting allocation between the first allowable torque AT1 of the first main pump 100 and the second allowable torque AT2 of the second main pump 200. On the basis of the first and second command values, the first and second torque control valves 35*a* and 35*b* generate the first and second output pressures. On the basis of the first and second output pressures, the first and second regulators 120 and 220 adjust the first and second allowable torques such that the first and second allowable torques become values to which the total T1*i*+T2*i* of the first and second initial allowable torques, which is the predetermined allowable torque, is allocated according to the ratio described above.

By estimating the respective demanded power of the plurality of first and second actuators 119*a*, 119*b*, . . . ; 219*c*, 219*d*, . . . , and adjusting the first and second allowable torques AT1 and AT2 of the first and second main pumps 100 and 200 in this manner, when the delivery flow rate of either one pump is kept low and there is a margin in consumed torque, accordingly the first and second allowable torques AT1 and AT2 are adjusted, and the consumed torque of the other pump can be increased. Thereby, in a hydraulic drive system that performs total horsepower control of performing control such that the total of the consumed torques of the first and second main pumps 100 and 200 does not become larger than the predetermined allowable torque, torque allocation can be performed efficiently between the first and second main pumps 100 and 200, and the torque generated by the prime mover 1 can be utilized effectively without being wasted.

In addition, since the torque generated by the prime mover 1 can be utilized effectively without being wasted, speed reductions and driving force reductions at the time of driving of the plurality of first and second actuators 119*a*, 119*b*, . . . ; 219*c*, 219*d*, . . . can be reduced, and excellent operability can be attained.

2. In addition, where the adjustment of the first and second allowable torques AT1 and AT2 is performed only by an increase horsepower method, there is a problem that a rise of the allowable torques cannot catch up with a sudden increase in the consumed torques of the hydraulic pumps, and a necessary driving force cannot be obtained. Where the adjustment of the allowable torques is performed only by a reduction horsepower method, there is a problem that a fall of the allowable torques is too late for a sudden increase in the consumed torques of the hydraulic pumps, and the prime mover 1 stalls undesirably due to over torque.

In the present embodiment, an increase horsepower/reduction horsepower method is performed, in which the first and second initial allowable torques T1*i* and T2*i*, which are the initial values of the first and second allowable torques AT1 and AT2, are preset to halves of the total allowable torque allocated to the first and second main pumps 100 and 200, and the first and second allowable torques AT1 and AT2 are increased or reduced according to the output pressures of the first and second torque control valves 35*a* and 35*b*. Thereby, it is possible to mitigate a problem about the increase horsepower method that a rise of the allowable torques cannot catch up with a sudden increase in the consumed torques of the first and second main pumps 100 and 200, and a necessary driving force cannot be obtained, and a problem about the reduction horsepower method that a fall of the allowable torques is too late for a sudden increase in the consumed torques of the first and second main pumps 100 and 200, and the prime mover 1 stalls undesirably due to over torque.

3. In addition, the increase torque control piston 120*c* and the reduction torque control piston 120*d* are provided to the first regulator 120, the increase torque control piston 220*c* and the reduction torque control piston 220*d* are provided to the second regulator 220, and torque increase and torque reduction are performed in the first and second regulators 120 and 220 to adjust the first and second allowable torques AT1 and AT2. Accordingly, even where there are differences in the characteristics between the first and second torque control valves 35*a* and 35*b*, which are solenoid valves, the differences in the characteristics are cancelled out, accurate torque allocation can be performed, and the prime mover 1 can be surely prevented from stalling.

4. In the first and second regulators 120 and 220, the first and second initial allowable torques T1*i* and T2*i* are set by the spring 120*f* and 220*f*, and the first and second allowable torques are increased or decreased according to the output pressures of the first and second torque control valves 35*a* and 35*b*, which are solenoid valves, relative to the first and second initial allowable torques T1*i* and T2*i* as reference torques. Thereby, even where the controller 70 malfunctions, and electric signals of the first and second command values have stopped being output to the first and second torque control valves 35*a* and 35*b*, the first and second initial allowable torques T1*i* and T2*i* are set for the first and second main pumps 100 and 200 as the first and second allowable torques AT1 and AT2 by the springs 120*f* and 220*f*, the first and second initial allowable torques T1*i* and T2*i* are set, and necessary work can be performed. In addition, since the first and second initial allowable torques T1*i* and T2*i* set as the first and second allowable torques AT1 and AT2 are the same value, if actuators to be driven are left and right travel motors, the travel motors LTM and RTM, the hydraulic fluids are supplied at the same flow rate from the first and second main pumps 100 and 200 by performing operation of the operation lever devices 524*a* and 524*b* for travelling (see FIG. 13) by the same amount as usual, and the hydraulic excavator can travel straight easily.

Second Embodiment

—Configuration—

Figure 14:
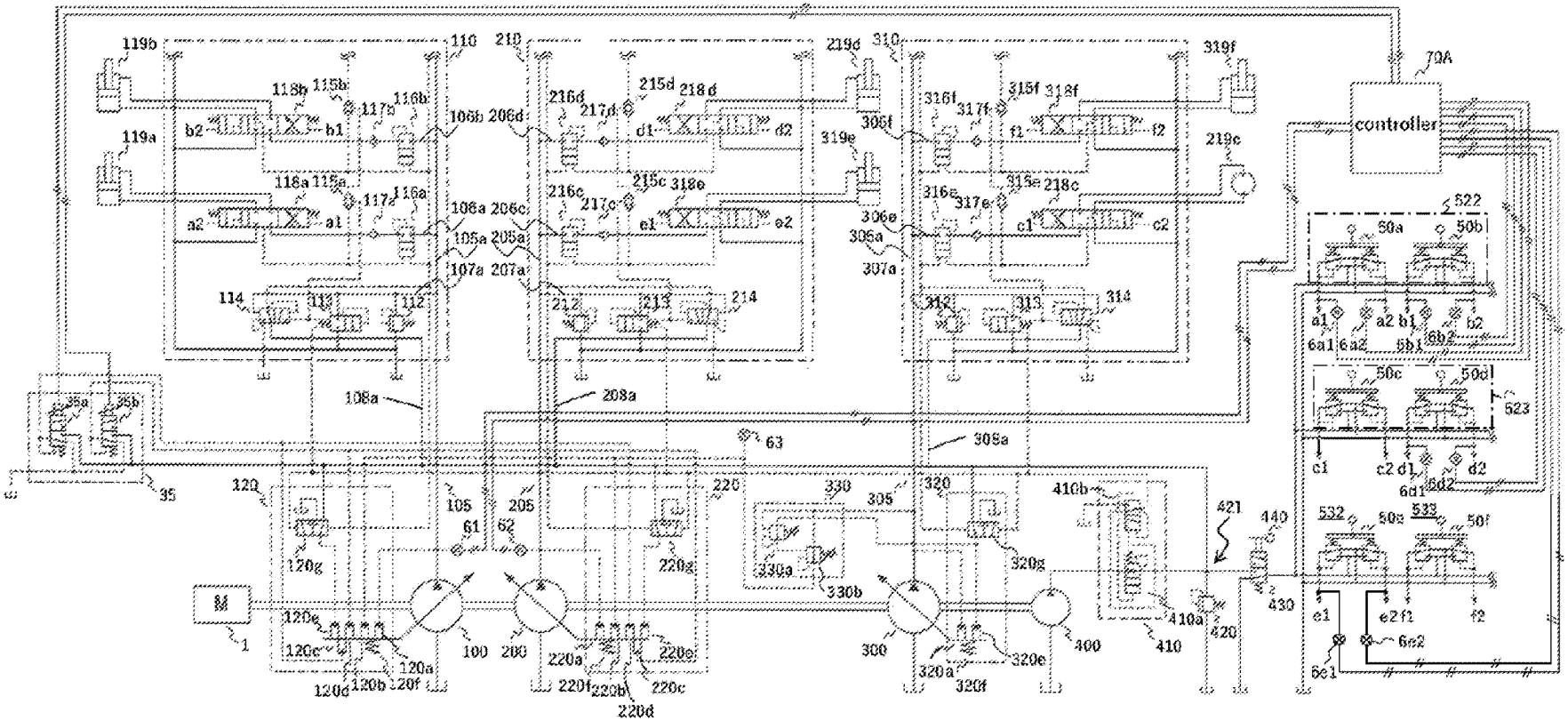
FIG. 14 is a figure illustrating the hydraulic drive system for a construction machine in a second embodiment of the present invention.

FIG. 14 is a figure illustrating the hydraulic drive system for the construction machine according to a second embodiment of the present invention.

In the present embodiment also, the construction machine is a hydraulic excavator.

In the hydraulic drive system according to the present embodiment, portions related to the first and second main pumps 100 and 200 have the same configurations as the first embodiment. It should be noted that, in the present embodiment, one of the plurality of second actuators which is the actuator 219*c* (the swing motor SM illustrated in FIG. 13) in the first embodiment driven by the hydraulic fluid delivered from the second main pump 200 is replaced with an actuator 319*e* (the swing cylinder SS illustrated in FIG. 13), and, along with this, one of the second flow control valves which is the flow control valve 218*c* is replaced with a flow control valve 318*e*.

In addition, the hydraulic drive system according to the present embodiment includes: a third variable displacement main pump 300 driven by the prime mover 1; a third regulator 320 for controlling the delivery flow rate of the third main pump 300; a plurality of third actuators 219*c*, 319*f*, . . . driven by a hydraulic fluid delivered from the third main pump 300; a third hydraulic fluid supply line 305 for supplying the hydraulic fluid delivered from the third main pump 300 to the plurality of third actuators 219*c*, 319*f*, . . . ; and a third control valve block 310 that is provided downstream of the third hydraulic fluid supply line 305, and is for distributing the hydraulic fluid delivered from the third main pump 300 to the plurality of third actuators 219*c*, 319*f*, . . . . That is, in the present embodiment, the actuator 219*c* (the swing motor SM illustrated in FIG. 13) is provided on the side of the third main pump 300.

Furthermore, the hydraulic drive system according to the present embodiment further comprises a torque estimating device 330 that generates a pressure (torque-estimated pressure) taking into consideration the estimated consumed torque of the third main pump, and a third pressure sensor 63 that senses the torque-estimated pressure generated by the torque estimating device 330.

The third control valve block 310 includes: a hydraulic line 305*a* connected to the third hydraulic fluid supply line 305; a plurality of third closed center flow control valves 218*c*, 318*f*, . . . that are arranged on a plurality of hydraulic lines 306*e*, 306*f*, . . . branching off from the hydraulic line 305*a*, and introducing the hydraulic fluid supplied from the third main pump 300 to the plurality of third actuators 219*c*, 319*f*, . . . , and control the flow (flow rate and direction) of the hydraulic fluid supplied to the plurality of third actuators 219*c*, 319*f*, . . . ; a plurality of pressure compensating valves 316*e*, 316*f*, . . . that are arranged on the plurality of hydraulic lines 306*e*, 306*f*, . . . , and control the differential pressures across the plurality of third flow control valves 218*c*, 318*f*, . . . ; a plurality of third check valves 317*e*, 317*f*, . . . that are arranged on the plurality of hydraulic lines 306*e*, 306*f*, . . . , and prevent the counterflow of the hydraulic fluid; a main relief valve 312 that is connected to a hydraulic line 307*a* branching off from the hydraulic line 305*a*, and controls a pressure P3 of the third hydraulic fluid supply line 305 such that the pressure P3 does not become equal to or higher than a set pressure; an unloading valve 313 that is connected to the hydraulic line 307*a*, and becomes opened, and returns the hydraulic fluid in the third hydraulic fluid supply line 305 to the tank when the pressure P3 of the third hydraulic fluid supply line 305 becomes a predetermined pressure higher than a maximum load pressure Plmax3 of the plurality of third actuators 219*c*, 319*f*, . . . ; a plurality of shuttle valves 315*e*, 315*f*, . . . that are connected to load pressure sensing ports of the plurality of third flow control valves 218*c*, 318*f*, . . . , and sense the maximum load pressure Plmax3 of the plurality of third actuators 219*c*, 319*f*, . . . ; and a differential-pressure pressure reducing valve 314 that is connected to a hydraulic line 308*a* to which the pilot primary pressure Pi0 generated at the pilot relief valve 420 is introduced, receives the pressure P3 of the third hydraulic fluid supply line 305 and the maximum load pressure Plmax3 that are introduced thereto as signal pressures, and outputs, as an LS differential pressure Pls3, the absolute pressure of the differential pressure between the pressure P3 of the third hydraulic fluid supply line 305 and the maximum load pressure Plmax3.

In addition to the plurality of remote control valves 50*a*, 50*b*, 50*c*, and 50*d* provided to the operation lever device 522 and 523, a plurality of remote control valves 50*e* and 50*f* each of which includes a pair of pilot valves (pressure reducing valves) that generate corresponding ones of operating pressures e1, e2, f1, and f2 for controlling a second flow control valve 318*e* and a third flow control valve 318*f* are arranged downstream of the pilot hydraulic pressure source 421, and the remote control valves 50*e* and 50*f* are provided to operation lever devices 532 and 533 installed in the operation room. The remote control valve 50*e* is provided with pressure sensors (operation amount sensors) 6*e*1 and 6*e*2 that sense the operating pressures e1 and e2 generated according to the operation amount of the operation lever device 532 (the operation amount of the operation lever).

The third regulator 320 of the third main pump 300 includes: a torque control piston 320*a* to which the pressure P3 of the third hydraulic fluid supply line 305 of the third main pump 300 is introduced, and that performs control such that, if the pressure P3 increases, the consumed torque of the third main pump 300 does not become larger than a third allowable torque AT3 allocated to the third main pump 300 by reducing the displacement volume of the third main pump 300 (e.g. the tilt of the swash plate); a flow rate control piston 320*e* that controls the delivery flow rate of the third main pump 300 according to the demanded flow rates of the plurality of third flow control valves 218*c*, 318*f*, . . . ; an LS valve 320*g* that controls the tilt of the third main pump 300 such that the LS differential pressure Pls3 becomes equal to the target LS differential pressure Pgr by introducing the constant pilot pressure Pi0 to the flow rate control piston 320*e* and reducing the delivery flow rate of the third main pump 300 when the LS differential pressure Pls3 is higher than the target LS differential pressure Pgr, and by releasing the hydraulic fluid in the flow rate control piston 320*e* to the tank and increasing the flow rate of the third main pump 300 when the LS differential pressure Pls3 is lower than the target LS differential pressure Pgr; and a spring 320*f* that sets the third allowable torque AT3 described above.

The torque estimating device 330 corrects the delivery pressure of the third main pump 300 on the basis of the output pressure of the LS valve 320*g* introduced to the flow rate control piston 320*e*, and generates a pressure (torque-estimated pressure) taking into consideration the estimated consumed torque of the third main pump 300. The torque estimating device 330 has two variable pressure reducing valves, a pressure reducing valve 330*a* and a pressure reducing valve 330*b*, the delivery pressure P3 of the third main pump 300 is introduced to a set pressure change input section of the pressure reducing valve 330*a*, the output pressure of the LS valve 320*g* introduced to the flow rate control piston 320*e* is introduced to an input section of the pressure reducing valve 330*a*, the output pressure of the pressure reducing valve 330*a* is introduced to a set pressure change input section of the pressure reducing valve 330*b*, and the delivery pressure P3 of the third main pump 300 is introduced to an input section of a pressure reducing valve 330*b*.

According to such a configuration, the torque estimating device 330 generates the tank pressure as the torque-estimated pressure when the third actuators 219*c* and 319*f* are not being driven by the third main pump 300, and corrects the delivery pressure P3 of the third main pump 300, and generates, as the torque-estimated pressure, a pressure that increases as the consumed torque of the third main pump 300 increases when the third actuators 219*c* and 319*f* are being driven.

Operation principles of the torque estimating device 330 to correct the delivery pressure of the third main pump 300 and generate the torque-estimated pressure on the basis of the output pressure of the LS valve 320*g* introduced to the flow rate control piston 320*e* are explained in detail in a patent document (JP-2015-148236-A).

In addition to the constituent elements illustrated in FIG. 1 related to the first embodiment, the first regulator 120 of the first main pump 100 includes a reduction torque control piston 120*b* to which the output pressure (torque-estimated pressure) of the torque estimating device 330 is introduced, and that reduces the first allowable torque AT1 allocated to the first main pump 100 by a corresponding amount as the consumed torque of the third main pump 300 increases.

In addition to the constituent elements illustrated in FIG. 1 related to the first embodiment, the second regulator 220 of the second main pump 200 includes a reduction torque control piston 220*b* to which the output pressure (torque-estimated pressure) of the torque estimating device 330 is introduced, and that reduces the second allowable torque AT2 allocated to the second main pump 200 by a corresponding amount as the consumed torque of the third main pump 300 increases.

In the first embodiment, as mentioned before, the total T1*i*+T2 of the first and second initial allowable torques set by the spring 120*f* and 220*f* is the predetermined allowable torque allocated to the first and second main pumps 100 and 200, and the total allowable torque AT1+AT2 of the first and second main pumps 100 and 200 is controlled such that the total allowable torque AT1+AT2 becomes equal to the predetermined allowable torque (=T1*i*+T2*i*).

In the present embodiment, the total allowable torque AT1+AT2 of the first and second main pumps 100 and 200 is controlled such that the total allowable torque AT1+AT2 increases or decreases according to the output pressure (torque-estimated pressure) of the torque estimating device 330 introduced to the reduction torque control piston 120*b* and 220*b*, and is a variable value that assumes the maximum value when the third actuators 219*c* and 319*f* are not being driven, and the output pressure (torque-estimated pressure) of the torque estimating device 330 equals the tank pressure, and the total allowable torque AT1+AT2, which is the variable value, is used as the predetermined allowable torque allocated to the first and second main pumps 100 and 200.

Then, the first and second regulators 120 and 220 control the delivery flow rates of the first and second main pumps 100 and 200, respectively, such that the total of the consumed torques of the first and second main pumps 100 and 200 does not become larger than the total allowable torque AT1+AT2 as the variable value, which is the predetermined allowable torque allocated to the first and second main pumps 100 and 200.

Here, in the present embodiment, the first initial allowable torque T1*i* of the first regulator 120 is set by the spring 120*f* as follows:

$$T1i=((\text{total output torque } T\text{Eng of prime mover 1})-(\text{minimum consumed torque } T3 \text{ min of third main pump 300})-(\text{consumed torque } T4 \text{ of pilot pump 400}))/2$$

Similarly, the second initial allowable torque T2*i* of the second regulator 220 is also set by the spring 220*f* as follows:

$$T2i=((\text{total output torque } T\text{Eng of prime mover 1})-(\text{minimum consumed torque } T3 \text{ min of third main pump 300})-(\text{consumed torque } T4 \text{ of pilot pump 400}))/2$$

The maximum value of the total allowable torque AT1+AT2 as the variable value, which is the predetermined allowable torque allocated, out of the total output torque of the prime mover 1, to the first and second main pumps 100 and 200, is equal to the total T1*i*+T2*i* of the first and second initial allowable torques, and the maximum value (the maximum value of the predetermined allowable torque) T1*i*+T2*i* of the total allowable torque AT1+AT2 is set as follows:

$$T1i+T2i=(\text{total output torque } T \text{ of prime mover 1})-(\text{minimum consumed torque } T3 \text{ min of third main pump 300})-(\text{consumed torque } T4 \text{ of pilot pump 400})$$

In addition, in the present embodiment, the total allowable torque AT1+AT2 of the first and second main pumps 100 and 200 (the predetermined allowable torque allocated to the first and second main pumps 100 and 200) is controlled as follows by the output pressure (torque-estimated pressure) of the torque estimating device 330 being introduced to the reduction torque control pistons 120*b* and 220*b*.

$$AT1+AT2=T1i+T2i-(\text{estimated consumed torque } T3 \text{ of third main pump 300})$$

That is, the total allowable torque AT1+AT2 is controlled as follows:

$$AT1+AT2=(\text{total output torque } T\text{Eng of prime mover 1})-(\text{minimum consumed torque } T3 \text{ min of third main pump 300})-(\text{consumed torque } T4 \text{ of pilot pump 400})-(\text{estimated consumed torque } T3 \text{ of third main pump 300})$$

Here, the minimum consumed torque T3 min of the third main pump 300 is the torque of the third main pump 300 consumed when the third actuators 219*c*, 319*f*, . . . are not being driven by the third main pump 300.

As mentioned above, the third pressure sensor 63 senses the torque-estimated pressure generated by the torque estimating device 330, and the pressure sensors 6*e*1 and 6*e*2 sense the operating pressures e1 and e2 generated according to the operation amount of the operation lever device 532 (the operation amount of the operation lever), and individually output electric signals to a controller 70A.

Details of the content of processes performed by the controller 70A are explained. In the following explanation also, " . . . " in the plurality of third actuators 219*c*, 319*f*, . . . , the plurality of third flow control valves 218*c*, 318*f*, . . . and the like is omitted for simplification of the explanation.

Figure 15:
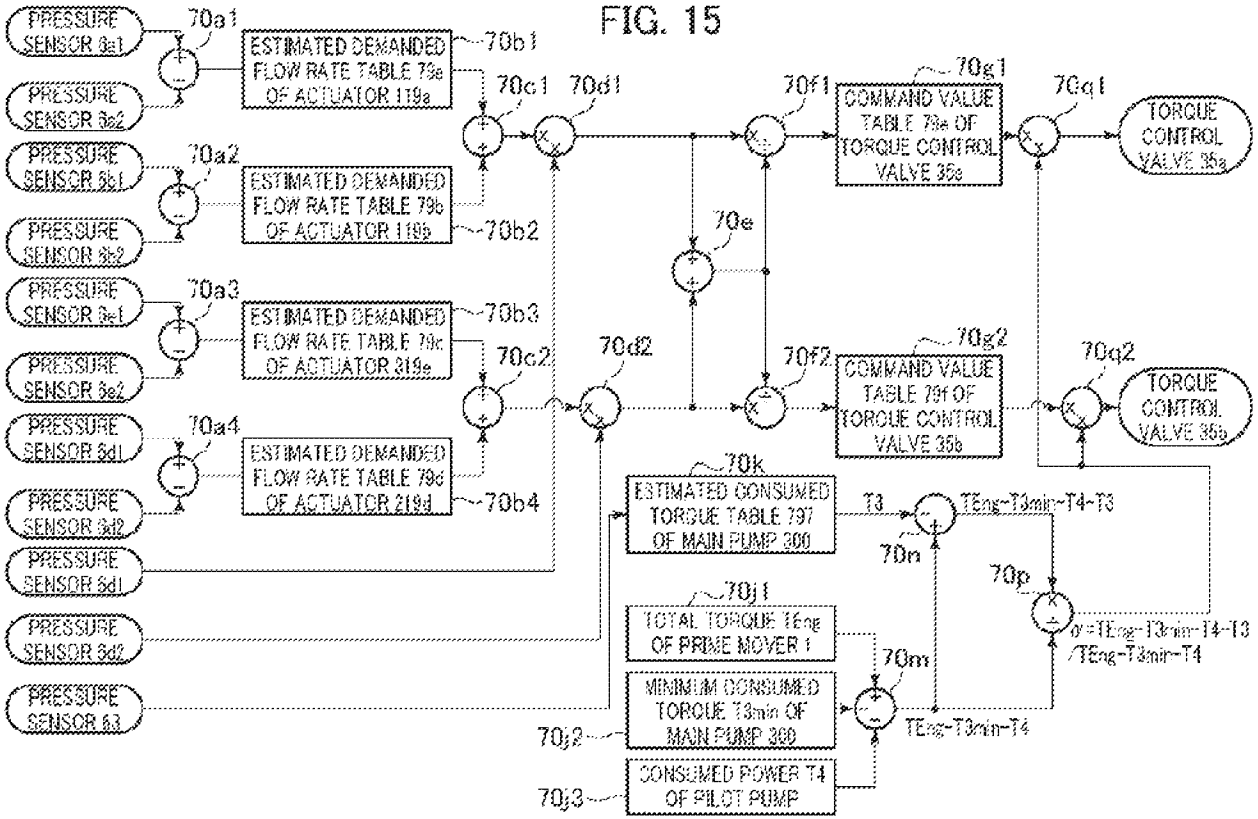
FIG. 15 is a functional block diagram illustrating the content of processes performed by a controller in the second embodiment of the present invention.

FIG. 15 is a functional block diagram illustrating the content of processes performed by the controller 70A in the second embodiment.

In the controller 70A, as compared to the functionalities of the controller 70 in the first embodiment illustrated in FIG. 2, one of the plurality of second actuators which is the actuator 219*c* is replaced with the actuator 319*e*, and, along with this, the pressure sensors 6*c*1 and 6*c*2 are replaced with the pressure sensors 6*e*1 and 6*e*2. In addition, the controller 70A has functionalities of performing the following processes, in addition to the functionalities of the controller 70 illustrated in FIG. 2.

In the controller 70A, by using a preset estimated consumed torque table 79*k* of the third main pump 300, a computing section 70*k* calculates the estimated consumed torque T3 of the third main pump 300 corresponding to the output pressure (torque-estimated pressure) of the torque estimating device 330 sensed by the third pressure sensor 63.

Figure 16:
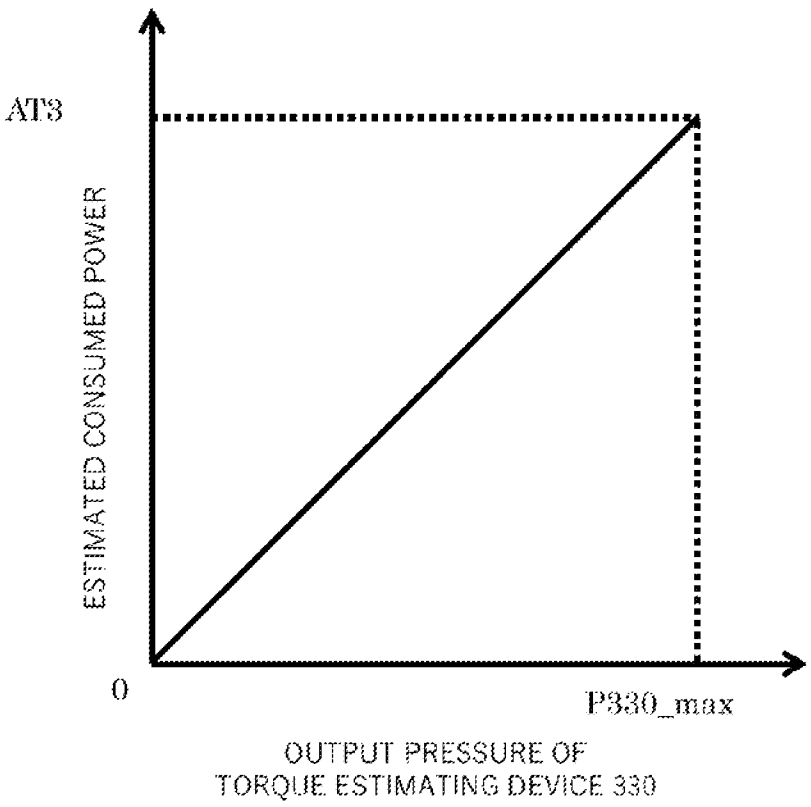
FIG. 16 is a figure illustrating table characteristics that are used in an estimated consumed torque table of a third main pump, and are for calculating an estimated consumed torque of the third main pump from the output pressure of a torque estimating device.

FIG. 16 is a figure illustrating table characteristics that are used in the estimated consumed torque table 79*k* of the third main pump 300 and are for calculating the estimated consumed torque T3 of the third main pump 300 from the output pressure of the torque estimating device 330. In the estimated consumed torque table 79*k*, a relation between the estimated consumed torque T3 and the output pressure of the torque estimating device 330 is set as the table characteristics such that the estimated consumed torque T3 of the third main pump 300 increases as the output pressure of the torque estimating device 330 increases.

In addition, in the controller 70A, the total output torque TEng of the prime mover 1, the minimum consumed torque T3 min of the third main pump 300 and the consumed torque T4 of the pilot pump 400 are preset for setting sections 70*j*1, 70*j*2, and 70*j*3, respectively. In the controller 70A, by performing a computation of TEng−T3 min−T4, a subtracting section 70*m* calculates the allowable torque that is available to the first, second, and third main pumps 100, 200, and 300 (the total allowable torque allocated to the first, second and third main pumps 100, 200, and 300), and, by performing a computation of TEng−T3 min−T4−T3, a subtracting section 70*n* calculates the allowable torque available to the first and second main pumps 100 and 200 (the maximum total allowable torque allocated to the first and second main pumps 100 and 200). As mentioned before, the minimum consumed power T3 min of the third main pump is the torque of the third main pump 300 consumed when the third actuators 219*c*, 319*f*, . . . are not being driven by the third main pump 300.

Next, in the controller 70A, by dividing TEng−T3 min−T4−T3 by TEng−T3 min−T4, a dividing section 70*p* calculates the rate of TEng−T3 min−T4−T3 to TEng−T3 min−T4 (the rate of the maximum allowable torque available to the first and second main pumps 100 and 200 to the allowable torque available to the first, second, and third main pumps 100, 200, and 300) a, and, by multiplying each of the first and second command values by the rate a, multiplying sections 70*q*1 and 70*q*2 correct the first and second command values such that the first and second allowable torques AT1 and AT2 set for the first and second regulators 120 and 220 decrease as the estimated consumed torque T3 of the third main pump 300 increases.

Next, the controller 70A outputs, to the first and second torque control valves 35*a* and 35*b*, as electric signals, the first and second command values corrected at the multiplying sections 70*q*1 and 70*q*2.

In other respects, the configuration of the second embodiment is the same as the first embodiment.

—Operation—

(a) Where all the Operation Levers are at the Neutral Positions

Since all the operation levers of the operation lever devices 522, 523, 532, and 533 are at the neutral positions, all the flow control valves 118*a*, 118*b*, 218*c*, 218*d*, 218*e*, 318*e*, and 318*f* are kept at the neutral positions by the springs provided at both ends thereof.

The hydraulic fluid delivered from the third main pump 300 is fed to the third control valve block 310 via the third hydraulic fluid supply line 305, but the entire hydraulic fluid is returned to the tank via the unloading valve 313 because all the third flow control valves 218*c* and 318*f* are kept at the neutral positions, and the hydraulic lines 306*e* and 306*f* are interrupted.

At this time, since the load pressure sensing ports of the third flow control valves 218*c* and 318*f* are communicating with the tank, the maximum load pressure Plmax3 equals the tank pressure.

The unloading valve 313 performs control such that the pressure P3 of the third hydraulic fluid supply line 305 does not become higher than Plmax3+Pgr+(spring force). Since the maximum load pressure Plmax3 equals the tank pressure as mentioned before, supposing that the tank pressure is 0, the unloading valve 313 keeps the pressure P3 of the third hydraulic fluid supply line 305 at a pressure slightly higher than the target LS differential pressure Pgr.

As the LS differential pressure Pls3, the differential-pressure pressure reducing valve 314 outputs the absolute pressure of the differential pressure between the maximum load pressure Plmax3 and the pressure P3 of the third hydraulic fluid supply line 305. Since the maximum load pressure Plmax3 equals the tank pressure as mentioned before, supposing that the tank pressure is 0, $$Pls3=P3-Pl\max3=P3>Pgr$$

is satisfied.

The LS differential pressure Pls3 is introduced to the LS valve 320*g* located in the third regulator 320. Since Pls3 is higher than Pgr, the constant pilot pressure Pi0 is introduced to the flow rate control piston 320*e* as mentioned before, and the tilt of the third main pump 300 is reduced to reduce the delivery flow rate.

In other respects, the operation is similar to the first embodiment, and where all the operation levers are at the neutral positions, the delivery flow rates of all of the first, second, and third main pumps 100, 200, and 300 are kept at the minimum rates.

(b) Where Only the Operation Lever of the First Actuators is Operated

Since the operation levers of the operation lever devices 523 (50*c*) and 533 of the third actuators 219*c* and 319*f* are at the neutral positions, the delivery flow rate of the third main pump 300 is kept at the minimum rate as mentioned before.

Since the third main pump 300 is not driving the third actuators 219*c* and 319*f*, the output pressure (torque-estimated pressure) of the torque estimating device 330 becomes 0, and the pressure introduced to the reduction torque control piston 120*b* of the first regulator 120 and the reduction torque control piston 220*b* of the second regulator 220 becomes 0. Because of this, the total allowable torque AT1+AT2 of the first and second main pumps 100 and 200 (the predetermined allowable torque allocated to the first and second main pumps 100 and 200) becomes the maximum torque.

In other respects, the operation is similar to the first embodiment. That is, where only the first actuators 119*a* and 119*b* are operated, the delivery flow rate of the second main pump 200 is kept at the minimum rate. The allowable torque AT1 of the first main pump 100 is set to the first maximum allowable torque AT11 (see FIG. 11), and the first main pump 100 is subjected to load sensing control if the consumed torque T1 of the first main pump 100 is within the range of the allowable torque AT1, and is subjected to horsepower control such that the delivery flow rate of the first main pump 100 is reduced forcibly when the consumed torque T1 is to become larger than the allowable torque AT1.

(c) Where Only the Operation Lever of the Second Actuators is Operated

Since the operation levers of the operation lever devices 523 (50*c*) and 533 of the third actuators 219*c* and 319*f* are at the neutral positions, the delivery flow rate of the third main pump 300 is kept at the minimum rate as mentioned before.

Since the third main pump 300 is not driving the third actuators 219*c* and 319*f*, the output pressure (torque-estimated pressure) of the torque estimating device 330 becomes 0, and the pressure introduced to the reduction torque control piston 120*b* of the first regulator 120 and the reduction torque control piston 220*b* of the second regulator 220 becomes 0. Because of this, the total allowable torque AT1+AT2 of the first and second main pumps 100 and 200 (the predetermined allowable torque allocated to the first and second main pumps 100 and 200) becomes the maximum torque.

In other respects, the operation is similar to the first embodiment. That is, where only the second actuators 219*d* and 319*e* are operated, the delivery flow rate of the first main pump 100 is kept at the minimum rate. The allowable torque AT2 of the second main pump 200 is set to the second maximum allowable torque AT21 (see FIG. 12), and the second main pump 200 is subjected to load sensing control if the consumed torque T2 of the second main pump 200 is within the range of the allowable torque AT2, and is subjected to horsepower control such that the delivery flow rate of the second main pump 200 is reduced forcibly when the consumed torque T2 is to become larger than the allowable torque AT2.

(d) Where Only the Operation Lever of the Third Actuators is Operated

Since the operation lever of the first actuators 119*a* and 119*b*, and the operation lever of the second actuators 219*d* and 319*e* are at the neutral position, the delivery flow rates of the first and second main pumps 100 and 200 are kept at the minimum rates as mentioned before.

When the operation levers of the operation lever devices 523 (50*c*) and 533 of the third actuators 219*c* and 319*f* are operated individually, and for example, when the operating pressure c1 and the operating pressure f1 are generated, the flow control valves 218*c* and 318*f* switch to the left side in FIG. 14.

The third actuators 219*c* and 319*f* are supplied with the hydraulic fluid delivered from the main pump 300 via the third hydraulic fluid supply line 305, the pressure compensating valves 316*e* and 316*f*, the check valves 317*e* and 317*f*, and the flow control valves 218*c* and 318*f*.

At this time, the load pressures of the third actuators 219*c* and 319*f* are introduced to the shuttle valves 315*e* and 315*f* via the load pressure sensing ports of the flow control valves 218*c* and 318*f*, the shuttle valves 315*e* and 315*f* sense the maximum load pressure Plmax3, and the maximum load pressure Plmax3 is introduced to the unloading valve 313 and the differential-pressure pressure reducing valve 314.

As mentioned before, the unloading valve 313 performs control such that the pressure P3 of the third hydraulic fluid supply line 305 does not become higher than Plmax3+Pgr+(spring force).

The differential-pressure pressure reducing valve 314 outputs, as the LS differential pressure Pls3, the absolute pressure of the differential pressure between the maximum load pressure Plmax3 and the pressure P3 of the third hydraulic fluid supply line 305, and the LS differential pressure Pls3 is introduced to pressure compensating valves 316*a* and 316*b* and the LS valve 320*g* of the third regulator 320.

The pressure compensating valve 316*e* performs control such that the downstream side pressure of the pressure compensating valve 316*e* becomes (downstream side pressure of flow control valve 218*c*)+(LS differential pressure Pls3), and the pressure compensating valve 316*f* performs control such that the downstream side pressure of the pressure compensating valve 316*f* becomes (downstream side pressure of flow control valve 318*f*)+(LS differential pressure Pls3).

That is, since the pressure compensating valves 316*e* and 316*f* perform control such that the differential pressures ΔP across the flow control valves 218*c* and 318*f* are kept constant, the rates of the flows through the flow control valves 218*c* and 318*f* are controlled such that the flow rates are proportional to the opening areas that are determined according to the operation amounts (operating pressures c1 and f1) of the operation levers of the operation lever devices 523 and 533.

As mentioned before, the LS valve 320*g* performs load sensing control of controlling the tilt of the third main pump 300 such that the LS differential pressure Pls3 becomes equal to the target LS differential pressure Pgr by increasing the delivery flow rate of the third main pump 300 to increase the LS differential pressure Pls3 when the delivery flow rate of the third main pump 300 becomes insufficient, and Pls3 becomes lower than Pgr, and by reducing the delivery flow rate of the third main pump 300 to reduce the LS differential pressure Pls3 when the delivery flow rate of the third main pump 300 becomes excessive and Pls3 becomes higher than Pgr.

At this time, when the estimated consumed torque T3 of the third main pump 300 is smaller than the third allowable torque AT3 set by the spring 320*f*, the third main pump 300 operates according to load sensing control. When the estimated consumed torque T3 is to become larger than the preset third allowable torque AT3, the torque control piston 320*a* forcibly reduces the delivery flow rate of the third main pump 300, and the third main pump 300 operates according to horsepower control.

As mentioned before, the torque estimating device 330 outputs the pressure (torque-estimated pressure) taking into consideration the estimated consumed torque of the third main pump 300, the output pressure is introduced to the reduction torque control piston 120*b* of the first regulator 120 and the reduction torque control piston 220*b* of the second regulator 220, and the first allowable torque AT1 and the second allowable torque AT2 are reduced equally such that the total allowable torque AT1+AT2, which is the sum of the first allowable torque AT1 and the second allowable torque AT2 (the predetermined allowable torque allocated to the first and second main pumps 100 and 200), satisfies:

$$AT1+AT2=(\text{total output torque } T\text{Eng of prime mover } 1)-(\text{minimum consumed torque } T3 \text{ min of third main pump } 300)-(\text{consumed torque } T4 \text{ of pilot pump } 400)$$

However, since the operation levers of the operation lever devices 522, 523 (50*d*), and 532 of the first and second actuators 119*a* and 119*b*, and 219*d* and 319*e* are not being operated at this time, the delivery flow rates of the first and second main pumps 100 and 200 are kept at the minimum rates.

(e) Where the Operation Levers of the First Actuators and the Second Actuators are Operated Simultaneously Since the operation levers of the operation lever devices 523 (50*c*) and 533 of the third actuators 219*c* and 319*f* are at the neutral positions, the delivery flow rate of the third main pump 300 is kept at the minimum rate as mentioned before.

Since the third main pump 300 is not driving the third actuators 219*c* and 319*f*, the output pressure (torque-estimated pressure) of the torque estimating device 330 becomes 0, and the pressure introduced to the reduction torque control piston 120*b* of the first regulator 120 and the reduction torque control piston 220*b* of the second regulator 220 becomes 0. Because of this, the total allowable torque AT1+AT2 of the first and second main pumps 100 and 200 (the predetermined allowable torque allocated to the first and second main pumps 100 and 200) becomes the maximum torque.

When the operation lever of the operation lever device 522 of the first actuators 119*a* and 119*b*, and the operation levers of the operation lever devices 523 (50*d*) and 532 of the second actuators 219*d* and 319*e* are operated simultaneously, and the operating pressures a1 and b1 and the operating pressures d1 and e1 are generated, the flow control valves 118*a* and 118*b* switch to the right side in FIG. 14, and the flow control valves 218*d* and 319*e* switch to the left side in FIG. 14.

Here, as mentioned before, in accordance with input from the pressure sensors 6*a*1, 6*a*2, 6*b*1, 6*b*2, 6*d*1, 6*d*2, 6*e*1, 6*e*2, 61, 62 and 63, the controller 70A calculates the sum of the estimated demanded powers of the first actuators 119*a* and 119*b*, and the sum of the estimated demanded powers of the second actuators 219*d* and 319*e*, calculates the first estimated demanded power ratio and the second estimated demanded power ratio, and, on the basis of these ratios, calculates the first and second command values for adjusting allocation between the first allowable torque AT1 of the first main pump 100 and the second allowable torque AT2 of the second main pump 200.

When the sum of the estimated demanded powers of the first actuators 119*a* and 119*b* is larger than the sum of the estimated demanded powers of the second actuators 219*d* and 319*e*, and for example, when the ratio between the sum of the estimated demanded powers of the first actuators 119*a* and 119*b* and the sum of the estimated demanded powers of the second actuators 219*d* and 319*e* is 70:30, the first estimated demanded power ratio is calculated as 0.7 (70%), and the second estimated demanded power ratio is calculated as 0.3 (30%). From these ratios, the controller 70A calculates a value corresponding to 0.7 (70%), which is the first estimated demanded power ratio, as the first command value for the first torque control valve 35*a* in accordance with the command value table 79*e* illustrated in FIG. 7, and calculates 0 as the second command value for the second torque control valve 35*b* in accordance with the command value table 79*f* illustrated in FIG. 8.

The calculated first and second command values are output to the first and second torque control valves 35*a* and 35*b* as electric signals, and the first and second torque control valves 35*a* and 35*b* output pressures according to the input first and second command values on the basis of the output characteristics illustrated in FIG. 9 and FIG. 10.

The output pressure of the first torque control valve 35*a* is introduced to the increase torque control piston 120*c* of the first regulator 120 and the reduction torque control piston 220*d* of the second regulator 220, the output pressure of the second torque control valve 35*b* is introduced to the increase torque control piston 220*c* of the second regulator 220 and the reduction torque control piston 120*d* of the first regulator 120, and the allowable torque AT1 of the first main pump 100 and the allowable torque AT2 of the second main pump 200 are set as follows.

$$AT1=((\text{total output torque } T\text{Eng of prime mover 1})-(\text{minimum consumed torque } T3 \text{ min of third main pump 300})-(\text{consumed torque } T4 \text{ of pilot pump 400}))\times 0.7$$

$$AT2=((\text{total output torque } T\text{Eng of prime mover 1})-(\text{minimum consumed torque } T3 \text{ min of third main pump 300})-(\text{consumed torque } T4 \text{ of pilot pump 400}))\times 0.3$$

When the sum of the estimated demanded powers of the first actuators 119*a* and 119*b* is smaller than the sum of the estimated demanded powers of the second actuators 219*d* and 319*e*, and for example, when the ratio between the sum of the estimated demanded powers of the first actuators 119*a* and 119*b* and the sum of the estimated demanded powers of the second actuators 219*d* and 319*e* is 40:60, the first estimated demanded power ratio is calculated as 0.4 (40%), and the second estimated demanded power ratio is calculated as 0.6 (60%). From these ratios, the controller 70A calculates 0 as the first command value for the first torque control valve 35*a* in accordance with the command value table 79*e* illustrated in FIG. 7, and calculates a value corresponding to 0.6 (60%), which is the second estimated demanded power ratio, as the second command value for the second torque control valve 35*b* in accordance with the command value table 79*f* illustrated in FIG. 8.

The calculated first and second command values are output to the first and second torque control valves 35*a* and 35*b* as electric signals, and the first and second torque control valves 35*a* and 35*b* output pressures according to the input first and second command values on the basis of the output characteristics illustrated in FIG. 9 and FIG. 10.

The output pressure of the second torque control valve 35*b* is introduced to the increase torque control piston 220*c* of the second regulator 220 and the reduction torque control piston 120*d* of the first regulator 120, the output pressure of the second torque control valve 35*b* is introduced to the increase torque control piston 220*c* of the second regulator 220 and the reduction torque control piston 120*d* of the first regulator 120, and the allowable torque AT1 of the first main pump 100 and the allowable torque AT2 of the second main pump 200 are set as follows.

$$AT1=((\text{total output torque } T\text{Eng of prime mover 1})-(\text{minimum consumed torque } T3 \text{ min of third main pump 300})-(\text{consumed torque } T4 \text{ of pilot pump 400}))\times 0.4$$

$$AT2=((\text{total output torque } T\text{Eng of prime mover 1})-(\text{minimum consumed torque } T3 \text{ min of third main pump 300})-(\text{consumed torque } T4 \text{ of pilot pump 400}))\times 0.6$$

At this time, when the consumed torque T1 of the first main pump 100 is smaller than the set first allowable torque AT1, the first main pump 100 operates according to load sensing control. When the consumed torque T1 is to become larger than the set first allowable torque AT1, the torque control piston 120*a* forcibly reduces the delivery flow rate of the first main pump 100, and the first main pump 100 operates according to horsepower control.

In addition, when the consumed torque T2 of the second main pump 200 is smaller than the set second allowable torque AT2, the second main pump 200 operates according to load sensing control. When the consumed torque T2 is to become larger than the set second allowable torque AT2, the torque control piston 220*a* forcibly reduces the delivery flow rate of the second main pump 200, and the second main pump 200 operates according to horsepower control.

That is, where the operation lever of the operation lever device 522 of the first actuators 119*a* and 119*b*, and the operation levers of the operation lever devices 523 (50*d*) and 532 of the second actuators 219*d* and 319*e* are operated simultaneously, the first and second allowable torques AT1 and AT2 of the first main pump 100 and the second main pump 200 are set to torques that are calculated by dividing the allowable torque (T1*i*+T2*i*) allocated to the first and second main pumps 100 and 200 according to the operating pressures a1 and b1 and the operating pressure e1 and d1 of the operation lever devices 522, 523 (50*d*), and 532, and the ratio between the sum of the estimated demanded powers of the first actuators 119*a* and 119*b* and the sum of the estimated demanded powers of the second actuators 219*d* and 319*e* calculated from the pressures P1 and P2 of the first and second hydraulic fluid supply lines 105 and 205, which are the delivery pressures of the first and second main pumps 100 and 200. The first main pump 100 is subjected to load sensing control when the consumed torque T1 of the first main pump 100 does not become larger than the allowable torque AT1, and is subjected to horsepower control such that the delivery flow rate of the first main pump 100 is reduced forcibly when the consumed torque T1 is to become larger than the allowable torque AT1. The second main pump 200 is subjected to load sensing control when the consumed torque T2 of the second main pump 200 does not become larger than the allowable torque AT2, and is subjected to horsepower control such that the delivery flow rate of the second main pump 200 is reduced forcibly when the consumed torque T2 is to become larger than the allowable torque AT2.

(f) Where the Operation Levers of the First Actuators, the Second Actuators, and the Third Actuators are Operated Simultaneously When the operation lever of the operation lever device 522 of the first actuators 119*a* and 119*b*, the operation levers of the operation lever devices 523 (50*d*) and 532 of the second actuators 219*d* and 319*e*, and the operation levers of the operation lever devices 523 (50*c*) and 533 of the third actuators 219*c* and 319*f* are operated simultaneously, the operating pressures a1 and b1 and the operating pressures e1 and d1 are generated, and for example, when the operating pressure c1 and the operating pressure f1 are generated, the flow control valves 118*a* and 118*b* switch to the right side in FIG. 14, and the flow control valves 218*d* and 318*e* switch to the left side in FIG. 14. The flow control valves 218*c* and 318*f* switch to the left side in FIG. 14.

At this time, as mentioned before, when the estimated consumed torque T3 of the third main pump 300 is smaller than the third allowable torque AT3 set by the spring 320*f*, the third main pump 300 operates according to load sensing control. When the estimated consumed torque T3 is to become larger than the third allowable torque AT3, the torque control piston 320*a* forcibly reduces the delivery flow rate of the third main pump 300, and the third main pump 300 operates according to horsepower control.

As mentioned before, the torque estimating device 330 outputs the pressure (torque-estimated pressure) taking into consideration the estimated consumed torque of the third main pump 300, the output pressure is introduced to the reduction torque control piston 120*b* of the first regulator 120 and the reduction torque control piston 220*b* of the second regulator 220, and the first allowable torque AT1 and the second allowable torque AT2 are reduced equally such that the total allowable torque AT1+AT2, which is the sum of the first allowable torque AT1 and the second allowable torque AT2 (the predetermined allowable torque allocated to the first and second main pumps 100 and 200), satisfies:

$$AT1+AT2=(\text{total output torque } T\text{Eng of prime mover 1})-(\text{minimum consumed torque } T3 \text{ min of third main pump 300})-(\text{consumed torque } T4 \text{ of pilot pump 400})-(\text{estimated consumed torque } T3 \text{ of third main pump 300})$$

Furthermore, at this time, as mentioned before, the controller 70A calculates, in accordance with input from the pressure sensors 6*a*1, 6*a*2, 6*b*1, 6*b*2, 6*d*1, 6*d*2, 6*e*1, 6*e*2, 61, 62, and 63, the sum of the estimated demanded powers of the first actuators 119*a* and 119*b* and the sum of the estimated demanded powers of the second actuators 219*d* and 319*e*, calculates the first estimated demanded power ratio and the second estimated demanded power ratio, and, on the basis of these ratios, calculates the first and second command values for adjusting allocation between the first allowable torque AT1 of the first main pump 100 and the second allowable torque AT2 of the second main pump 200.

When the sum of the estimated demanded powers of the first actuators 119*a* and 119*b* is larger than the sum of the estimated demanded powers of the second actuator 219*d* and 319*e*, and for example, when the ratio between the sum of the estimated demanded powers of the first actuators 119*a* and 119*b* and the sum of the estimated demanded powers of the second actuator 219*d* and 319*e* is 70:30, the first estimated demanded power ratio is calculated as 0.7 (70%), and the second estimated demanded power ratio is calculated as 0.3 (30%). From these ratios, the controller 70A calculates a value corresponding to 0.7 (70%), which is the first estimated demanded power ratio, as the first command value for the first torque control valve 35*a* in accordance with the command value table 79*e* illustrated in FIG. 7, and calculates 0 as the second command value for the second torque control valve 35*b* in accordance with the command value table 79*f* illustrated in FIG. 8.

The calculated first and second command values are output to the first and second torque control valves 35*a* and 35*b* as electric signals, and the first and second torque control valves 35*a* and 35*b* output pressures according to the input first and second command values on the basis of the output characteristics illustrated in FIG. 9 and FIG. 10.

The output pressure of the first torque control valve 35*a* is introduced to the increase torque control piston 120*c* of the first regulator 120 and the reduction torque control piston 220*d* of the second regulator 220, the output pressure of the second torque control valve 35*b* is introduced to the increase torque control piston 220*c* of the second regulator 220 and the reduction torque control piston 120*d* of the first regulator 120, and the allowable torque AT1 of the first main pump 100 and the allowable torque AT2 of the second main pump 200 are set as follows.

$$AT1=((\text{total output torque } T\text{Eng of prime mover 1})-(\text{minimum consumed torque } T3 \text{ min of third main pump 300})-(\text{consumed torque } T4 \text{ of pilot pump 400})-(\text{estimated consumed torque } T3 \text{ of third main pump 300}))\times 0.7$$

$$AT2=((\text{total output torque } T\text{Eng of prime mover 1})-(\text{minimum consumed torque } T3 \text{ min of third main pump 300})-(\text{consumed torque } T4 \text{ of pilot pump 400})-(\text{estimated consumed torque } T3 \text{ of third main pump 300}))\times 0.3$$

When the sum of the estimated demanded powers of the first actuators 119*a* and 119*b* is smaller than the sum of the estimated demanded powers of the second actuator 219*d* and 319*e*, and for example, when the ratio between the sum of the estimated demanded powers of the first actuators 119*a* and 119*b* and the sum of the estimated demanded powers of the second actuator 219*d* and 319*e* is 40:60, the first estimated demanded power ratio is calculated as 0.4 (40%), and the second estimated demanded power ratio is calculated as 0.6 (60%). From these ratios, the controller 70A calculates 0 as the first command value for the first torque control valve 35*a* in accordance with the command value table 79*e* illustrated in FIG. 7, and calculates a value corresponding to 0.6 (60%), which is the second estimated demanded power ratio, as the second command value for the second torque control valve 35*b* in accordance with the command value table 79*f* illustrated in FIG. 8.

The calculated first and second command values are output to the first and second torque control valves 35*a* and 35*b* as electric signals, and the first and second torque control valves 35*a* and 35*b* output pressures according to the input first and second command values on the basis of the output characteristics illustrated in FIG. 9 and FIG. 10.

The output pressure of the second torque control valve 35*b* is introduced to the increase torque control piston 220*c* of the second regulator 220 and the reduction torque control piston 120*d* of the first regulator 120, the output pressure of the second torque control valve 35*b* is introduced to the increase torque control piston 220*c* of the second regulator 220 and the reduction torque control piston 120*d* of the first regulator 120, and the allowable torque AT1 of the first main pump 100 and the allowable torque AT2 of the second main pump 200 are set as follows.

$AT1$=((total output torque $T$Eng of prime mover 1)−(minimum consumed torque $T3$ min of third main pump 300)−(consumed torque $T4$ of pilot pump 400)−(estimated consumed torque $T3$ of third main pump 300))×0.4

$AT2$=((total output torque $T$Eng of prime mover 1)−(minimum consumed torque $T3$ min of third main pump 300)−(consumed torque $T4$ of pilot pump 400)−(estimated consumed torque $T3$ of third main pump 300))×0.6

At this time, when the consumed torque T1 of the first main pump 100 is smaller than the set first allowable torque AT1, the first main pump 100 operates according to load sensing control. When the consumed torque T1 is to become larger than the set first allowable torque AT1, the torque control piston 120*a* forcibly reduces the delivery flow rate of the first main pump 100, and the first main pump 100 operates according to horsepower control.

In addition, when the consumed torque T2 of the second main pump 200 is smaller than the set second allowable torque AT2, the second main pump 200 operates according to load sensing control. When the consumed torque T2 is to become larger than the set second allowable torque AT2, the torque control piston 220*a* forcibly reduces the delivery flow rate of the second main pump 200, and the second main pump 200 operates according to horsepower control.

That is, where the operation lever of the operation lever device 522 of the first actuators 119*a* and 119*b*, the operation levers of the operation lever devices 523 (50*d*) and 532 of the second actuators 219*d* and 319*e*, and the operation levers of the operation lever devices 523 (50*c*) and 533 of the third actuators 219*c* and 319*f* are operated simultaneously, the third main pump 300 operates according to load sensing control when the estimated consumed torque T3 of the third main pump 300 is smaller than the third allowable torque AT3 set by the spring 320*f*, and operates according to horsepower control such that the delivery flow rate is reduced forcibly when the estimated consumed torque T3 is to become larger than the third allowable torque AT3.

In addition, the predetermined allowable torque allocated to the first and second main pumps 100 and 200 is set to a value obtained by subtracting the estimated consumed torque T3 of the third main pump 300 from the maximum value of the total allowable torque AT1+AT2, and the first and second allowable torques AT1 and AT2 of the first main pump 100 and the second main pump 200 are set to torques that are calculated by dividing the predetermined allowable torque according to the ratio between the sum of the estimated demanded powers of the first actuators 119*a* and 119*b* and the sum of the estimated demanded powers of the second actuators 219*d* and 319*e*. The first main pump 100 is subjected to load sensing control when the consumed torque T1 of the first main pump 100 does not become larger than the allowable torque AT1, and is subjected to horsepower control such that the delivery flow rate of the first main pump 100 is reduced forcibly when the consumed torque T1 is to become larger than the allowable torque AT1. The second main pump 200 is subjected to load sensing control when the consumed torque T2 of the second main pump 200 does not become larger than the allowable torque AT2, and is subjected to horsepower control such that the delivery flow rate of the second main pump 200 is reduced forcibly when the consumed torque T2 is to become larger than the allowable torque AT2.

—Advantages—

In the thus configured present embodiment, the first and second regulators 120 and 220 receive, as input from the torque estimating device 330, the torque-estimated pressure which is a hydraulically estimated consumed torque of the third main pump 300 and, on the basis of the torque-estimated pressure, reduces the predetermined allowable torque (T1*i*+T2*i*) allocated to the first and second main pumps 100 and 200, which is the predetermined allowable torque, by an amount corresponding to the estimated consumed torque of the third main pump 300. Thereby, the consumed torque of the third main pump 300 is accurately reflected in the first and second regulators 120 and 220, and the predetermined allowable torque can be precisely allocated to the first and second main pumps.

In addition, in the present embodiment, the controller 70A calculates the estimated consumed torque of the third main pump 300 on the basis of the sensed value of the third pressure sensor 63, and corrects the first and second command values such that the first and second allowable torques AT1 and AT2 set to the first and second regulators 120 and 220 decrease as the estimated consumed torque of the third main pump 300 increases. Thereby, advantages similar to the first embodiment such as an advantage that torque allocation can be performed efficiently between the first and second main pumps 100 and 200 in total horsepower control of the first and second main pumps 100 and 200, and the torque generated by the prime mover 1 can be utilized effectively without being wasted can be attained in a 3-pump system including the third main pump 300.

Third Embodiment

—Configuration—

Figure 17:
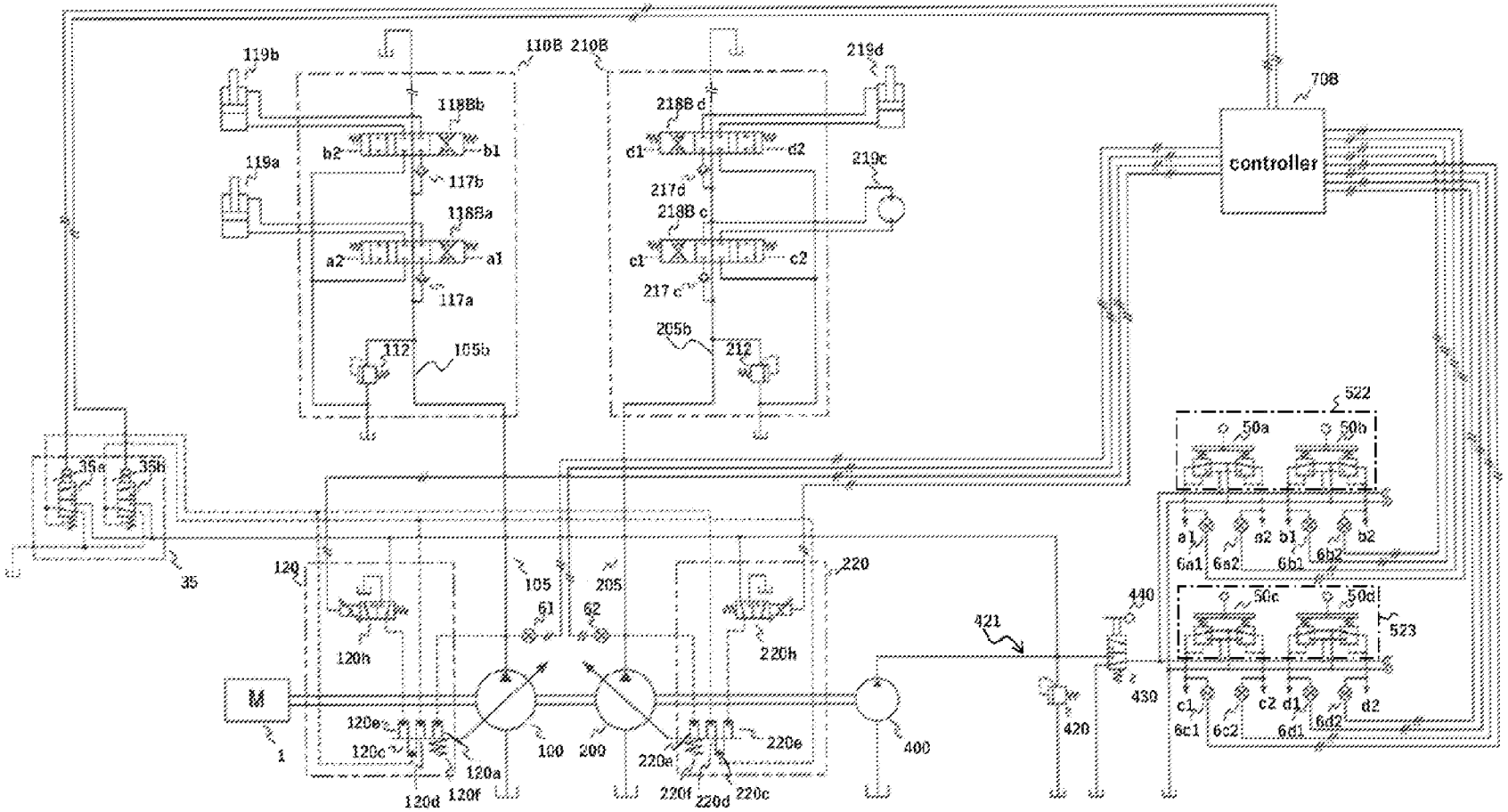
FIG. 17 is a figure illustrating the hydraulic drive system for a construction machine in a third embodiment of the present invention.

FIG. 17 is a figure illustrating the hydraulic drive system for the construction machine in a third embodiment of the present invention.

Similar to the first embodiment, the hydraulic drive system in the present embodiment comprises: the prime mover 1 (diesel engine); the first and second variable displacement main pumps 100 and 200 and the fixed delivery flow rate pilot pump 400; the first regulator 120, the second regulator 220, the plurality of first actuators 119*a* and 119*b*; the plurality of second actuators 219*c* and 219*d*; the first hydraulic fluid supply line 105; the second hydraulic fluid supply line 205; a first control valve block 110B; and a second control valve block 210B.

The first control valve block 110B includes: a hydraulic line 105*b* whose upstream side is connected to the first hydraulic fluid supply line 105, and downstream side is connected to the tank; a plurality of first open center flow control valves 118Ba, 118Bb, . . . that are arranged on the hydraulic line 105*b*, and introduce the hydraulic fluid supplied from the first main pump 100 to the plurality of first actuators 119*a*, 119*b*, . . . ; the plurality of check valves 117*a*, 117*b*, . . . that are arranged on the respective meter-in hydraulic lines of the first flow control valves 118Ba, 118Bb, . . . , and prevent the counterflow of the hydraulic fluid; and the main relief valve 112 that is connected to the hydraulic line 105*b*, and controls the pressure P1 of the first hydraulic fluid supply line 105 such that the pressure P1 does not become equal to or higher than a set pressure.

The second control valve block 210B includes: a hydraulic line 205*b* whose upstream side is connected to the second hydraulic fluid supply line 205, and downstream side is connected to the tank; a plurality of second open center flow control valves 218Bc, 218Bd, . . . that are arranged on the hydraulic line 205*b*, and introduce the hydraulic fluid supplied from the second main pump 200 to the plurality of second actuators 219*c*, 219*d*, . . . ; the plurality of check valves 217*c*, 217*d*, . . . that are arranged on the respective meter-in hydraulic lines of the second flow control valves 218Bc, 218Bd, . . . , and prevent the counterflow of the hydraulic fluid; and the main relief valve 212 that is connected to the hydraulic line 205*b*, and controls the pressure P2 of the second hydraulic fluid supply line 205 such that the pressure P2 does not become equal to or higher than a set pressure.

The hydraulic fluid supply line of the fixed delivery flow rate pilot pump 400 is not provided with the prime mover rotation speed sensing valve 410, which is included in the first embodiment, but the pilot hydraulic pressure source 421 is formed directly thereon. Similar to the first embodiment, the plurality of remote control valves 50*a*, 50*b*, 50*c*, 50*d*, . . . and the selector valve 430 are arranged downstream of the pilot hydraulic pressure source 421.

Similar to the first embodiment, the first regulator 120 of the first main pump 100 includes the torque control piston 120*a*, the flow rate control piston 120*e*, the increase torque control piston 120*c*, the reduction torque control piston 120*d*, and the spring 120*f*.

In addition, instead of the LS valve 120*g* in the first embodiment, the first regulator 120 includes a first flow control valve 120*h* that introduces the constant pilot pressure Pi0 to the flow rate control piston 120*e*, and reduces the delivery flow rate of the first main pump 100 when the first command value output from a controller 70B is 0, and releases the hydraulic fluid of the flow rate control piston 120*e* to the tank, increases the displacement of the first main pump 100, and increases the delivery flow rate of the first main pump 100 when the first command value is not 0.

Similar to the first embodiment, the second regulator 220 of the second main pump 200 includes the torque control piston 220*a*, the flow rate control piston 220*e*, the increase torque control piston 220*c*, the reduction torque control piston 220*d*, and the spring 220*f*.

In addition, instead of the LS valve 220*g* in the first embodiment, the second main pump 200 includes a second flow control valve 220*h* that introduces the constant pilot pressure Pi0 to the flow rate control piston 220*e*, and reduces the delivery flow rate of the second main pump 200 when the second command value output from the controller 70B is 0, and releases the hydraulic fluid of the flow rate control piston 220*e* to the tank, increases the displacement of the second main pump 200, and increases the delivery flow rate of the second main pump 200 when the second command value is not 0.

As explained about the first embodiment, the spring 120*f* of the first regulator 120 sets the first initial allowable torque T1*i* when the output pressures of the first and second torque control valves 35*a* and 35*b* introduced to the increase torque control piston 120*c* and the reduction torque control piston 120*d* are 0, and the first initial allowable torque T1*i* is set as follows:

$$T1i=((\text{total output torque } T\text{Eng of prime mover 1})-(\text{consumed torque } T4 \text{ of pilot pump 400}))/2$$

Similarly, the spring 220*f* of the second regulator 220 sets the second initial allowable torque T2*i* when the output pressures of the first and second torque control valves 35*a* and 35*b* introduced to the increase torque control piston 220*c* and the reduction torque control piston 220*d* are 0, and the second initial allowable torque T2*i* is set as follows:

$$T2i=((\text{total output torque } T\text{Eng of prime mover 1})-(\text{consumed torque } T4 \text{ of pilot pump 400}))/2$$

In addition, similar to the first embodiment, the construction machine hydraulic drive system comprises: the first pressure sensor 61; the second pressure sensor 62; the pressure sensors 6*a*1, 6*a*2, 6*b*1, 6*b*2, 6*c*1, 6*c*2, 6*d*1, 6*d*2, . . . ; the torque control valve block 35 including the first and second torque control valves 35*a* and 35*b*; and the controller 70B.

Details of the content of processes performed by the controller 70B in the present embodiment are explained. In the following explanation also, " . . . " in the plurality of first actuators 119*a*, 119*b*, . . . , the plurality of second actuators 219*c*, 219*d*, . . . , the remote control valves 50*a*, 50*b*, 50*c*, 50*d*, . . . , the operating pressures a1, a2, b1, b2, c1, c2, d1, d2, . . . , the pressure sensors 6*a*1, 6*a*2, 6*b*1, 6*b*2, 6*c*1, 6*c*2, 6*d*1, 6*d*2, . . . and the like is omitted for simplification of the explanation.

Figure 18:
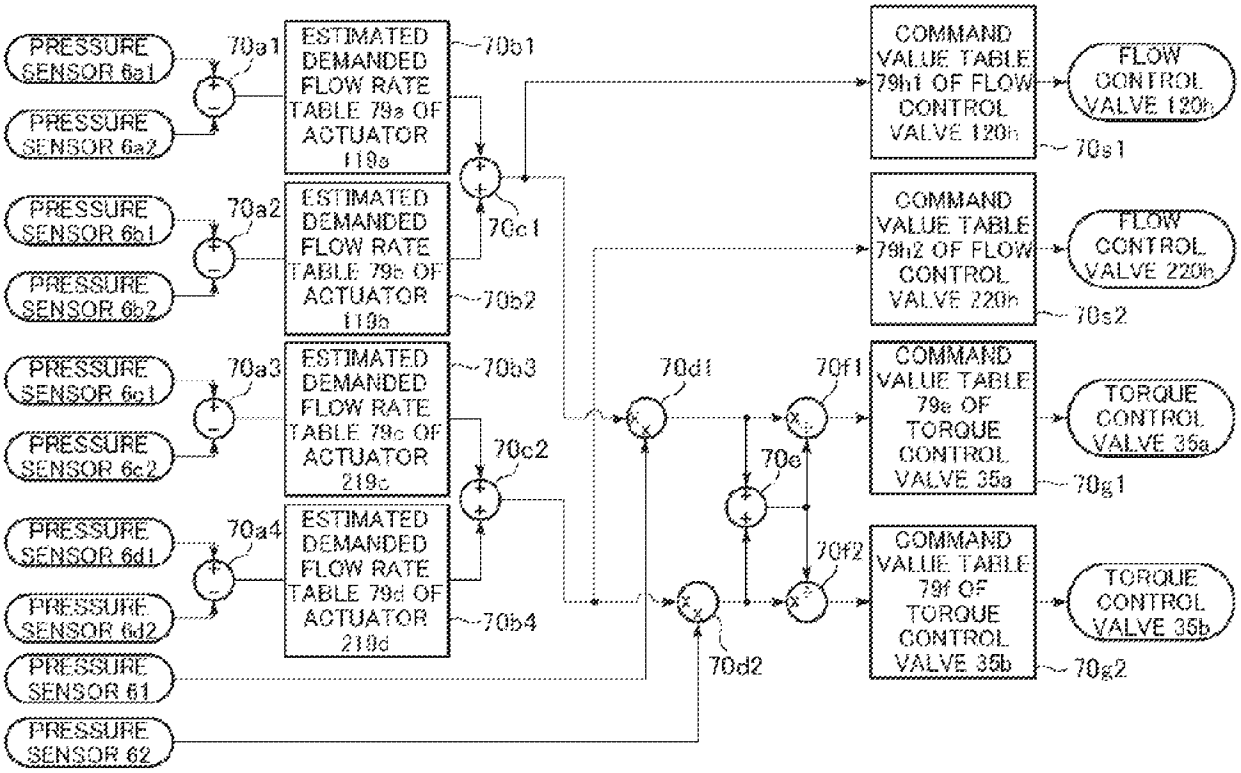
FIG. 18 is a functional block diagram illustrating the content of processes performed by a controller in the third embodiment of the present invention.

FIG. 18 is a functional block diagram illustrating the content of processes performed by the controller 70B.

Similar to the first embodiment, the controller 70B includes the subtracting sections 70*a*1, 70*a*2, 70*a*3, and 70*a*4, the estimated demanded flow rate computing sections 70*b*1, 70*b*2, 70*b*3, and 70*b*4, the adding sections 70*c*1 and 70*c*2, the multiplying sections 70*d*1 and 70*d*2, an adding section 70*e*1, the dividing sections 70*f*1 and 70*f*2, and the command value computing sections 70*g*1 and 70*g*2.

In addition, the controller 70B in the present embodiment includes command value computing sections 70*s*1 and 70*s*2, and, by using preset command value tables 79*hl* and 79*h*2 of the flow control valves 120*h* and 220*h*, the command value computing sections 70*s*1 and 70*s*2 calculate the first and second command values corresponding to the sum of the estimated demanded flow rates of the plurality of first actuators 119*a* and 119*b* and the sum of the estimated demanded flow rates of the plurality of second actuators 219*c* and 219*d* calculated at the adding sections 70*c*1 and 70*c*2, and output the first and second command values to the first and second flow control valves 120*h* and 220*h*.

Figure 19:
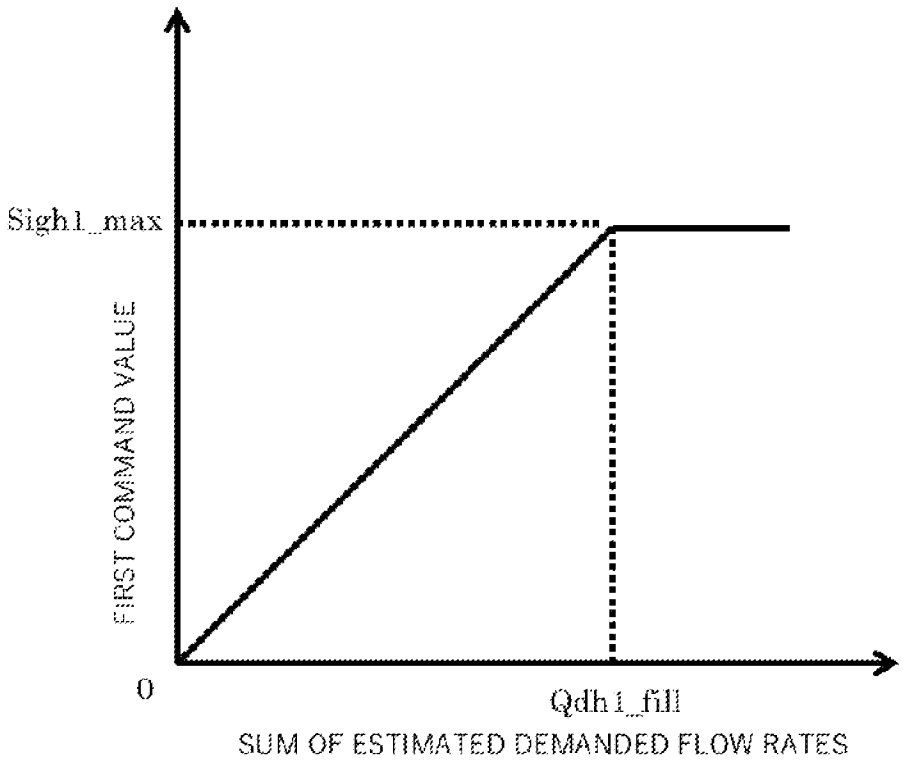
FIG. 19 is a figure illustrating characteristics of a command value table for calculating the first command value from the sum of estimated demanded flow rates of a plurality of first actuators.
Figure 20:
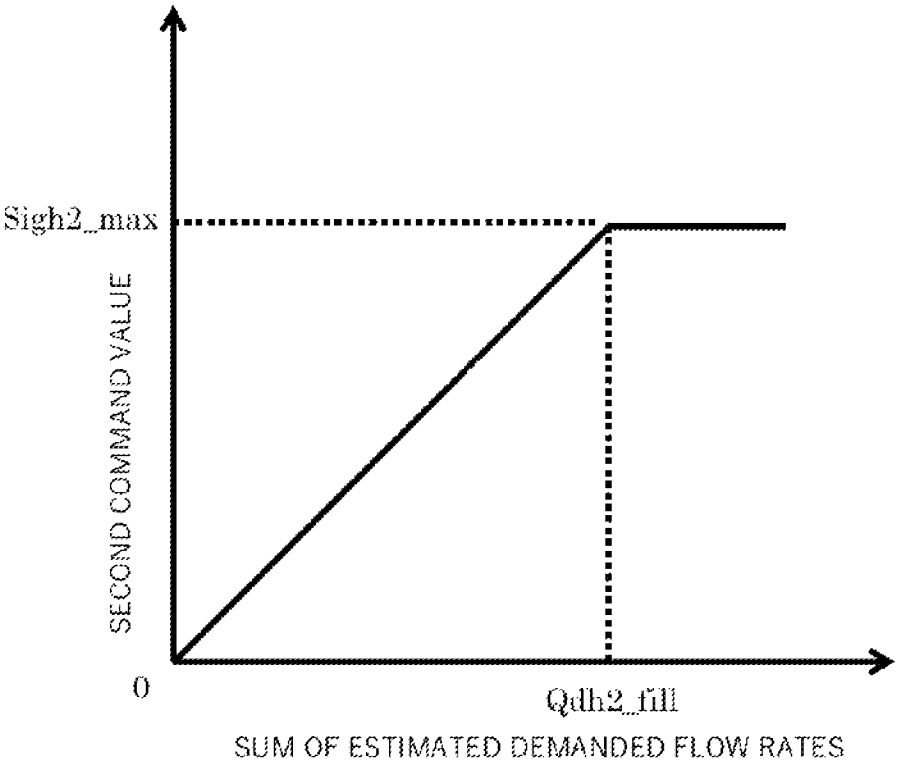
FIG. 20 is a figure illustrating characteristics of a command value table for calculating the second command value from the sum of estimated demanded flow rates of a plurality of second actuators.

FIG. 19 is a figure illustrating characteristics of the command value table 79*h*1 for calculating the first command value from the sum of estimated demanded flow rates of the plurality of first actuators 119*a* and 119*b*. FIG. 20 is a figure illustrating characteristics of the command value table 79*h*2 for calculating the second command value from the sum of estimated demanded flow rates of the plurality of second actuators 219*c* and 219*d*.

In the command value table 79*hl*, a relation between the first command value and the sum of the estimated demanded flow rates is set such that the first command value increases as the sum of the estimated demanded flow rates of the plurality of first actuators 119*a* and 119*b* increases, and the first command value becomes the maximum value when the sum of the estimated demanded flow rates becomes Qfill1.

Similarly, in the command value table 79*h*2 also, a relation between the second command value and the sum of the estimated demanded flow rates is set such that the second command value increases as the sum of the estimated demanded flow rates of the plurality of second actuators 219*c* and 219*d* increases, and the second command value becomes the maximum value when the sum of the estimated demanded flow rates becomes Qfill2.

Next, the controller 70B outputs, to the first and second flow control valves 120*h* and 220*h*, as electric signals, the first and second command values calculated at the command value computing sections 70*s*1 and 70*s*2.

Figure 21:
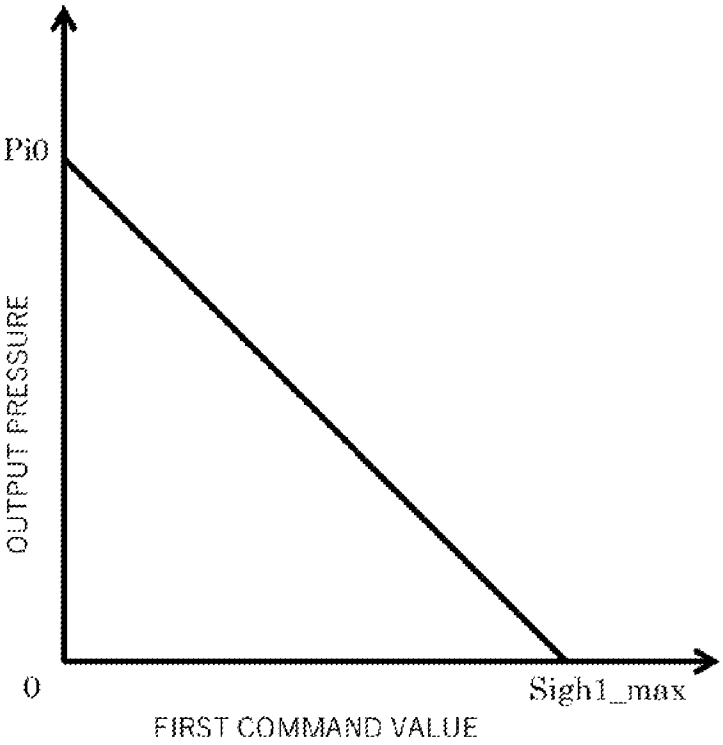
FIG. 21 is a figure illustrating output characteristics of a first flow control valve.
Figure 22:
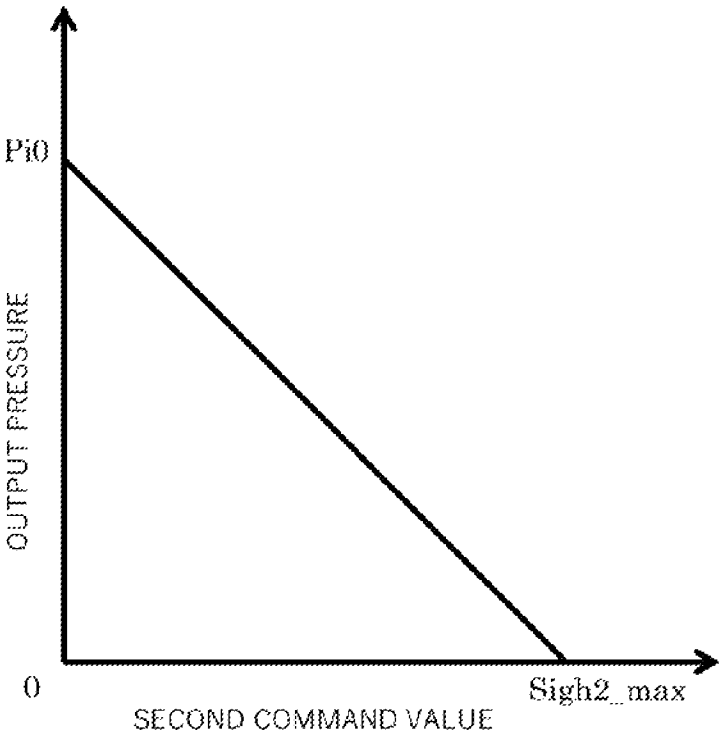
FIG. 22 is a figure illustrating output characteristics of a second flow control valve.

FIG. 21 and FIG. 22 are figures illustrating output characteristics of the first and second flow control valves 120*h* and 220*h*, respectively.

Both of the first and second flow control valves 120*h* and 220*h* have output characteristics of outputting smaller pressures as the first and second command values increase.

The output pressure of the first flow control valve 120*h* is introduced to the flow rate control piston 120*e* of the first regulator 120, and the output pressure of the second flow control valve 220*h* is introduced to the flow rate control piston 220*e* of the second regulator 220.

Figure 23:
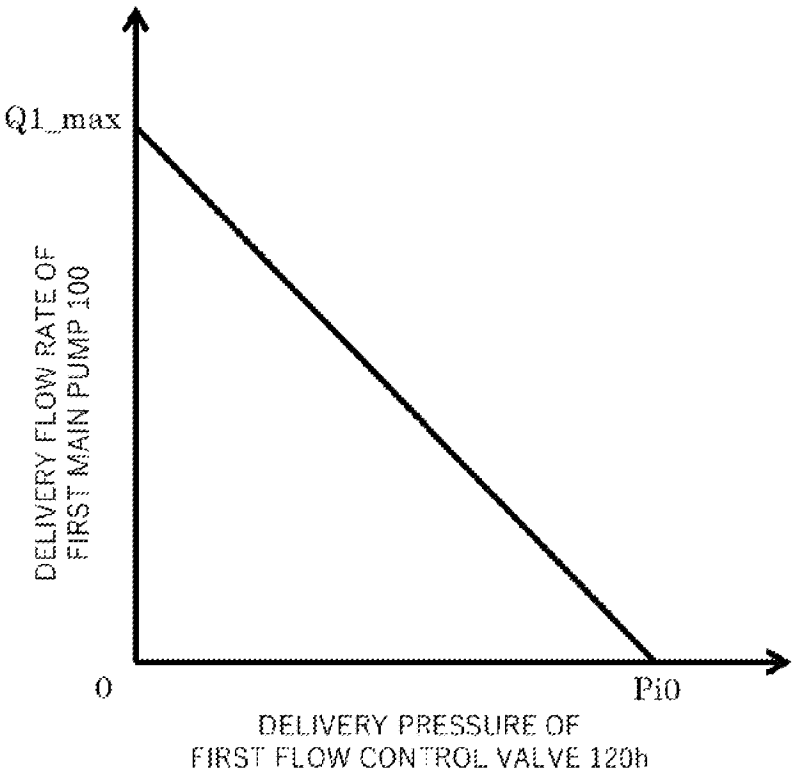
FIG. 23 is a figure illustrating a relation between the output pressure of the first flow control valve, and the delivery flow rate of the first main pump controlled by a flow rate control piston to which the output pressure of the first flow control valve is introduced.

FIG. 23 is a figure illustrating a relation between the output pressure of the first flow control valve 120*h* and the delivery flow rate of the first main pump 100 controlled by the flow rate control piston 120*e* to which the output pressure of the first flow control valve 120*h* is introduced.

Figure 24:
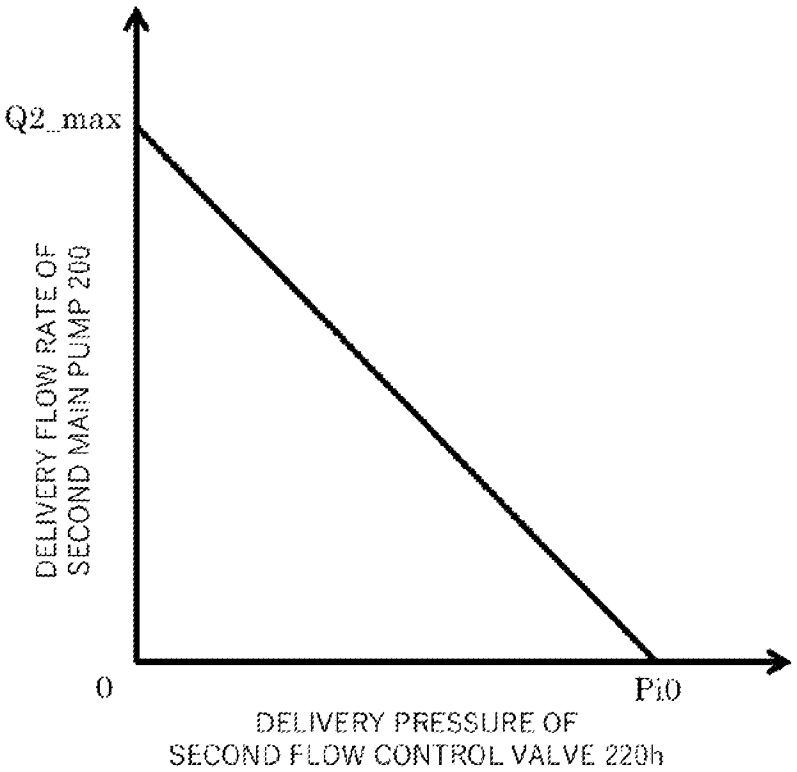
FIG. 24 is a figure illustrating a relation between the output pressure of the second flow control valve, and the delivery flow rate of the second main pump controlled by a flow rate control piston to which the output pressure of the second flow control valve is introduced.

FIG. 24 is a figure illustrating a relation between the output pressure of the second flow control valve 220*h* and the delivery flow rate of the second main pump 200 controlled by the flow rate control piston 220*e* to which the output pressure of the second flow control valve 220*h* is introduced.

As illustrated in FIG. 23, the delivery flow rate of the first main pump 100 decreases as the output pressure of the first flow control valve 120*h* increases. In addition, as illustrated in FIG. 24, the delivery flow rate of the second main pump 200 decreases as the output pressure of the second flow control valve 220*h* increases.

Thereby, the delivery flow rates of the first and second main pumps 100 and 200 are controlled such that the delivery flow rates increase as the first and second command values calculated at the command value computing section 70*s*1 and 70*s*2 increase.

That is, the command value computing section 70*s*1, the first flow control valve 120*h*, and the flow rate control piston 120*e* of the controller 70B are included in a so-called positive control section that performs control of increasing the delivery flow rate of the first main pump 100 according to the operating pressures a1, a2, b1, and b2 sensed by the pressure sensors 6*a*1, 6*a*2, 6*b*1, and 6*b*2 (the lever operation amount of the operation lever device 522), and the command value computing section 70*s*2, the flow control valve 220*h*, and the flow rate control piston 220*e* of the controller 70B are included in a so-called positive control section that performs control of increasing the delivery flow rate of the second main pump 200 according to the operating pressures c1, c2, d1, and d2 sensed by the pressure sensors 6*c*1, 6*c*2, 6*d*1, and 6*d*2 (the lever operation amount of the operation lever device 523).

In other respects, the configuration is the same as the first embodiment.

—Operation—

(a) Where all the Operation Levers are at the Neutral Positions

Since all the operation levers of the operation lever devices 522 and 523 are at the neutral positions, all the flow control valves 118Ba, 118Bb, 218Bc, and 218Bd are kept at the neutral positions by the springs provided at both ends thereof.

Since all the operation levers are at the neutral positions, the first and second command values output by the controller 70B to the flow control valves 120*h* and 220*h* are 0, the constant pilot pressure Pi0 is introduced to the flow rate control pistons 120*e* and 220*e*, and the delivery flow rates of the first and second main pumps 100 and 200 are kept at the minimum rates.

Whereas the hydraulic fluid delivered from the first main pump 100 at the minimum flow rate is fed to the first control valve block 110B via the first hydraulic fluid supply line 105, all the first flow control valves 118Ba and 118Bb are kept at the neutral positions, and the entire hydraulic fluid is returned to the tank through the center bypass hydraulic lines of the flow control valves 118Ba and 118Bb.

Whereas the hydraulic fluid delivered from the second main pump 200 at the minimum flow rate is fed to the second control valve block 210B via the second hydraulic fluid supply line 205, all the second flow control valves 218Bc and 218Bd are kept at the neutral positions, and the entire hydraulic fluid is returned to the tank through the center bypass hydraulic lines of the flow control valves 218Bc and 218Bd.

(b) Where Only the Operation Lever of the First Actuators is Operated

Since the operation lever of the operation lever device 523 of the second actuators 219*c* and 219*d* is at the neutral position, the delivery flow rate of the second main pump 200 is kept at the minimum rate as mentioned before.

When the operation lever of the operation lever device 522 of the first actuators 119*a* and 119*b* is operated, and for example, when the operating pressure a1 and the operating pressure b1 are generated, the flow control valves 118Ba and 118Bb switch to the right side in FIG. 17.

The first actuators 119*a* and 119*b* are supplied with the hydraulic fluid delivered from the first main pump 100 via the first hydraulic fluid supply line 105, the center bypass hydraulic lines of the flow control valves 118Ba and 118Bb, and the check valves 117*a* and 117*b*.

As mentioned before, the controller 70B outputs the first command value to the first flow control valve 120*h* according to the sum of the estimated demanded flow rates of the first actuators 119*a* and 119*b*.

In addition, as mentioned before, the controller 70B calculates, in accordance with the pressures signals input from the pressure sensors 6*a*1, 6*a*2, 6*b*1, 6*b*2, 6*c*1, 6*c*2, 6*d*1, 6*d*2, 61, and 62, the ratio between the sum of the estimated demanded powers of the first actuators 119*a* and 119*b* and the sum of the estimated demanded powers of the second actuators 219*c* and 219*d*, and, on the basis of these ratios, calculates the first and second command values for adjusting allocation between the first allowable torque AT1 of the first main pump 100 and the second allowable torque AT2 of the second main pump 200. At this time, since only the first actuators 119*a* and 119*b* are being operated, and the sum of the estimated demanded powers of the second actuators 219*c* and 219*d* equals 0, the first estimated demanded power ratio is 1.0 (100%), the second estimated demanded power ratio is 0 (0%), and the maximum first command value is output as an electric signal to the first torque control valve 35*a*.

As mentioned before, the first flow control valve 120*h* having received, as input, the first command value as an electric signal according to the sum of the estimated demanded flow rates of the first actuators 119*a* and 119*b* controls the displacement of the first main pump 100 such that the delivery flow rate becomes a rate according to the first command value.

The first torque control valve 35*a* having received, as input, the maximum first command value as an electric signal outputs the maximum pressure according to the first command value, the output pressure is introduced to the increase torque control piston 120*c* of the first regulator 120, the allowable torque AT1 of the first main pump 100 is set to the first maximum allowable torque AT11 (see FIG. 11), additionally the output pressure of the first torque control valve 35*a* is introduced to the reduction torque control piston 220*d* of the second regulator 220, and the allowable torque AT2 of the second main pump 200 is set to the second minimum allowable torque AT20 (see FIG. 11).

At this time, the consumed torque T1 of the first main pump 100 equals the quotient of the division of the consumed power of the first main pump 100 represented by (delivery pressure P1)×(delivery flow rate Q1) by the rotation speed of the first main pump 100. When the consumed torque T1 is smaller than the set first allowable torque AT1=AT11, the first main pump 100 operates according to positive control. When the consumed torque T1 is to become larger than the set first allowable torque AT1=AT11, the torque control piston 120*a* forcibly reduces the delivery flow rate of the first main pump 100, and the second main pump 200 operates according to horsepower control.

That is, where only the first actuators 119*a* and 119*b* are operated, the delivery flow rate of the second main pump 200 is kept at the minimum rate. The allowable torque AT1 of the first main pump 100 is set to the first maximum allowable torque AT11, and the first main pump 100 operates according to positive control if the consumed torque T1 of the first main pump 100 is within the range of the allowable torque AT1, and is subjected to horsepower control such that the delivery flow rate of the first main pump 100 is reduced forcibly when the consumed torque T1 is to become larger than the allowable torque AT1.

(c) Where Only the Operation Lever of the Second Actuators is Operated

Since the operation lever of the operation lever device 522 of the first actuators 119*a* and 119*b* is at the neutral position, the delivery flow rate of the first main pump 100 is kept at the minimum rate as mentioned before.

When the operation lever of the operation lever device 523 of the second actuators 219*c* and 219*d* is operated, and for example, when the operating pressure c1 and the operating pressure d1 are generated, the flow control valves 218Bc and 218Bd switch to the right side in FIG. 17.

The second actuators 219*c* and 219*d* are supplied with the hydraulic fluid delivered from the second main pump 200 via the second hydraulic fluid supply line 205, the respective center bypass hydraulic lines of the flow control valves 218Bc and 218Bd, and the check valves 217*c* and 217*d*.

As mentioned before, the controller 70B outputs the first command value to the second flow control valve 220*h* according to the sum of the estimated demanded flow rates of the second actuators 219*c* and 219*d*.

In addition, as mentioned before, the controller 70B calculates, in accordance with the pressures signals input from the pressure sensors 6*a*1, 6*a*2, 6*b*1, 6*b*2, 6*c*1, 6*c*2, 6*d*1, 6*d*2, 61, and 62, the ratio between the sum of the estimated demanded powers of the first actuators 119*a* and 119*b* and the sum of the estimated demanded powers of the second actuators 219*c* and 219*d*, and, on the basis of these ratios, calculates the first and second command values for adjusting allocation between the first allowable torque AT1 of the first main pump 100 and the second allowable torque AT2 of the second main pump 200. At this time, since only the second actuators 219*c* and 219*d* are being operated, and the sum of the estimated demanded powers of the first actuators 119*a* and 119*b* equals 0, the first estimated demanded power ratio is 0 (0%), the second estimated demanded power ratio is 1.0 (100%), and the maximum second command value is output as an electric signal to the second torque control valve 35*b*.

As mentioned before, the second flow control valve 220*h* having received, as input, the second command value as an electric signal according to the sum of the estimated demanded powers of the second actuators 219*c* and 219*d* controls the displacement of the second main pump 200 such that the delivery flow rate becomes a rate according to the second command value.

The second torque control valve 35*b* having received, as input, the maximum second command value as an electric signal outputs the maximum pressure according to the second command value, the output pressure is introduced to the increase torque control piston 220*c* of the second regulator 120, the allowable torque AT2 of the second main pump 200 is set to the second maximum allowable torque AT21 (see FIG. 12), additionally the output pressure of the second torque control valve 35*b* is introduced to the reduction torque control piston 120*b* of the first regulator 120, and the allowable torque AT1 of the first main pump 100 is set to the first minimum allowable torque AT10 (see FIG. 12).

At this time, the consumed torque T2 of the second main pump 200 equals the quotient of the division of the consumed power of the second main pump 200 represented by (delivery pressure P2)×(delivery flow rate Q2) by the rotation speed of the second main pump 200. When the consumed torque T2 is smaller than the set second allowable torque AT2=AT21, the second main pump 200 operates according to positive control. When the consumed torque T2 is to become larger than the set second allowable torque AT2=AT21, the torque control piston 220*a* forcibly reduces the delivery flow rate of the second main pump 200, and the second main pump 200 operates according to horsepower control.

That is, where only the second actuators 219*c* and 219*d* are operated, the delivery flow rate of the first main pump 100 is kept at the minimum rate. The allowable torque AT2 of the second main pump 200 is set to the second maximum allowable torque AT21, and the second main pump 200 operates according to positive control if the consumed torque T2 of the second main pump 200 is within the range of the allowable torque AT2, and is subjected to horsepower control such that the delivery flow rate of the second main pump 200 is reduced forcibly when the consumed torque T2 is to become larger than the allowable torque AT2.

(d) Where the Operation Levers of the First Actuators and the Second Actuators are Operated Simultaneously When the operation lever of the operation lever device 522 of the first actuators 119*a* and 119*b*, and the operation lever of the operation lever device 523 of the second actuators 219*c* and 219*d* are operated simultaneously, and the operating pressures a1 and b1 and the operating pressures c1 and d1 are generated, the flow control valves 118Ba and 118Bb switch to the right side in FIG. 17, and the flow control valves 218Bc and 218Bd switch to the left side in FIG. 17.

The first actuators 119*a* and 119*b* are supplied with the hydraulic fluid delivered from the first main pump 100 via the first hydraulic fluid supply line 105, the respective center bypass hydraulic lines of the flow control valve 118Ba and 118Bb and the check valves 117*a* and 117*b*, and the second actuators 219*c* and 219*d* are supplied with the hydraulic fluid delivered from the second main pump 200 via the second hydraulic fluid supply line 205, the center bypass hydraulic lines of the flow control valves 218Bc and 218Bd, and the check valves 217*c* and 217*d*.

As mentioned before, the controller 70B calculates, in accordance with input from the pressure sensors 6*a*1, 6*a*2, 6*b*1, 6*b*2, 6*c*1, 6*c*2, 6*d*1, 6*d*2, 61, and 62, the sum of the estimated demanded powers of the first actuators 119*a* and 119*b* and the sum of the estimated demanded powers of the second actuators 219*c* and 219*d*, calculates the first estimated demanded power ratio and the second estimated demanded power ratio, and, on the basis of these ratios, calculates the first and second command values for adjusting allocation between the first allowable torque AT1 of the first main pump 100 and the second allowable torque AT2 of the second main pump 200.

When the sum of the estimated demanded powers of the first actuators 119*a* and 119*b* is larger than the sum of the estimated demanded powers of the second actuators 219*c* and 219*d*, and for example, when the ratio between the sum of the estimated demanded powers of the first actuators 119*a* and 119*b* and the sum of the estimated demanded powers of the second actuators 219*c* and 219*d* is 70:30, the first estimated demanded power ratio is calculated as 0.7 (70%), and the second estimated demanded power ratio is calculated as 0.3 (30%). From these ratios, the controller 70B calculates a value corresponding to 0.7 (70%), which is the first estimated demanded power ratio, as the first command value for the first torque control valve 35*a* in accordance with the command value table 79*e* illustrated in FIG. 7, and calculates 0 as the second command value for the second torque control valve 35*b* in accordance with the command value table 79*f* illustrated in FIG. 8.

The calculated first and second command values are output to the first and second torque control valves 35*a* and 35*b* as electric signals, and the first and second torque control valves 35*a* and 35*b* output pressures according to the input first and second command values on the basis of the output characteristics illustrated in FIG. 9 and FIG. 10.

The output pressure of the first torque control valve 35*a* is introduced to the increase torque control piston 120*c* of the first regulator 120 and the reduction torque control piston 220*d* of the second regulator 220, the output pressure of the second torque control valve 35*b* is introduced to the increase torque control piston 220*c* of the second regulator 220 and the reduction torque control piston 120*d* of the first regulator 120, and the allowable torque AT1 of the first main pump 100 and the allowable torque AT2 of the second main pump 200 are set as follows.

$$AT1=((\text{total output torque } T\text{Eng of prime mover 1})-(\text{consumed torque } T4 \text{ of pilot pump 400}))\times 0.7$$

$$AT2=((\text{total output torque } T\text{Eng of prime mover 1})-(\text{consumed torque } T4 \text{ of pilot pump 400}))\times 0.3$$

When the sum of the estimated demanded powers of the first actuators 119*a* and 119*b* is smaller than the sum of the estimated demanded powers of the second actuators 219*c* and 219*d*, and for example, when the ratio between the sum of the estimated demanded powers of the first actuators 119*a* and 119*b* and the sum of the estimated demanded powers of the second actuators 219*c* and 219*d* is 40:60, the first estimated demanded power ratio is calculated as 0.4 (40*s*), and the second estimated demanded power ratio is calculated as 0.6 (60%). From these ratios, the controller 70B calculates 0 as the first command value for the first torque control valve 35*a* in accordance with the command value table 79*e* illustrated in FIG. 7, and calculates a value corresponding to 0.6 (60%), which is the second estimated demanded power ratio, as the second command value for the second torque control valve 35*b* in accordance with the command value table 79*f* illustrated in FIG. 8.

The calculated first and second command values are output to the first and second torque control valves 35*a* and 35*b* as electric signals, and the first and second torque control valves 35*a* and 35*b* output pressures according to the input first and second command values on the basis of the output characteristics illustrated in FIG. 9 and FIG. 10.

The output pressure of the second torque control valve 35*b* is introduced to the increase torque control piston 220*c* of the second regulator 220 and the reduction torque control piston 120*d* of the first regulator 120, the output pressure of the second torque control valve 35*b* is introduced to the increase torque control piston 220*c* of the second regulator 220 and the reduction torque control piston 120*d* of the first regulator 120, and the allowable torque AT1 of the first main pump 100 and the allowable torque AT2 of the second main pump 200 are set as follows.

$$AT1=((\text{total output torque } T\text{Eng of prime mover 1})-(\text{consumed torque } T4 \text{ of pilot pump 400}))\times 0.4$$

$$AT2=((\text{total output torque } T\text{Eng of prime mover 1})-(\text{consumed torque } T4 \text{ of pilot pump 400}))\times 0.6$$

At this time, when the consumed torque T1 of the first main pump 100 is smaller than the set first allowable torque AT1, the first main pump 100 operates according to positive control. When the consumed torque T1 is to become larger than the set first allowable torque AT1, the torque control piston 120*a* forcibly reduces the delivery flow rate of the first main pump 100, and the first main pump 100 operates according to horsepower control.

In addition, when the consumed torque T2 of the second main pump 200 is smaller than the set second allowable torque AT2, the second main pump 200 operates according to positive control. When the consumed torque T2 is to become larger than the set second allowable torque AT2, the torque control piston 220*a* forcibly reduces the delivery flow rate of the second main pump 200, and the second main pump 200 operates according to horsepower control.

That is, where the first actuators 119*a* and 119*b* and the second actuators 219*c* and 219*d* are operated simultaneously, the allowable torques AT1 and AT2 of the first main pump 100 and the second main pump 200 are set to torques that are calculated by dividing the allowable torque (T1*i*+T2*i*) allocated to the first main pumps 100 and 200 according to the operating pressures a1 and b1 and operating pressures c1 and d1 of the operation lever devices 522 and 523, and the ratio between the sum of the estimated demanded powers of the first actuators 119*a* and 119*b* and the sum of the estimated demanded powers of the second actuators 219*c* and 219*d* calculated from the pressures P1 and P2 of the first and second hydraulic fluid supply lines 105 and 205, which are the delivery pressures of the first and second main pumps 100 and 200. The first main pump 100 is subjected to positive control when the consumed torque T1 of the first main pump 100 does not become larger than the allowable torque AT1, and is subjected to horsepower control such that the delivery flow rate of the first main pump 100 is reduced forcibly when that the consumed torque T1 is to become larger than the allowable torque AT1. The second main pump 200 is subjected to positive control when the consumed torque T2 of the second main pump 200 does not become larger than the allowable torque AT2, and is subjected to horsepower control such that the delivery flow rate of the second main pump 200 is reduced forcibly when the consumed torque T2 is to become larger than the allowable torque AT2.

—Advantages—

According to the present embodiment, advantages similar to the first embodiment can be attained in one that adopts positive control for the first and second regulators 120 and 220.

DESCRIPTION OF REFERENCE CHARACTERS

1: Prime mover
100: First main pump (first pump)
200: Second main pump (second pump)
300: Third main pump (third pump)
400: Pilot pump
120: First regulator
220: Second regulator
320: Third regulator
120*a*, 220*a*, 320*a*: Torque control piston
120*b*, 220*b*: Reduction torque control piston
120*c*: (First) increase torque control piston
220*c*: (Second) increase torque control piston
120*d*: (First) reduction torque control piston
220*d*: (Second) reduction torque control piston
120*e*, 220*e*: Flow rate control piston
120*f*, 220*f*, 320*f*: Spring
120*g*, 220*g*, 320*g*: LS valve
120*h*, 220*h*: Flow control valve
330: Torque estimating device
110: First control valve block
210: Second control valve block
310: Third control valve block
118*a*, 118*b*: First flow control valve
218*c*, 218*d*: Second flow control valve
318*e*, 218*d*: Second flow control valve (second embodiment)
218*c*, 318*f*: Third flow control valve (second embodiment)
119*a*, 119*b*: First actuator
219*c*, 219*d*: Second actuator
319*e*, 219*d*: Second actuator (second embodiment)
219*c*, 319*f*: Third actuator (second embodiment)
522, 523, 532, 533: Operation lever device
35*a*: First torque control valve
35*b*: Second torque control valve
70, 70A, 70B: Controller
50*a*, 50*b*, 50*c*, 50*d*, 50*e*, 50*f*: Remote control valve
6*a*1, 6*a*2, 6*b*1, 6*b*2, 6*c*1, 6*c*2, 6*d*1, 6*d*2, 6*e*1, 6*e*2: Pressure sensor (operation amount sensor)
61: First pressure sensor
62: Second pressure sensor
63: Third pressure sensor

The invention claimed is:

1. A hydraulic, drive system for a construction machine comprising:

a first pump and a second pump that are driven by a prime mover;

a plurality of first actuators driven by a hydraulic fluid delivered from the first pump;

a plurality of second actuators driven by a hydraulic fluid delivered from the second pump;

a plurality of first flow control valves that control the hydraulic fluid supplied to the plurality of first actuators;

a plurality of second flow control valves that control the hydraulic fluid supplied to the plurality of second actuators;

a plurality of operation lever devices that operate the plurality of first flow control valves and the plurality of second flow control valves, and drive the plurality of first actuators and the plurality of second actuators;

a first regulator that adjusts a delivery flow rate of the first pump; and a second regulator that adjusts a delivery flow rate of the second pump, the first regulator adjusting the delivery flow rate of the first pump such that a consumed torque of the first pump does not become larger than a first allowable torque, and adjusting the delivery flow rate of the first pump such that a total of the consumed torque of the first pump and a consumed torque of the second pump does not become larger than a predetermined allowable torque, the second regulator adjusting the delivery flow rate of the second pump such that the consumed torque of the second pump does not become larger than a second allowable torque, and adjusting the delivery flow rate of the second pump such that the total of the consumed torque of the first pump and the consumed torque of the second pump does not become larger than the predetermined allowable torque, wherein the construction machine hydraulic drive system further comprises:

a plurality of operation amount sensors that sense operation amounts of the plurality of operation lever devices;

a first pressure sensor that senses a delivery pressure of the first pump;

a second pressure sensor that senses a delivery pressure of the second pump;

a controller configured to calculate a ratio between a sum of estimated demanded powers of the plurality of first actuators and a sum of estimated demanded powers of the plurality of second actuators on a basis of sensed values of the plurality of operation amount sensors and sensed values of the first pressure sensor and the second pressure sensor, and output, on a basis of the ratio, a first command value and a second command value for adjusting allocation between the first allowable torque of the first pump and the second allowable torque of the second pump; and a first torque control valve and a second torque control valve that generate a first output pressure and a second output pressure on a basis of the output first command value and second command value, and the first regulator and the second regulator being configured to adjust the first allowable torque and the second allowable torque, on a basis of the first output pressure and the second output pressure, such that the first allowable torque and the second allowable torque become values to which the predetermined allowable torque is allocated according to the ratio.

2. The hydraulic drive system for the construction machine according to claim 1, further comprising:

a third pump driven by the prime mover;

a plurality of third actuators driven by a hydraulic fluid delivered from the third pump;

a plurality of third flow control valves that control the hydraulic fluid supplied to the plurality of third actuators;

a third regulator that adjusts a delivery flow rate of the third pump such that a delivery pressure of the third pump becomes higher than a maximum load pressure of the plurality of third actuators;

a torque estimating device configured to estimate a consumed torque of the third pump, generate a torque-estimated pressure by correcting the delivery pressure of the third pump, and output the torque-estimated pressure to the first regulator and the second regulator; and a third pressure sensor that senses the torque-estimated pressure generated by the torque estimating device, wherein the first regulator and the second regulator being configured to reduce the predetermined allowable torque by an amount corresponding to the consumed torque of the third pump on a basis of the torque-estimated pressure, and the controller is configured to calculate an estimated consumed torque of the third pump on a basis of a sensed value of the third pressure sensor, and correct the first command value and the second command value such that the first allowable torque and the second allowable torque set for the first regulator and the second regulator decrease as the estimated consumed torque of the third pump increases.

3. The hydraulic drive system for the construction machine according to claim 1, wherein the first regulator sets a first initial allowable torque allocated to the first pump to a half of the predetermined allowable torque, the second regulator sets a second initial allowable torque allocated to the second pump to a remaining half of the predetermined allowable torque, the first regulator being configured to increase the first allowable torque relative to the first initial allowable torque as a reference torque on a basis of the first output pressure of the first torque control valve, and reduce the first allowable torque relative to the first initial allowable torque as a reference torque on a basis of the second output pressure of the second torque control valve, and the second regulator being configured to reduce the second allowable torque relative to the second initial allowable torque as a reference torque on a basis of the first output pressure of the first torque control valve, and increase the second allowable torque relative to the second initial allowable torque as a reference torque on a basis of the second output pressure of the second torque control valve.

4. The hydraulic drive system for the construction machine according to claim 1, wherein the first regulator includes a first spring that sets a first initial allowable torque allocated to the first pump to a half of the predetermined allowable torque, and the second regulator includes a second spring that sets a second initial allowable torque allocated to the second pump to a remaining half of the predetermined allowable torque.

5. The hydraulic drive system for the construction machine according to claim 1, wherein the first regulator includes a first increase torque control piston that increases the first allowable torque on a basis of the first output pressure of the first torque control valve, and a first reduction torque control piston that reduces the first allowable torque on a basis of the second output pressure of the second torque control valve, and the second regulator includes a second reduction torque control piston that reduces the second allowable torque on a basis of the first output pressure of the first torque control valve, and a second increase torque control piston that increases the second allowable torque on a basis of the second output pressure of the second torque control valve.

* * * * *